US009534856B2

(12) United States Patent
Suzuki et al.

(10) Patent No.: US 9,534,856 B2
(45) Date of Patent: Jan. 3, 2017

(54) HEAT EXCHANGER

(75) Inventors: Yoshio Suzuki, Nagoya (JP); Tatsuo Kawaguchi, Mizuho (JP); Shigeharu Hashimoto, Okazaki (JP); Michio Takahashi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 406 days.

(21) Appl. No.: 13/491,709

(22) Filed: Jun. 8, 2012

(65) Prior Publication Data

US 2012/0247732 A1 Oct. 4, 2012

Related U.S. Application Data

(63) Continuation of application No. PCT/JP2010/072280, filed on Dec. 10, 2010.

(30) Foreign Application Priority Data

Dec. 11, 2009 (JP) ..... 2009-281439
Apr. 30, 2010 (JP) ..... 2010-105763

(51) Int. Cl.
*F28F 21/04* (2006.01)
*F28D 7/10* (2006.01)
*F28F 7/02* (2006.01)

(52) U.S. Cl.
CPC ..... *F28F 21/04* (2013.01); *F28D 7/10* (2013.01); *F28F 7/02* (2013.01)

(58) Field of Classification Search
CPC ..... F28D 21/0003; F28D 21/0005; F28D 21/0007; F28D 7/10; F01N 5/02; F01N 3/2889; F01N 2240/02; F28F 7/02; F28F 21/04

(Continued)

(56) References Cited

U.S. PATENT DOCUMENTS 4,787,443 A 11/1988 Fukatsu et al.
6,976,530 B2 * 12/2005 Hayashi et al. ..... 165/157

(Continued)

FOREIGN PATENT DOCUMENTS

CN 1378064 11/2002
EP 0 935 058 A2 8/1999

(Continued)

OTHER PUBLICATIONS

Translation of JP62009183 A, USPTO translation by McElroy Translation Company, Jun. 2014.*

(Continued)

*Primary Examiner* — Len Tran
*Assistant Examiner* — Hans Weiland
(74) *Attorney, Agent, or Firm* — Burr & Brown, PLLC

(57) ABSTRACT

There is provided a heat exchanger realizing downsizing, weight saving, and cost reduction in comparison with a conventional heat exchange element or heat exchanger. The heat exchanger is provided with a first fluid flow portion formed of a honeycomb structure having a plurality of cells partitioned by ceramic partition walls and extending from one end face to another end face in an axial direction to allow a heating medium as a first fluid to flow therein, and a second fluid flow portion formed of a casing containing the honeycomb structure therein, the casing having an inlet and an outlet for a second fluid, and the second fluid flowing on an outer peripheral face of the honeycomb structure to receive heat from the first fluid.

11 Claims, 52 Drawing Sheets

(58) Field of Classification Search
USPC ..... 165/154, 157, 164, 165
See application file for complete search history.

(56) References Cited

U.S. PATENT DOCUMENTS

| | | | | |
|---|---|---|---|---|
| 2008/0044621 | A1* | 2/2008 | Strauss | 428/108 |
| 2009/0041635 | A1* | 2/2009 | Berkey | F01N 13/0093 422/177 |
| 2010/0205946 | A1 | 8/2010 | Fukudome et al. | |

FOREIGN PATENT DOCUMENTS

| | | | | | |
|---|---|---|---|---|---|
| FR | 2 378 250 | A1 | | 8/1978 | |
| GB | 1 596 194 | A | | 8/1981 | |
| JP | 53-24374 | | | 3/1978 | |
| JP | 60-062591 | | | 4/1985 | |
| JP | 61-024997 | | | 2/1986 | |
| JP | 61-083897 | | | 4/1986 | |
| JP | 62-009183 | | | 1/1987 | |
| JP | 62009183 | A | * | 1/1987 | F28D 7/10 |
| JP | 63-60319 | | | 11/1988 | |
| JP | 02-150691 | | | 6/1990 | |
| JP | 06-288692 | | | 10/1994 | |
| JP | 09327627 | A | * | 12/1997 | B01J 35/04 |
| JP | 10-332223 | | | 12/1998 | |
| JP | 11-223478 | A | | 8/1999 | |
| JP | 2001-182543 | | | 7/2001 | |
| JP | 3572110 | | | 9/2004 | |
| JP | 2006-002738 | | | 1/2006 | |
| JP | 2009-156162 | | | 7/2009 | |

OTHER PUBLICATIONS

Machine Translation of JP 09327627 A—retrieved Jul. 9, 2014.*
Chinese Office Action (With English Translation), Chinese Application No. 201080056166.5, dated Sep. 10, 2013 (13 pages).
U.S. Appl. No. 13/852,144, filed Mar. 28, 2013, Miyazaki et al.
U.S. Appl. No. 13/895,656, filed May 16, 2013, Yoshida et al.
U.S. Appl. No. 14/036,379, filed Sep. 25, 2013, Suzuki, et al.
Japanese Office Action (Application No. 2011-545269) dated May 13, 2014 (with English translation).
U.S. Appl. No. 14/095,279, filed Dec. 3, 2013, Suzuki et al.
U.S. Appl. No. 14/140,918, filed Dec. 26, 2013, Kawaguchi et al.
Japanese Office Action (With English Translation), Japanese Office Action 2011-545269, dated Jan. 6, 2015 (8 pages).
International Search Report and Written Opinion (With English Translation), International Application No. PCT/JP2010/072280, dated Feb. 1, 2011 (12 pages).
European Search Report, European Application No. 10836080.1, dated Jan. 28, 2015 (6 pages).

* cited by examiner

HEAT EXCHANGER

BACKGROUND OF THE INVENTION

Field of the Invention

The present invention relates to a heat exchanger for transferring heat of the first fluid (high temperature side) to the second fluid (low temperature side).

Background Art

There is demanded a heat collection technique from a high temperature gas such as a combustion exchange gas from an engine. As gas/liquid heat exchangers, fin-provided tube-type heat exchangers for an automobile radiator, an outdoor unit for an air-conditioner, etc., are general. However, for collecting heat from gas such as automobile exhaust gas, a general metal heat exchanger has poor thermal resistance, and the use at high temperature is difficult. Therefore, thermally resistant metal material and ceramic material having thermal resistance, thermal shock resistance, corrosion resistance, and the like are suitable. Though there is known a heat exchanger made of heat resistant metal, heat resistant metal has problems such as difficulty in processing, high density and heavy weight, and low thermal conductivity besides high cost.

Patent Document 1 discloses a ceramic heat exchanger where passages for a heating medium is disposed from one end face to the other end face with forming a passage for a medium to be heated in a direction perpendicular to a gap between the passages for a heating medium.

Patent Document 2 discloses a ceramic heat exchanger where a plurality of ceramic heat exchangers each having a heating medium passage and a non-heating medium passage are formed therein are disposed in a casing by means of a string-shaped sealing material made of an unfired ceramic material between bonding faces of the heat exchangers.

However, since Patent Documents 1 and 2 do not have good productivity because they have many steps such as plugging and slit forming, the costs are high. In addition, since the passages of gas/liquid are disposed on every other line, the piping structure and the sealing structure of the fluid are complex. Further, a heat transfer coefficient of liquid is generally 10 to 100 times larger than that of gas, and, in these techniques, heat transfer area on the gas side becomes insufficient, and the heat exchangers are large in proportion to the heat transfer area of the gas regulating the heat exchanger performance.

In Patent Documents 3 and 4, there is a tendency of increase in costs because the honeycomb structural portion and the tube portion have to be manufactured separately and then bonded together to have poor productivity.

Patent Document 5 discloses a honeycomb heat exchanger where a ceramic honeycomb for passing a low temperature fluid therethrough is bonded unitarily to the outer peripheral portion of a ceramic honeycomb for passing a high temperature fluid therethrough by means of a ceramic cylindrical body. Both the ceramic honeycombs are bonded together to make the heat exchange area of the fluids wide, thereby aiming at a high heat exchange amount. However, heat is transferred between the outer peripheral wall of the central honeycomb formed body and the outer peripheral wall of the outer peripheral ceramic honeycomb for exchange, and there is a ceramic cylindrical body between them to inhibit the fluids from being mixed upon breakage. Therefore, the heat exchange route is long, and the thermal resistance of the solid portion is large, which is considered to have a large loss of heat exchange.

Patent Document 6 discloses an apparatus for evaporating liquid by bonding ceramic honeycombs together. Since liquid passes along the minimum distance of the high temperature portion honeycomb, sufficient heat exchange cannot be conducted.

Patent Document 7 discloses a reaction container for conducting a uniform combustion heat generation reaction by air and a fuel with a catalyst on a ceramic honeycomb with a low pressure loss. The outside medium to be heated is not flowing, and it has a large loss of heat exchange.

Patent Document 8 discloses a heat exchanger where heat of the ceramic honeycomb is transferred to the outside, thereby lowering the gas temperature and generating steam. There is a phase transition from liquid to steam, and a strong structure for supporting the volume change is required.

Patent Document 9 discloses an exhaust heat recovery system using a ceramic honeycomb. However, the exhaust heat recovery system uses a heat acoustic phenomenon.

Patent Document 10 discloses an engine exhaust gas heat exchanger. In the heat exchanger, a catalyst conducting exhaust gas purification is a honeycomb structure, and heat exchange is conducted by the gas spouting portion at the back of the honeycomb structure and the fluid flowing in the periphery of the gas spouting portion.

PRIOR ART DOCUMENT

Patent Document

Patent Document 1: JP-A-61-24997
Patent Document 2: JP-B-63-60319
Patent Document 3: JP-A-61-83897
Patent Document 4: JP-A-2-150691
Patent Document 5: JP-A-62-9183
Patent Document 6: JP-A-6-286692
Patent Document 7: JP-A-10-332223
Patent Document 8: JP-A-2001-182543
Patent Document 9: JP-A-2006-2738
Patent Document 10: JP-A-2009-156162

A conventional heat exchanger has a large size as an apparatus and high production costs. Alternatively, the heat exchange efficiency is not sufficient. The present invention aims to provide a heat exchanger which realizes downsizing, weight saving, and cost reduction in comparison with conventional heat exchange element, heat exchanger, and the like.

SUMMARY OF THE INVENTION

The present inventors found out that the aforementioned problems can be solved by a heat exchanger where the first fluid is allowed to flow in cells of a honeycomb structure and where the second fluid is allowed to flow on the outer peripheral face of the honeycomb structure in the casing. That is, according to the present invention, the following heat exchanger is provided.

According to a first aspect of the present invention, a heat exchanger comprises: a first fluid flow portion formed of a honeycomb structure having a plurality of cells partitioned by ceramic partition walls and extending from one end face to the other end face in an axial direction to allow a heating medium as a first fluid to flow therein, and a second fluid flow portion formed of a casing containing the honeycomb structure therein, the casing having an inlet and an outlet for a second fluid, and the second fluid flowing on an outer peripheral face of the honeycomb structure in direct or indirect contact with the outer peripheral face to receive heat from the first fluid.

According to a second aspect of the present invention, the heat exchanger according to the first aspect is provided, wherein the first fluid is gas, the second fluid is liquid, and the first fluid has a higher temperature than that of the second fluid.

According to the third aspect of the present invention, the heat exchanger according to the first or second aspect is provided, having a fin for transferring heat from and to the second fluid flowing in the second fluid flow portion on the outer peripheral face of the honeycomb structure.

According to a fourth aspect of the present invention, the heat exchanger according to the first or second aspect is provided, wherein a metal plate or ceramic plate is provide so as to fit for at least a part of the outer peripheral face of the honeycomb structure.

According to a fifth aspect of the present invention, the heat exchanger according to the first or second aspect is provided, wherein a metal plate or ceramic plate is provided so as to fit for the entire outer peripheral face of the honeycomb structure to have a structure where the second fluid is not brought into direct contact with the outer peripheral face of the honeycomb structure.

According to a sixth aspect of the present invention, the heat exchanger according to the fourth or fifth aspect is provided, having a fin for transferring heat from and to the second fluid flowing in the second fluid flow portion on the outer peripheral face of the metal plate or the ceramic plate.

According to a seventh aspect of the present invention, the heat exchanger according to any one of the fourth through the sixth aspect is provided, with the metal plate or the ceramic plate fitted for the outer peripheral face of the honeycomb structure and the outside casing portion forming the second fluid flow portion outside the metal plate or the ceramic plate as a unitary body.

According to an eighth aspect of the present invention, the heat exchanger according to the first aspect is provided, wherein a tube formed of metal or ceramics with the internal portion serving as the second fluid flow portion is provided in the form of winding around the outer peripheral face of the honeycomb structure.

According to a ninth aspect of the present invention, the heat exchanger according to any one of the first through the sixth aspect is provided, wherein the honeycomb structure has an extended outer peripheral wall formed so as to cylindrically extend outside in an axial direction from an end face in the axial direction.

According to a tenth aspect of the present invention, the heat exchanger according to the ninth aspect is provided, wherein the casing is formed cylindrically in the form of covering a part of the outer peripheral face outside the outer peripheral face of the honeycomb structure, the second fluid flows in the casing and is brought into direct contact with the outer peripheral face to receive heat from the first fluid, and a honeycomb portion having the cells formed by the partition walls is disposed downstream with respect to the second fluid flow portion in the axial direction.

According to an eleventh aspect of the present invention, the heat exchanger according to the ninth aspect is provided, wherein the casing is formed cylindrically in the form of covering a part of the outer peripheral face outside the outer peripheral face of the honeycomb structure, the second fluid flows in the casing and is brought into direct contact with the outer peripheral face to receive heat from the first fluid, and the second fluid flow portion is disposed downstream in the axial direction with respect to the honeycomb portion having the cells formed by the partition walls.

According to a twelfth aspect of the present invention, the heat exchanger according to any one of the first through the eleventh aspect is provided, wherein the first fluid flow portion is constituted in such a manner that a plurality of honeycomb portions having the cells formed by the partition walls are disposed in line in the axial direction, and the honeycomb portions are disposed in such a manner that directions of the partition walls are different between the honeycomb portions in a cross section perpendicular to the axial direction.

According to a thirteenth aspect of the present invention, the heat exchanger according to any one of the first through the eleventh aspect is provided, wherein the first fluid flow portion is constituted so that a plurality of honeycomb portions having the cells formed by the partition walls are disposed in line in the axial direction, the honeycomb portions have different cell densities, and the honeycomb portions are disposed so that a honeycomb portion on the outlet side of the first fluid has a higher cell density than that of a honeycomb portion on the inlet side of the first fluid.

According to a fourteenth aspect of the present invention, the heat exchanger according to any one of the first through the thirteenth aspect is provided, wherein the plural honeycomb structures are disposed in the casing so that the outer peripheral faces face each other in a state of having a gap for allowing the second fluid to flow therein.

In a heat exchanger of the present invention, the structure is not complex, and downsizing, weight saving, and cost reduction can be realized in comparison with conventional heat exchange elements (heat exchanger or a device thereof). In addition, a heat exchanger of the present invention has a heat-transfer efficiency equivalent to or higher than that of conventional heat exchange elements.

DETAILED DESCRIPTION OF THE INVENTION

Hereinbelow, embodiments of the present invention will be described with referring to drawings. The present invention is by no means limited to the following embodiments, and changes, modifications, and improvements may be added as long as they do not deviate from the scope of the invention.

Figure 1A:
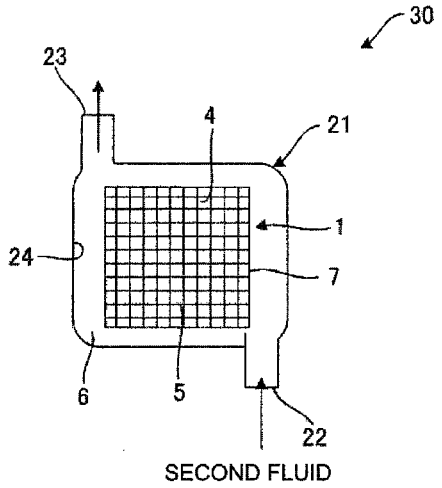
FIG. 1A is a schematic view showing an embodiment of a heat exchanger of the present invention viewed from the first fluid inlet side.
Figure 1B:
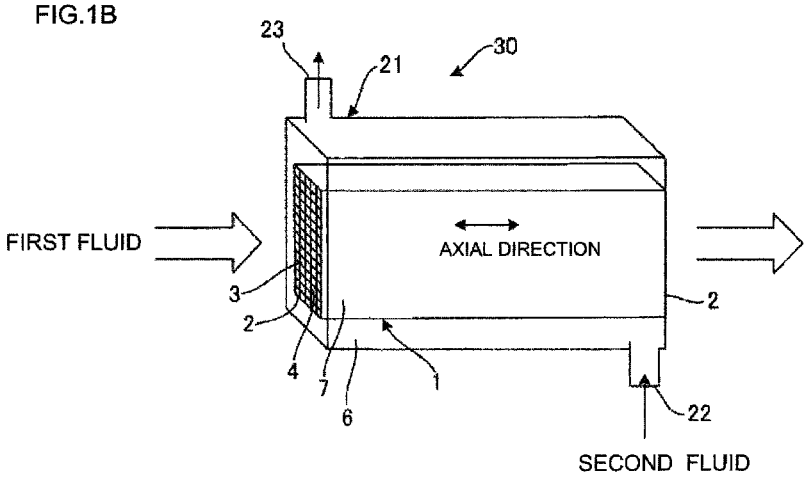
FIG. 1B is a perspective view showing an embodiment of a heat exchanger of the present invention, where the first fluid and the second fluid exchange heat by opposed flows.

FIG. 1A is a schematic view of a heat exchanger 30 of the present invention, and FIG. 1B is a schematic perspective view. The heat exchanger 30 is provided with a first fluid flow portion 5 formed of a honeycomb structure 1 having a plurality of cells 3 partitioned by ceramic partition walls 9 and extending from one end face 2 to the other end face 2 in an axial direction to allow the heating medium as a first fluid to flow therein, and a second fluid flow portion 6 formed of a casing 21 containing the honeycomb structure 1 therein, the casing 21 having an inlet 22 and an outlet 23 for the second fluid, and the second fluid flowing on an outer peripheral face 7 of the honeycomb structure 1 to receive heat from the first fluid. What the second fluid flows on the outer peripheral face 7 of the honeycomb structure 1 includes both the cases of the direct contact and the indirect contact of the second fluid to the outer peripheral face 7 of the honeycomb structure 1.

The honeycomb structure 1 put in the casing 21 has a plurality of cells 3 partitioned by ceramic partition walls 4 and extending from one end face 2 to the other end face 2 in an axial direction to allow a heating medium as the first fluid to flow therein. The heat exchanger 30 is configured in such a manner that the first fluid having higher temperature than that of the second fluid flows in the cells 3 of the honeycomb structure 1.

In addition, the second fluid flow portion 6 is formed by the inner peripheral face 24 of the casing 21 and the outer peripheral face 7 of the honeycomb structure 1. The second fluid flow portion 6 is a flow portion for the second fluid, formed by the casing 21 and the outer peripheral face 7 of the honeycomb structure 1, and separated from the first fluid flow portion 5 by the partition walls 4 of the honeycomb structure 1 to be able to conduct heat and receives the heat of the first fluid flowing in the first fluid flow portion 5 by means of the partition walls 4 to transfer the heat to the medium to be heated as the second fluid. The first fluid and the second fluid are completely separated from each other and never mixed together.

The first fluid flow portion 5 is formed as a honeycomb structure. In the case of a honeycomb structure, when a fluid passes through the cells 3, the fluid linearly proceeds from the inlet to the outlet of the honeycomb structure 1 without flowing into another cell because of the partition walls 4. Since the honeycomb structure 1 in the heat exchanger 30 of the present invention is not plugged, the size of the heat exchanger can be reduced because of the increase in the heat transfer area of the fluid. This enables to increase the heat transfer amount per unit volume of the heat exchanger. Further, since works such as formation of plugging portions and formation of slits in the honeycomb structure 1 are not necessary, the production cost of the heat exchanger 30 can be reduced.

It is preferable that a heat exchanger 30 of the present invention allows the first fluid having higher temperature than that of the second fluid to flow for heat conduction from the first fluid to the second fluid. The heat exchange between the first fluid and the second fluid can be performed efficiently when gas is allowed to flow as the first fluid while liquid is allowed to flow as the second fluid. That is, a heat exchanger 30 of the present invention can be employed as a gas/liquid heat exchanger.

In a heat exchanger 30 of the present invention, the heat of the first fluid can be transferred efficiently to the honeycomb structure 1 by allowing the first fluid having higher temperature than that of the second fluid to flow in the cells of the honeycomb structure 1. That is, though the total heat transfer resistance is total of the heat resistance of the first fluid, heat resistance of the partition walls, and heat resistance of the second fluid, the rate-determining factor is the heat resistance of the first fluid. In the heat exchanger 30, since the first fluid passes through the cells 3, the contact area of the honeycomb structure 1 with the first fluid is large, and therefore the heat resistance of the first fluid as the rate-determining factor can be reduced. Therefore, as shown in FIG. 1B, even if the length in the axial direction of the honeycomb structure 1 is made shorter than that of a side of an end face 2 in the axial direction, it is possible to sufficiently exchange heat in comparison with a conventional one. In addition, in a heat exchanger 30 of the present invention, since the second fluid flows in the portion having the widest surface area of the outermost periphery of the honeycomb structure 1, the retention time can be increased at the time of the same flow amount and flow rate to have less loss of heat exchange. Further, in the present invention, when the second fluid flowing in the second fluid flow portion 6 is liquid, since there is almost no volume change, a simple structure is sufficient for supporting the pressure of the liquid.

The embodiment shown in FIGS. 1A and 1B shows a heat exchanger 30 where the first fluid and the second fluid exchange heat by opposed flows. The "opposed flows" mean that the second fluid flows in the parallel and opposite direction to the direction of the first fluid flows. The direction in which the second fluid is allowed to flow is not limited to the direction opposite to the flow of the first fluid (opposed flow), and suitable selection and design are possible, such as the flow in the same direction (parallel flow) or at a certain angle ($0°<x<180°$: excluding a right angle).

While the production of a ceramic heat exchanger described as prior art needs steps of plugging, slit forming, and bonding of plural formed bodies or fired bodies, the present invention can basically employ extrusion forming, which can reduce the number of steps. While steps of press working, welding, etc., are necessary when the same structure is tried to be produced with heat resistant metal, the present invention does not require such steps. Therefore, the production costs can be reduced, and sufficient heat-transfer efficiency can be obtained.

A heat exchanger 30 of the present invention can be configured by the honeycomb structure 1 functioning as the first fluid flow portion 5 (high temperature side) having a honeycomb structure where the first fluid (heating medium) flows and the casing 21 having the inside portion functioning as the second fluid flow portion 6. Since the first fluid flow portion 5 is formed of the honeycomb structure 1, heat exchange can be performed efficiently. In the honeycomb structure 1, a plurality of cells 3 functioning as fluid passages are separated and formed by the partition walls 4, and, as the cell shape, a desired shape may suitably be selected from a circle, an ellipse, a triangle, a quadrangle, other polygons, and the like. Incidentally, when a large heat exchanger 30 is required, a module structure obtained by joining a plurality of honeycomb structures 1 may be employed (see FIG. 2A).

Figure 3:
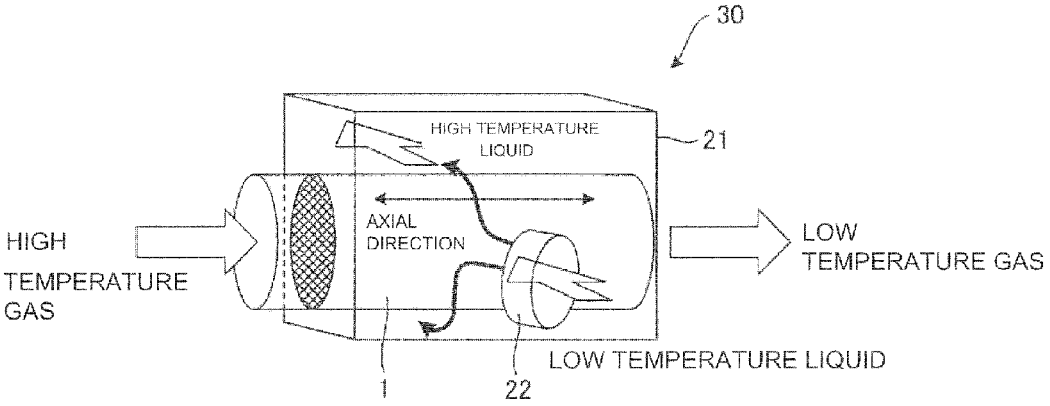
FIG. 3 is a view showing an embodiment of a heat exchanger containing a circular columnar honeycomb structure.

Though the shape of the honeycomb structure 1 is a quadrangular prism, the shape is not limited to the shape, and another shape such as a cylindrical shape may be employed (see FIG. 3).

There is no particular limitation on the cell density of the honeycomb structure 1 (i.e., the number of cells per unit cross-sectional area), and it may be designed according to the purpose. However, it is preferably within the range from 25 to 2000 cells/inch$^2$ (4 to 320 cells/cm$^2$). When the cell density is lower than 25 cells/inch$^2$, strength of the partition walls 4 and, as a result, strength of the honeycomb structure 1 itself and the effective GSA (geometric surface area) may become insufficient. On the other hand, when the cell density is higher than 2000 cells/inch$^2$, the pressure loss at the time that a heat medium flows may increase.

The number of cells per one honeycomb structure 1 (per one module) is desirably 1 to 10,000, more desirably 200 to 2,000. When the number of the cells is too large, heat conduction distance from the first fluid side to the second fluid side becomes long since the honeycomb itself becomes large, which increases heat conduction loss and reduces heat flux. When the number of the cells is small, the heat conduction area on the first fluid side is small, which cannot reduce heat resistance on the first fluid side, and heat flux is reduced.

There is no particular limitation on the thickness of the partition walls 4 (partition wall thickness) of the cells 3 of the honeycomb structure 1, and it may suitably be designed according to the purpose. The partition wall thickness is preferably 50 μm to 2 mm, more preferably 60 to 500 μm. When the partition wall thickness is below 50 μm, mechanical strength decreases, which may cause breakage due to a shock or thermal stress. On the other hand, when it is above 2 mm, there may be caused defects of fall of the rate of the cell capacity on the honeycomb structure side, increase of a pressure loss of the fluid, or fall of heat-transfer efficiency when a heat medium passes.

The density of the partition walls 4 of the cells 3 of the honeycomb structure 1 is preferably 0.5 to 5 g/cm$^3$. When it is below 0.5 g/cm$^3$, the partition walls 4 have insufficient strength, and therefore the partition walls 4 may have breakage due to the pressure when the first fluid pass through the passage. In addition, when it is above 5 g/cm$^3$, the honeycomb structure 1 itself becomes heavy to impair characteristics of weight saving. The density in the aforementioned range enables to make the honeycomb structure 1 strong. In addition, an effect of improving the heat conductivity coefficient can be obtained.

It is preferable to employ a ceramic material having excellent heat resistance for the honeycomb structure 1. In particular, silicon carbide is preferable in consideration of heat conductivity. However, the whole of the honeycomb structure 1 is not necessarily formed of silicon carbide, and it is sufficient that silicon carbide is contained in the main body. That is, the honeycomb structure 1 is preferably formed of conductive ceramic containing silicon carbide. Though the heat conductivity coefficient at room temperature is preferably 10 W/mK or more and 300 W/mK or less as a property of the honeycomb structure 1, it is not limited to this range. It is possible to use a corrosion resistant metal material such as a Fe—Cr—Al based alloy instead of conductive ceramic.

So that a heat exchanger 30 of the present invention may obtain high heat-transfer efficiency, it is more preferable to use a material containing silicon carbide having high heat conductivity for the honeycomb structure 1. However, since a porous body cannot obtain high heat conductivity coefficient even with silicon carbide, it is more preferable to impregnate the honeycomb structure 1 with silicon in the production process of the honeycomb structure 1 to obtain a dense structure. The dense structure enables have a high heat conductivity coefficient. For example, a silicon carbide porous body has a heat conductivity coefficient of about 20 W/mK while a dense body can have a heat conductivity coefficient of about 150 W/mK.

That is, though Si-impregnation SiC, (Si+Al)-impregnation SiC, metal composite SiC, $Si_3N_4$, SiC or the like may be employed, it is more desirable to employ Si-impregnation SiC or (Si+Al)-impregnation SiC in order to obtain a dense structure to obtain high heat-transfer efficiency. Since Si-impregnation SiC has a structure where a coagulation of metal silicon melt surrounds the surface of the SiC particles and where SiC particles are unitarily bonded together by means of metal silicon, silicon carbide is cut off from an atmosphere containing oxygen and protected from oxidation. Further, SiC has a characteristic of having high heat conductivity coefficient to make release of heat easy. However, Si-impregnation SiC is formed densely while showing high heat conductivity coefficient and high heat resistance, thereby showing sufficient strength as a heat transfer member. That is, a honeycomb structure 1 formed of a Si—SiC based (Si-impregnation SiC, (Si+Al)-impregnation SiC) material shows high heat conductivity coefficient as well as excellent properties of corrosion resistance against acid or alkali in addition to heat resistance, thermal shock resistance, and oxidation resistance.

More specific description will be given. In the case that the honeycomb structure 1 employs a Si-impregnation SiC composite material or a (Si+Al)-impregnation SiC as the main component, since a bonding material is insufficient when the Si content defined by Si/(Si+SiC) is too small, the bonding of SiC particles by the Si phase becomes insufficient. Therefore, the heat conductivity coefficient falls, and it becomes difficult to obtain strength capable of maintaining a structure with thin walls such as a honeycomb structure. In reverse, when the Si content is too large, the honeycomb structure 1 excessively shrinks by firing due to the presence of metal silicon more than necessary to be able to appropriately bond the SiC particles, which is not preferable in point of causing negative effects such as fall of the porosity and decrease of the average pore diameter. Therefore, Si content is preferably 5 to 50 mass %, more preferably 10 to 40 mass %.

In such Si-impregnation SiC or (Si+Al)-impregnation SiC, the pores are filled with metal silicon, there is a case that the porosity is 0 or nearly 0, and such Si-impregnation SiC or (Si+Al)-impregnation SiC has excellent oxidation resistance and durability, and thereby the use for a long period in high temperature atmosphere is possible. Since an oxidation protection film is formed when it is once oxidized, oxidation degradation is not caused. In addition, since it has high strength from ordinary temperature to high temperature, a thin and light structure can be formed. Further, since it has high heat conductivity coefficient which is almost the same as those of copper and aluminum metal, high far-infrared radiation emissivity, and electric conductivity, static electricity is hardly charged.

In the case that the first fluid (high temperature side) allowed to flow into a heat exchanger 30 of the present invention is exhaust gas, it is preferable that a catalyst is loaded on the partition walls inside the cells 3 of the honeycomb structure 1 where the first fluid (high temperature side) passes. This is because it becomes possible to exchange heat of the reaction heat (exothermic reaction) generated upon purification of exhaust gas. It is preferable that the catalyst contains at least one kind selected from the group consisting of noble metals (platinum, rhodium, palladium, ruthenium, indium, silver, and gold), aluminum, nickel, zirconium, titanium, cerium, cobalt, manganese, zinc, copper, zinc, tin, iron, niobium, magnesium, lanthanum, samarium, bismuth, and barium. These may be metals, oxides, and other compounds. The amount of the catalyst (catalyst metal+carrier) carried by the first fluid flow portion 5 of the honeycomb structure 1 where the first fluid (high temperature side) passes is preferably 10 to 400 g/L, and if the catalyst is a noble metal, the amount is more preferably 0.1 to 5 g/L. When the amount of the catalyst (catalyst metal+carrier) carried is below 10 g/L, the catalyst function may hardly be exhibited. On the other hand, when the amount is above 400 g/L, the production costs may increase as well as the increase of pressure loss. As necessary, the catalyst is loaded on the partition walls 4 of the cells 3 of the honeycomb structure 1. When the catalyst is loaded, masking is performed on the honeycomb structure 1 to be able to load the catalyst on the honeycomb structure 1. After a ceramic powder to function as carrier microparticles is impregnated with an aqueous solution containing the catalyst component, drying and firing are performed to obtain catalyst-coated microparticles. To the catalyst-coated microparticles were added a dispersion medium (water or the like) and other additives to prepare a coating solution (slurry), and, after the partition walls 4 of the honeycomb structure 1 are coated with the slurry, drying and firing are performed to load the catalyst on the partition walls 4 of the cells 3 of the honeycomb structure 1. Incidentally, upon firing, the mask on the honeycomb structure 1 is removed.

Figure 2A:
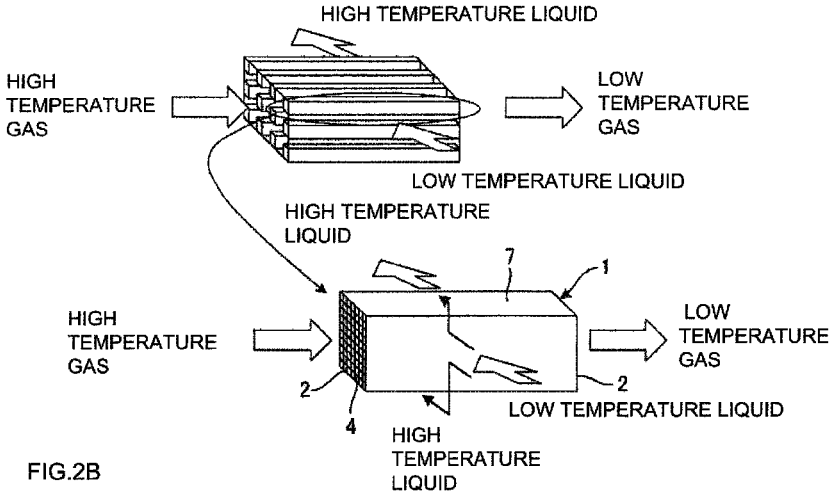
FIG. 2A is a view showing another embodiment of a heat exchanger of the present invention and schematically showing a disposition where a plurality of honeycomb structures are layered and where the first fluid and the second fluid exchange heat by orthogonal flows.

Another embodiment of a heat exchanger 30 is shown in FIG. 2A. In the heat exchanger 30 shown in FIG. 2A, a plurality of honeycomb structures 1 are disposed in such a manner that the outer peripheral faces 7 of the honeycomb structures face one another in a state of having a gap where the second fluid flows. Incidentally, FIG. 2A schematically shows a disposition of the honeycomb structure 1, where the casing 21 and the like are omitted. Specifically, the honeycomb structures 1 are layered to form a 4 (width)×3 (height) fashion with gaps. Such configuration can increase the number of the cells 3 where the first fluid flows, thereby allowing a large amount of the first fluid to flow therein. In addition, since a plurality of honeycomb structures 1 are disposed in such a manner that the outer peripheral faces 7 face one another with a gap therebetween, the outer peripheral face 7 of the honeycomb structure 1 has a large contact area with the second fluid, and therefore heat exchange between the first fluid and the second fluid can efficiently be performed.

Figure 2B:
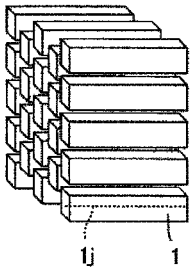
FIG. 2B is a perspective view showing an embodiment of an equilateral triangle checkerwise disposition of a plurality of honeycomb structures.
Figure 2C:
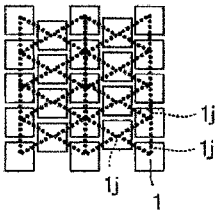
FIG. 2C is a view showing an embodiment of an equilateral triangle checkerwise disposition of a plurality of honeycomb structures viewed from the first fluid inlet side.

FIGS. 2B and 2C shows an embodiment of an equilateral triangle checkerwise disposition of a plurality of honeycomb structures 1. FIG. 2B is a perspective view, and FIG. 2C is a view from the first fluid inlet side. A plurality of honeycomb structures 1 are disposed in such a manner that the lines connecting the central axes 1*j* of the honeycomb structures 1 form equilateral triangles. Such a disposition enables to allow the second fluid to uniformly flow among the honeycomb structures 1 (among the modules), thereby improving heat-transfer efficiency. Therefore, in the case of disposing a plurality of honeycomb structures 1, an equilateral triangle checkerwise disposition is preferable. The equilateral triangle checkerwise disposition serves as a kind of fin structure, which makes the flow of the second fluid a turbulent flow, thereby making heat exchange with the first fluid easier.

Figure 2D:
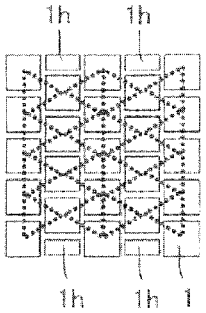
FIG. 2D is a view showing an embodiment where honeycomb structures having a different size are included.

FIG. 2D shows an embodiment where honeycomb structures 1 having different sizes are included. In the embodiment of FIG. 2D, complementary honeycomb structures 1*h* are disposed in gaps among the honeycomb structures 1 having an equilateral triangle checkerwise disposition. The complementary honeycomb structures 1*h* are for filling the gaps and have different size and shape from the ordinary honeycomb structures 1. That is, it is not necessary that all the honeycomb structures 1 have the same size and shape. The use of the complementary honeycomb structures 1*h* having different size and shape, the gaps between the casing 21 and honeycomb structures 1 can be filled, and the heat-transfer efficiency can be improved.

FIG. 3 shows an embodiment of a honeycomb structure 1 put in the casing 21 of a heat exchanger 30. In a honeycomb structure 1 shown in FIG. 3, a cross section perpendicular to the axial direction has a circular shape. That is, the honeycomb structure 1 shown in FIG. 3 is formed to have a cylindrical columnar shape. In the casing 21, a circular columnar honeycomb structure 1 may be put as shown in FIG. 3, or a plurality of circular columnar honeycomb structures 1 may be put. The shape of a cross section perpendicular to the axial direction of the honeycomb structure 1 may be a circle as shown in FIG. 3 or may be a quadrangle as shown in FIG. 1. Alternatively, it may be a hexagon as described later. In FIG. 3, the second fluid flows perpendicularly to the flow of the first fluid. However the flow of the second fluid may be an opposed flow with respect to the first fluid, and the positions of the inlet and the outlet are not particularly limited.

Figure 4A:
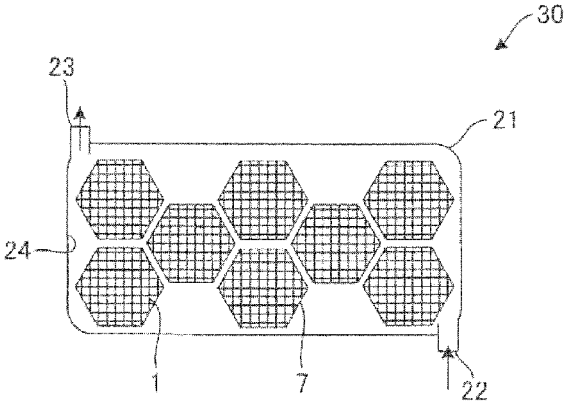
FIG. 4A is a view showing an embodiment of a heat exchanger containing hexagonal columnar honeycomb structures, viewed from the first fluid inlet side.
Figure 4B:
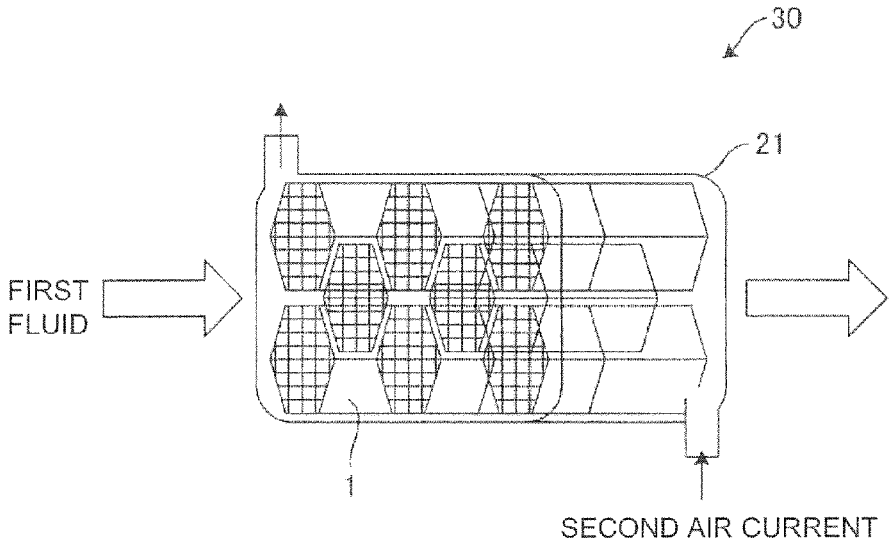
FIG. 4B is a perspective view showing an embodiment of a heat exchanger containing hexagonal columnar honeycomb structures.

FIGS. 4A and 4B shows an embodiment where the shape of a cross section perpendicular to the axial direction of the honeycomb structure 1 is a hexagon. The honeycomb structures 1 are disposed in a layered fashion in a state that the outer peripheral faces 7 face one another with having gaps where the second fluid flows. As described above, the honeycomb structure 1 may have a structure of a prism, a circular column, a hexagon, or the like, and they may be used in combination. The shapes may be selected in accordance with the shape of a heat exchanger 30.

Figure 5A:
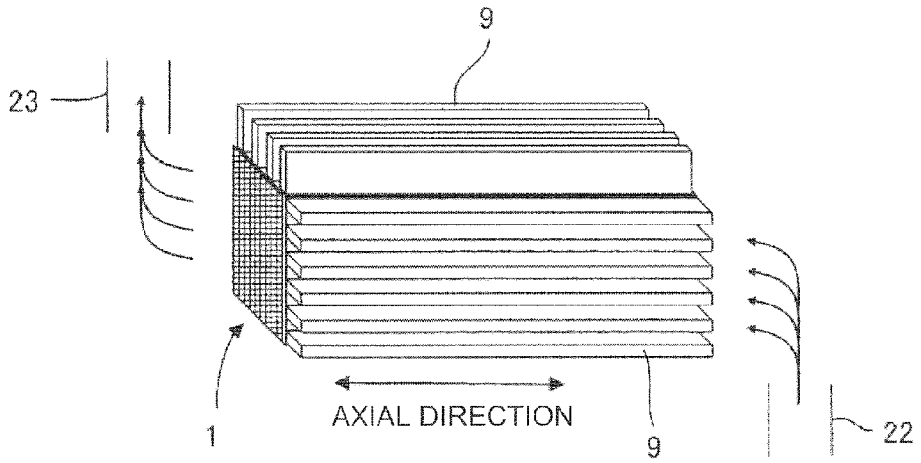
FIG. 5A is a perspective view showing an embodiment of a honeycomb structure having fins on the outer peripheral faces thereof.
Figure 5B:
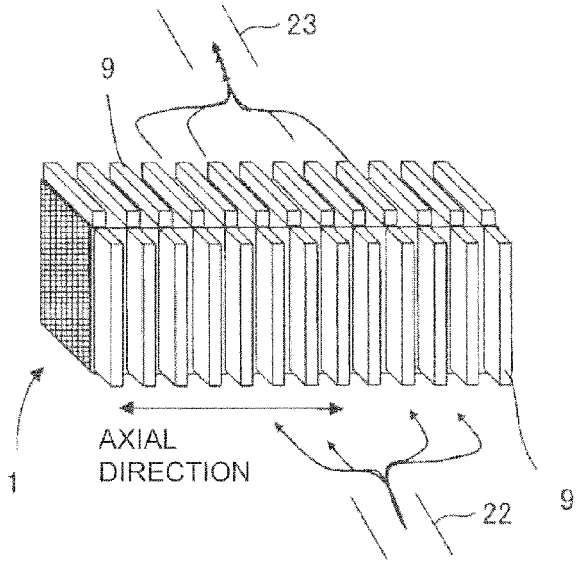
FIG. 5B is a perspective view showing another embodiment of a honeycomb structure having fins on the outer peripheral faces thereof.

FIGS. 5A and 5B shows an embodiment having fins 9 for transferring heat with the second fluid flowing in the second fluid flow portion 6 on the outer peripheral faces 7 of a honeycomb structure 1. FIG. 5A shows an embodiment having a plurality of fins 9 in the axial direction of the honeycomb structure 1. FIG. 5B shows an embodiment having a plurality of fins 9 in the direction perpendicular to the axial direction of the honeycomb structure 1. A heat exchanger 30 may be constituted so as to have one honeycomb structure 1 in the casing 21 or may be constituted so as to have a plurality of honeycomb structures 1. The material for the fins 9 is desirably the same as that for the honeycomb structure 1. The embodiment of FIG. 5A can be produced by extrusion by a die having fins 9 in the outer periphery of the honeycomb structure 1. The embodiment of FIG. 5B can be produced by bonding fins 9 formed independently in the outer periphery of the honeycomb structure 1 and being unitarily fired. The flow direction the second fluid is different between the embodiment of FIG. 5A and the embodiment of FIG. 5B. In the case that the inlet 22 and the outlet 23 for the second fluid are positioned apart from each other in the axial direction of the honeycomb structure 1, the fins 9 may have the shape of FIG. 5A. In the case that the inlet 22 and the outlet 23 are at positions perpendicular to the axial direction of the honeycomb structure 1 (the case that the inlet 22 and the outlet 23 are not positioned apart from each other in the axial direction), the fins 9 may have the shape of FIG. 5B.

Figure 6:
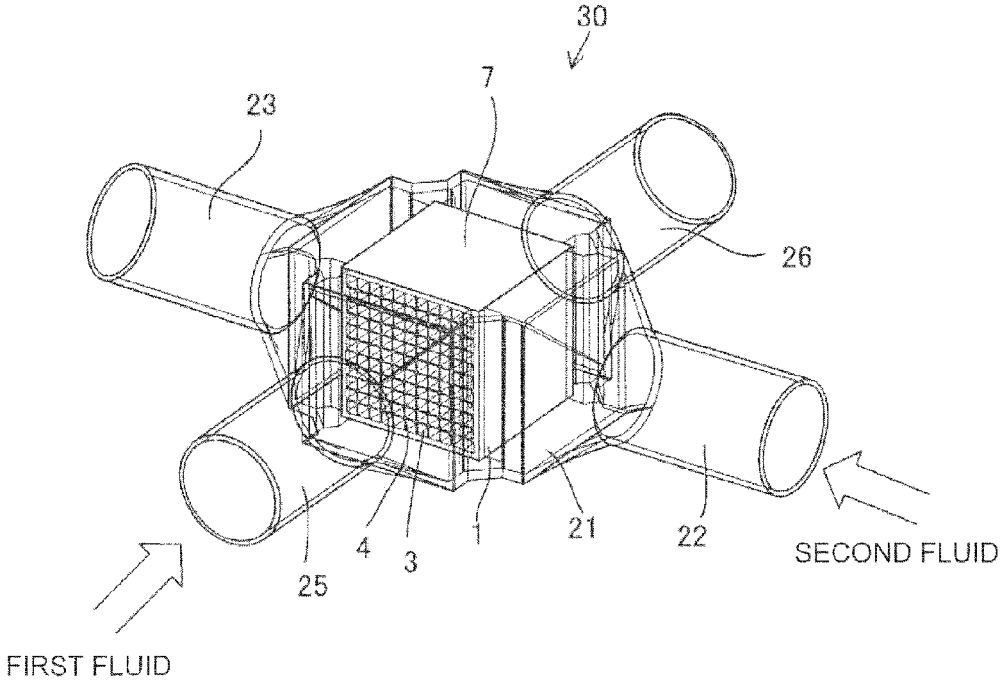
FIG. 6 is a view showing an embodiment of a heat exchanger of the present invention, having a honeycomb structure mounted therein.

FIG. 6 shows another embodiment of a heat exchanger 30 of the present invention. The heat exchanger 30 of the present invention of the present invention includes the honeycomb structure 1 and the casing 21 in which the honeycomb structure 1 is mounted. Though there is no particular limitation on the material for the casing 21, a metal having good workability (e.g., stainless steel) is preferable. There is no particular limitation on the material for the casing including the pipes connected thereto. In the casing 21 are formed the inlet 22 for allowing the second fluid to flow into the casing 21 and the outlet 23 for discharging the second fluid inside the casing 21 outside. In addition, there are formed the inlet 25 for the first fluid to allow the first fluid to directly flow into the cells 3 of the honeycomb structure 1 from outside and the outlet 26 for the first fluid to allow the first fluid in the cells 3 to be directly discharged outside. That is, the first fluid having flowed in from the first fluid inlet 25 exchanges heat with the second fluid without direct contact inside the casing 21 by the honeycomb structure 1 and is discharged from the first fluid outlet 26.

There is no particular limitation on the heating medium as the first fluid allowed to flow in a heat exchanger 30 of the present invention having a structure as described above as long as it is a medium having heat, such as gas or liquid. For example of gas, exhaust gas or the like of an automobile may be mentioned. There is no particular limitation on the medium to be heated as the second fluid which takes heat (exchanges heat) from the heating medium as long as it has lower temperature than that of the heating medium, such as gas or liquid. Though water is preferable in consideration of handling, it is not particularly limited to water.

As described above, since the honeycomb structure 1 has high heat conductivity and a plural portions functioning as fluid passages by the partition walls 4, high heat-transfer efficiency can be obtained. Therefore, the entire honeycomb structure 1 can be downsized and mounted on an automobile.

In the case of using a metal as the material for the casing, since metal is expanded in the longitudinal direction, strain is caused. The casing 21 preferably has a structure where the thermal expansion difference in the longitudinal direction of the casing 21 is absorbed by the casing 21. That is, the casing 21 preferably has a structure formed of plural constituent members which can move mutually and relatively.

Figure 7:
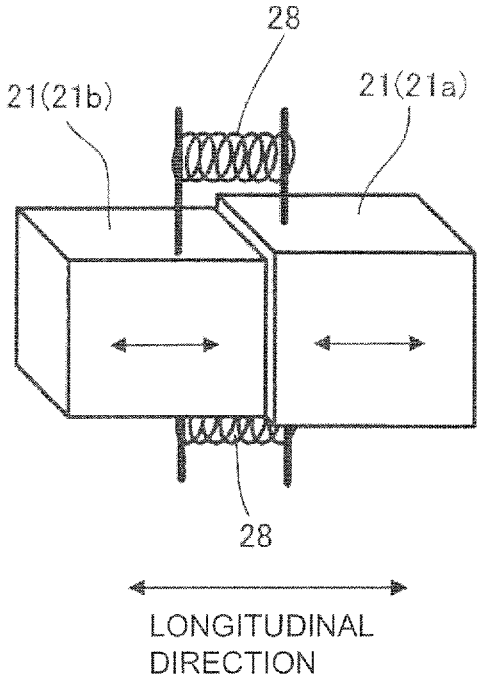
FIG. 7 is a schematic view showing an embodiment of a casing provided with an elastic member.

FIG. 7 shows an embodiment of a casing 21 provided with elastic members. The casing 21 is configured to separately have the first casing 21*a* and the second casing 21*b*, which are plural constituent members. Since, for example, a spring 28 is provided as the elastic member, the casing has a structure capable of changing the length in the longitudinal direction. This enables to absorb the expansion of the casing 21 at the time of high temperature by the change in shape of the spring. The shrinkage at the time of low temperature can be suppressed by the force of the spring.

Figure 8:
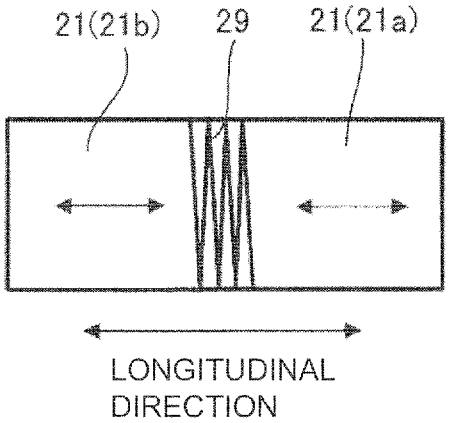
FIG. 8 is a schematic view showing an embodiment of a casing having an accordion portion.

FIG. 8 shows an embodiment of a casing 21 having an accordion portion. The casing 21 has plural constituent portions, where an accordion portion is formed between the first casing 21*a* and the second casing 21*b*. The first casing 21*a*, the accordion portion, and the second casing 21 *b* unitarily constitute the casing 21. This enables to change the length of the longitudinal direction, thereby absorbing the expansion at the time of high temperature and shrinkage at the time of low temperature by the accordion portion.

Figure 9:
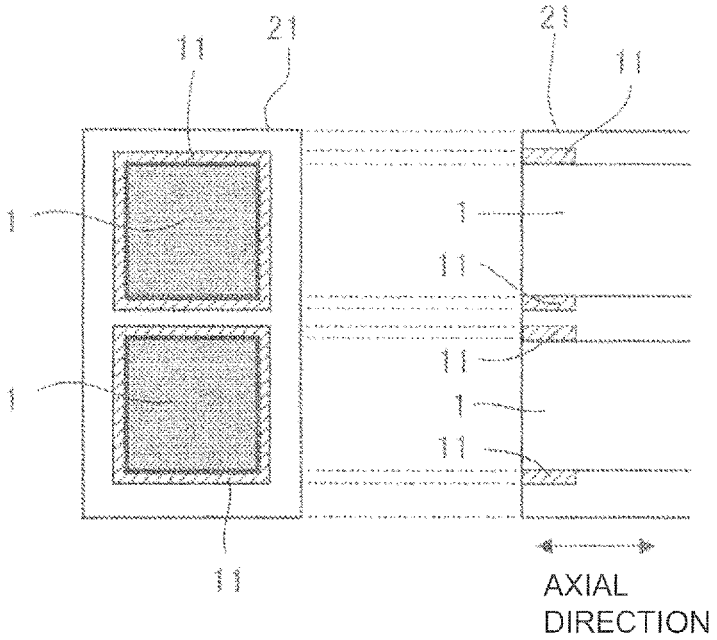
FIG. 9 is a schematic view for explaining sealing between the casing and the honeycomb structure.

The sealing between the honeycomb structure 1 and the casing 21 will be described by using FIG. 9. The gap between the honeycomb structure 1 and the casing 21 is sealed with a sealing material. In the case that the sealing material is different from the material for the honeycomb structure 1, they have different thermal expansion coefficient, and therefore a gap may be formed in the sealing portion. When a high temperature fluid flows in the honeycomb structure 1 while a low temperature fluid flows on the outer peripheral face 7 of the honeycomb structure 1 inside the casing 21, since the casing 21 has lower temperature and smaller thermal expansion, sealing is desirably maintained due to constriction from the outer periphery. When the honeycomb structure 1 is made of ceramic, as the sealing material, a metal material having heat resistance and elasticity can be mentioned.

Figure 13A:
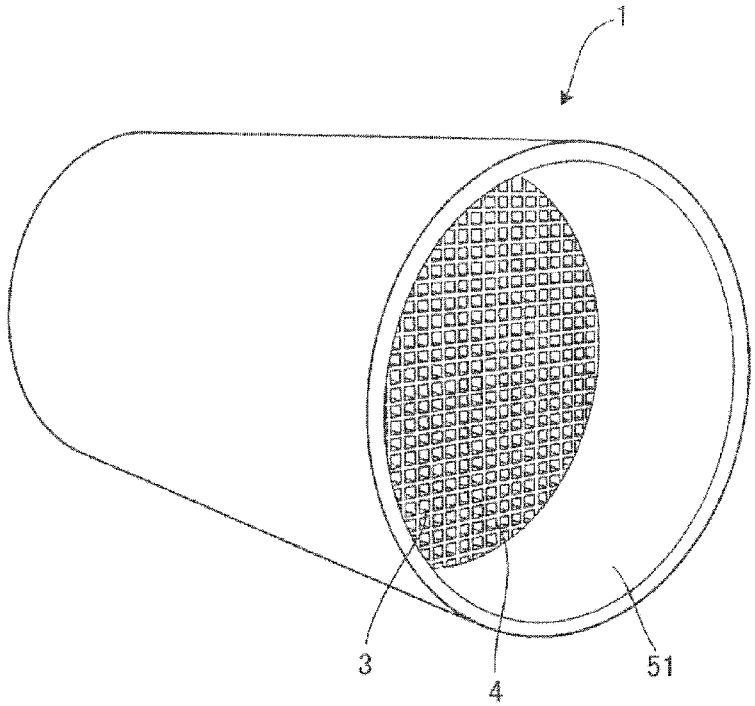
FIG. 13A is a view schematically showing a honeycomb structure having an extended outer peripheral wall.
Figure 13B:
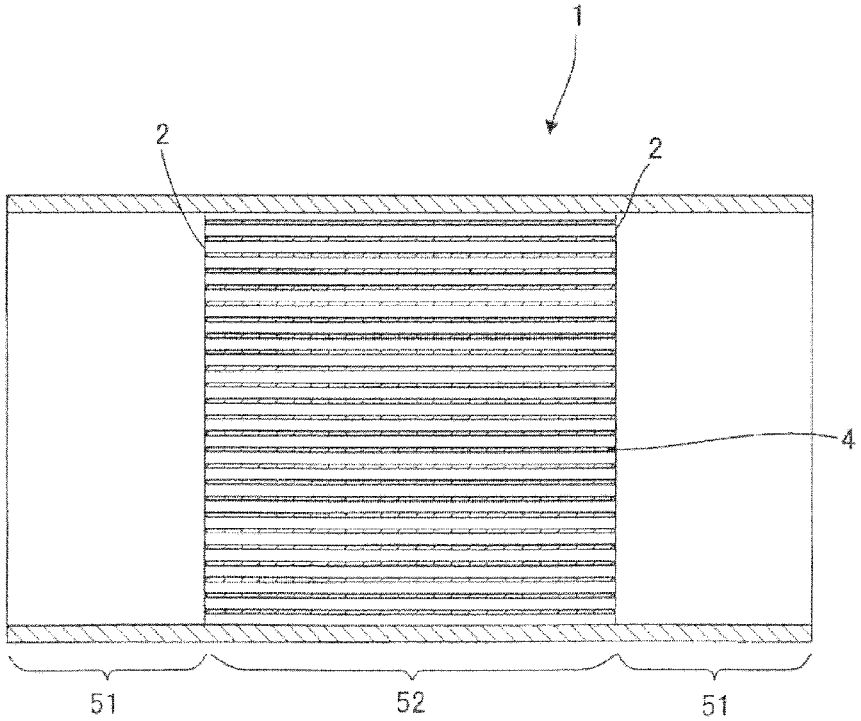
FIG. 13B is a cross-sectional view showing a honeycomb structure having an extended outer peripheral wall, cut along a cross section parallel to the axial direction.
Figure 14A:
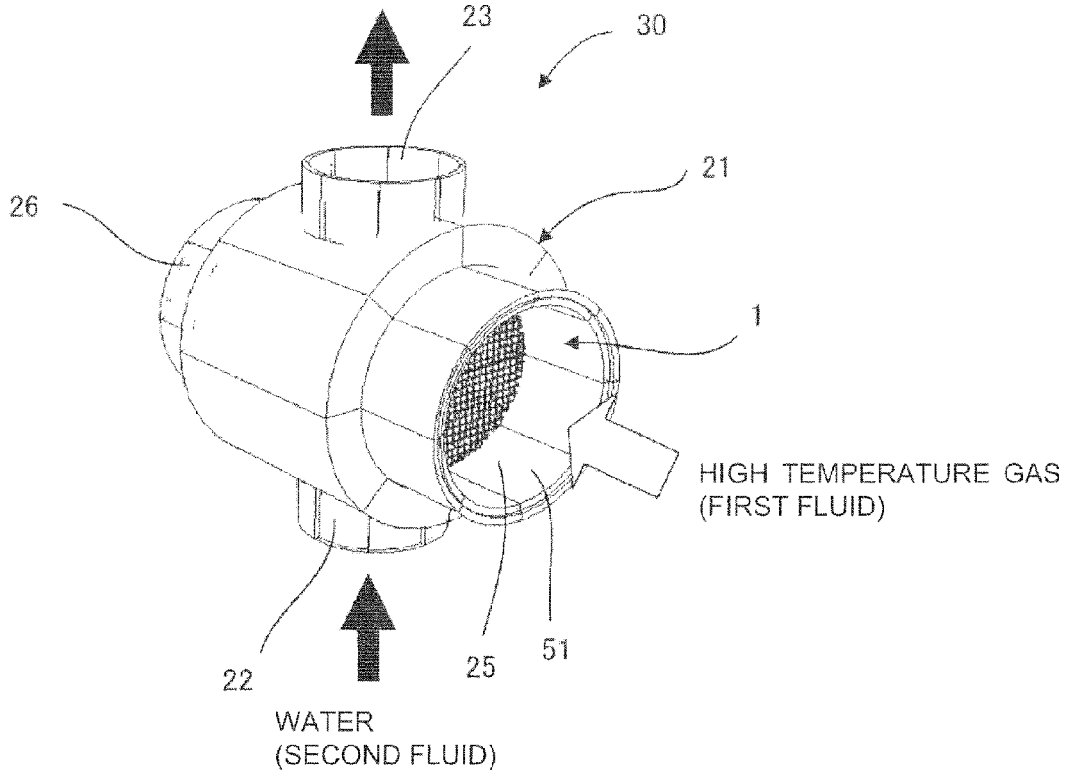
FIG. 14A is a perspective view showing a heat exchanger where a honeycomb structure having an extended outer peripheral wall is contained in a casing.

FIG. 13A shows a perspective view of the honeycomb structure 1 having the extended outer peripheral wall 51, and FIG. 13B shows a cross-sectional view along a cross section parallel to the axial direction. FIG. 14A shows a perspective view of a heat exchanger 30 where a honeycomb structure 1 having the extended outer peripheral wall 51 is put in the casing 21, FIG. 14B is a cross-sectional view along a cross section parallel to the axial direction, and FIG. 140 is a cross-sectional view along a cross section perpendicular to the axial direction.

Figure 13C:
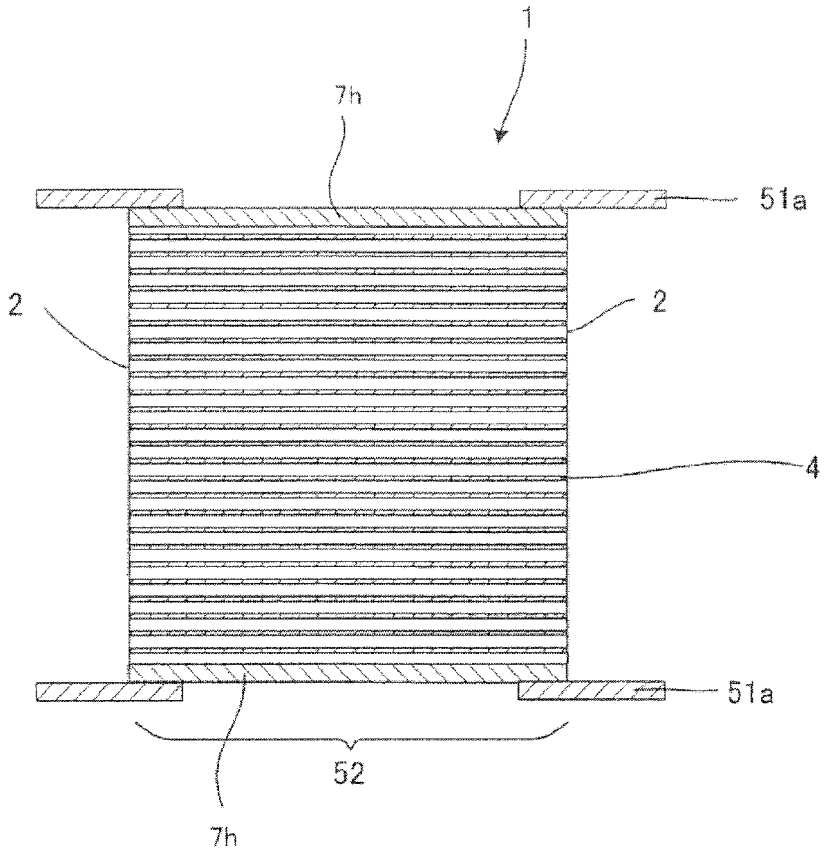
FIG. 13C is a cross-sectional view showing a honeycomb structure having an attached extended outer peripheral wall at both the ends, cut along a cross section parallel to the axial direction.
Figure 13D:
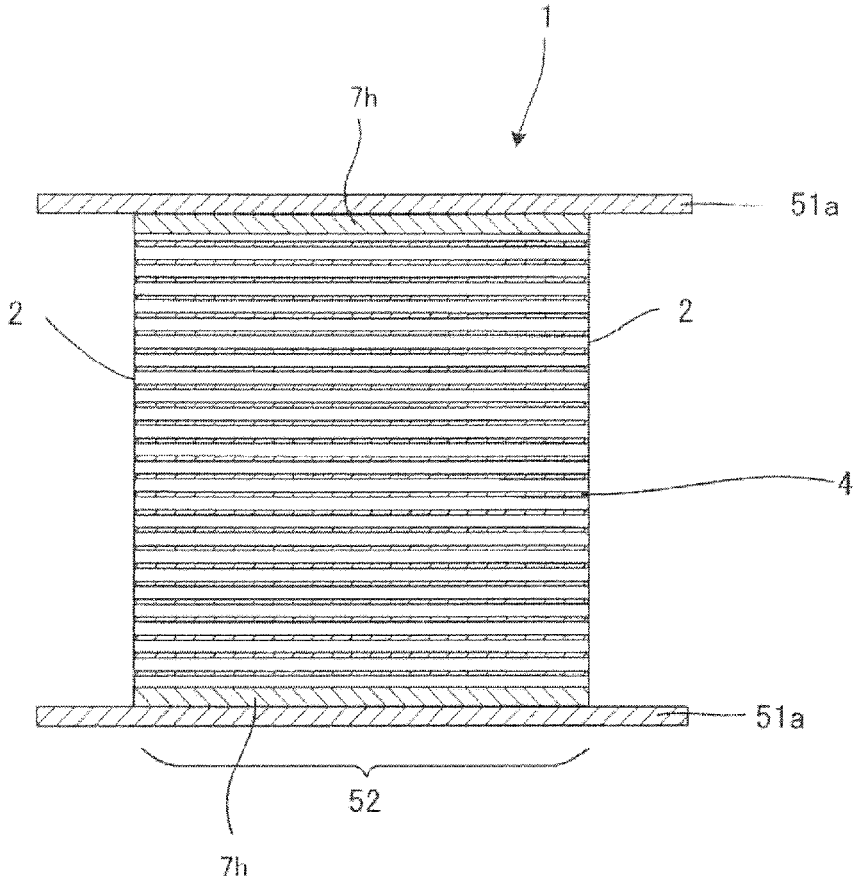
FIG. 13D is a cross sectional view showing a honeycomb structure having an attached extended outer peripheral wall covering the entire periphery of the honeycomb portion, cut along a cross section parallel to the axial direction.

As shown in FIGS. 13A and 13B, the honeycomb structure 1 has the extended outer peripheral wall 51 protruding in the axial direction in a cylindrical shape outside of the end faces 2 in the axial direction of the honeycomb portion 52. The extended outer peripheral wall 51 is formed unitarily with and continuously from the outer peripheral wall of the honeycomb portion 52. Alternatively, a thin plate-shaped wall where the extended outer peripheral wall 51 is formed unitarily with the outer peripheral wall of the honeycomb portion 52 may be wound around the honeycomb structure 1 having no extended outer peripheral wall 51, or a honeycomb structure 1 may be pressed into a cylindrical object. The object to be wound does not have to cover the entire periphery of the honeycomb portion 52, and it is also possible that both the end portions are covered while the outer peripheral wall 7*h* is shown in the central portion. In the case that the extended outer peripheral wall 51 is metal and bonded to the honeycomb 1, brazing, welding, or use of a bonding material or the like is desirable. FIG. 13C shows an embodiment where the ring-shaped attached extended outer peripheral walls 51*a* are attached in both the end portions of the honeycomb structure 1. Alternatively, as shown in FIG. 13D, it is possible to use a ring-shaped attached extended outer peripheral wall 51*a* covering the entire periphery of the honeycomb portion 52. The attached extended outer peripheral wall 51*a* is preferably a metal plate or a ceramic plate. Neither partition walls 4 nor cells 3 are formed on the inner peripheral face side of the extended outer peripheral wall 51 or the attached extended outer peripheral wall 51*a* to have a hollow. The honeycomb portion 52 in the central portion is a heat collection portion for facilitating heat transfer.

Figure 14B:
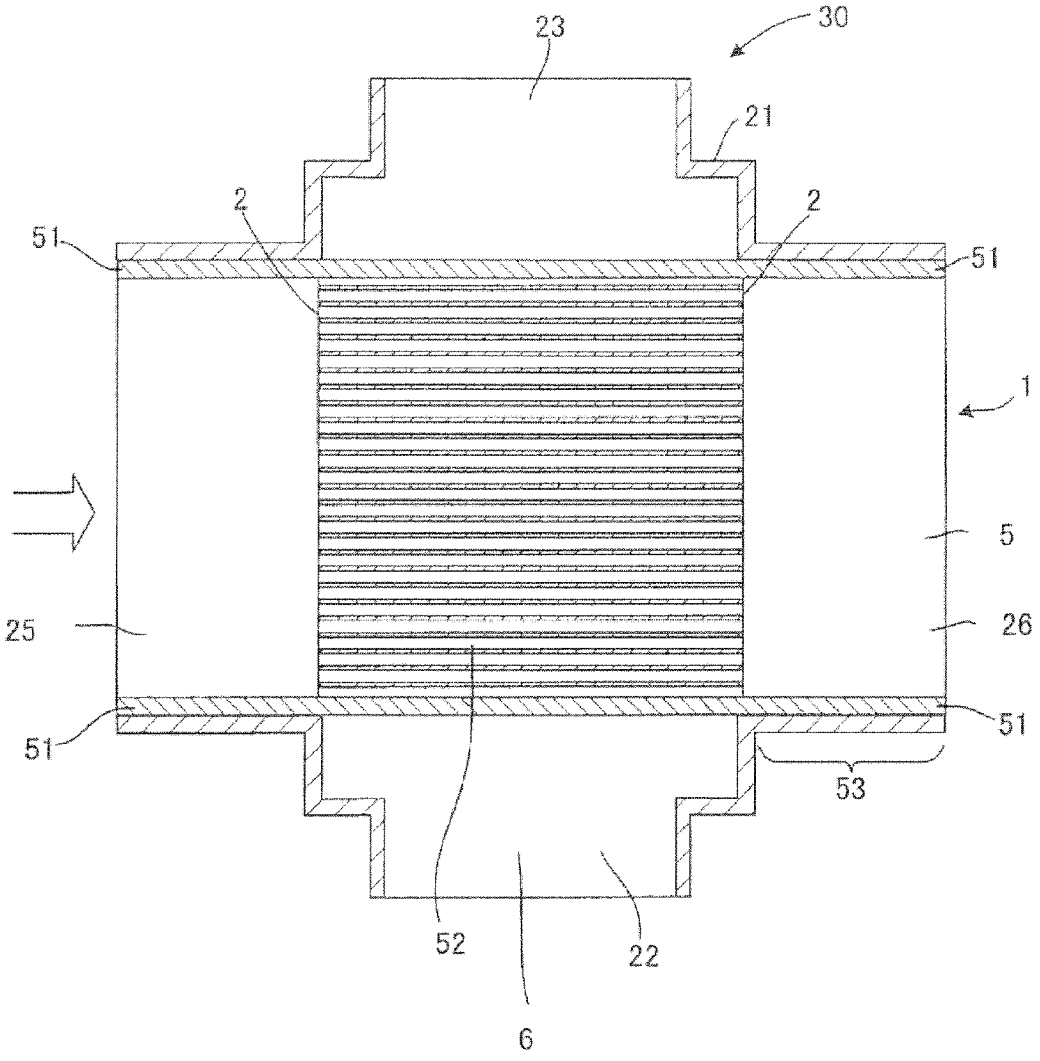
FIG. 14B is a cross-sectional view showing a heat exchanger where a honeycomb structure having an extended outer peripheral wall is contained in a casing, cut along a cross section parallel to the axial direction.
Figure 14C:
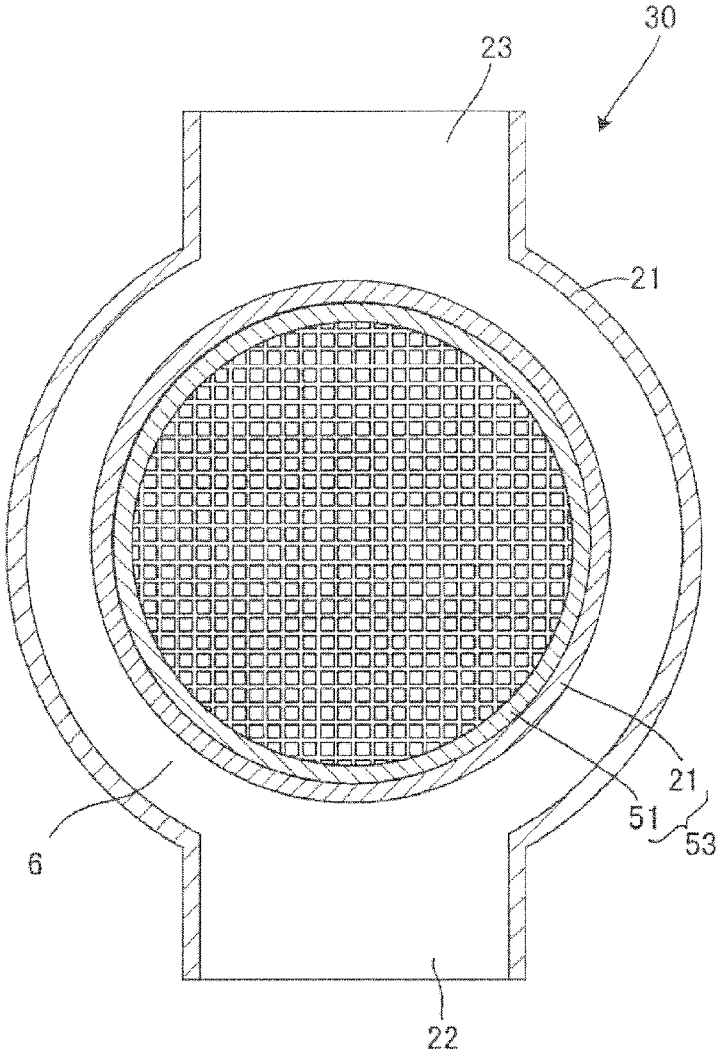
FIG. 14C is a cross-sectional view showing a heat exchanger where a honeycomb structure having an extended outer peripheral wall is contained in a casing, cut along a cross section perpendicular to the axial direction.

As shown in FIGS. 14A to 14C, the casing 21 of the heat exchanger 30 of the present embodiment is formed linearly to fit for the honeycomb structure 1 where the first fluid flow portion 5 from the first fluid inlet 25 to the first fluid outlet 26 is formed, and the second fluid flow portion 6 is also formed linearly from the second fluid inlet 22 to the second fluid outlet 23. Thus, the casing has an intersection structure where the first fluid flow portion 5 and the second fluid flow portion 6 intersect each other. The honeycomb structure 1 is provided so as to fit for the casing 21, and the sealing portion 53 is formed by the outer peripheral face of the extended outer peripheral wall 51 of the honeycomb structure 1 and the inner peripheral face of the casing 21. The inlet 22 and the outlet 23 of the second fluid are formed on mutually opposite sides across the honeycomb structure 1.

In order to enhance reliability of the heat exchanger 30, it is effective to suppress the temperature rise of the sealing portion 53 by inhibiting heat from being transferred from the high temperature fluid (first fluid) side to the sealing portion 53. In the present embodiment, since the extended outer peripheral wall 51 is formed, and the extended outer peripheral wall 51 serves as the sealing portion 53, the performance of the heat exchanger 30 is improved. For example, in the structure of FIGS. 1A and 1B, the vicinity of the end face 2 on the first fluid inlet side of the honeycomb structure 1 has the highest temperature. However, it is difficult to allow the second fluid to flow in the endmost portion because it needs bonding with the casing 21 and sealing portion (sealing portion 11) (see FIG. 9). By providing the extended outer peripheral wall 51 as the present embodiment, also the end portion (vicinity of the end face 2 on the inlet side) of the honeycomb portion 21 can exchange heat. In other words, since the sealing portion 53 is formed outside in the axial direction with respect to the honeycomb portion 52, the second fluid can be brought into contact with the entire outer peripheral face of the honeycomb portion 21. This enables to improve heat-transfer efficiency.

Figure 15A:
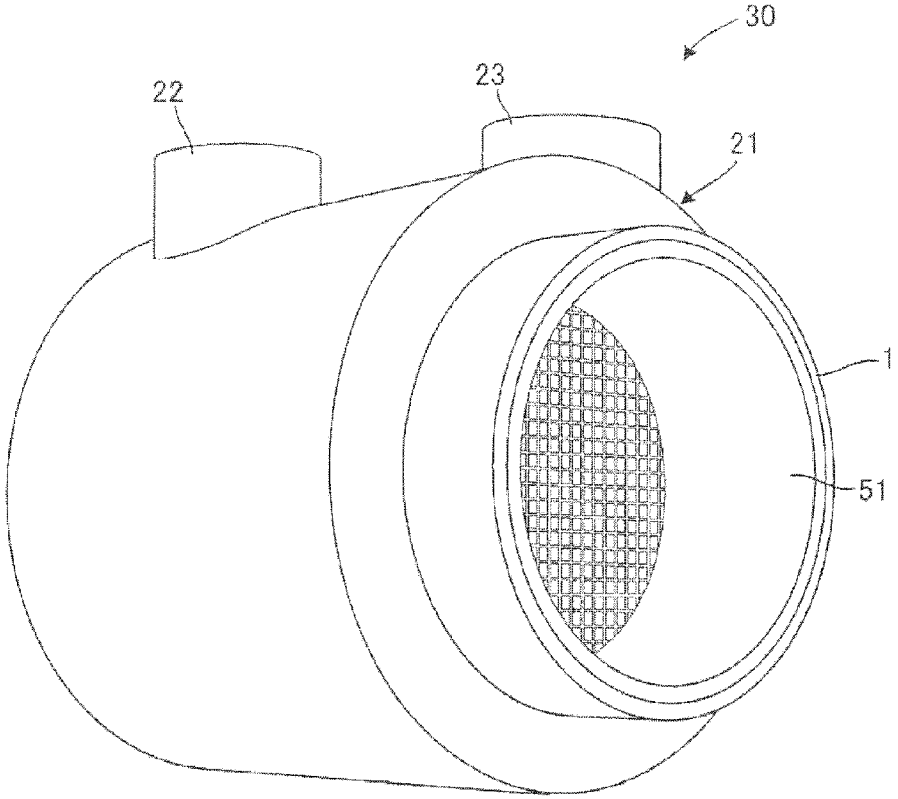
FIG. 15A is a perspective view showing another embodiment of a heat exchanger where a honeycomb structure having an extended outer peripheral wall is contained in a casing.
Figure 15B:
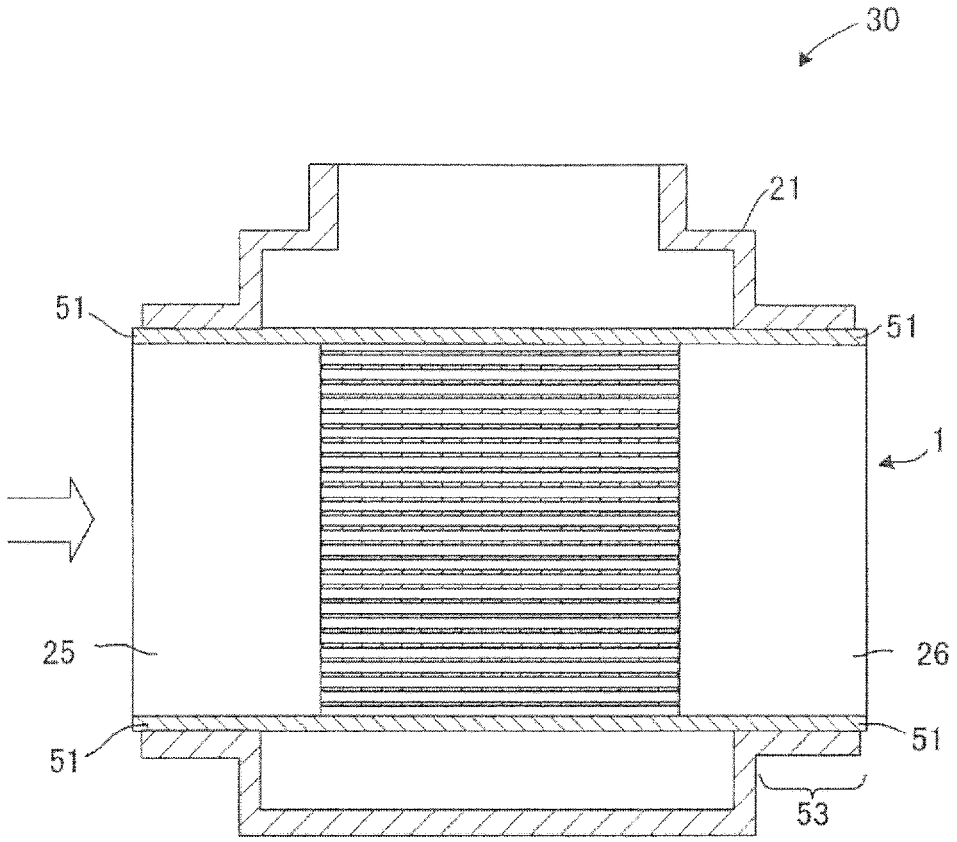
FIG. 15B is a cross-sectional view showing another embodiment of a heat exchanger where a honeycomb structure having an extended outer peripheral wall is contained in a casing, cut along a cross section parallel to the axial direction.
Figure 15C:
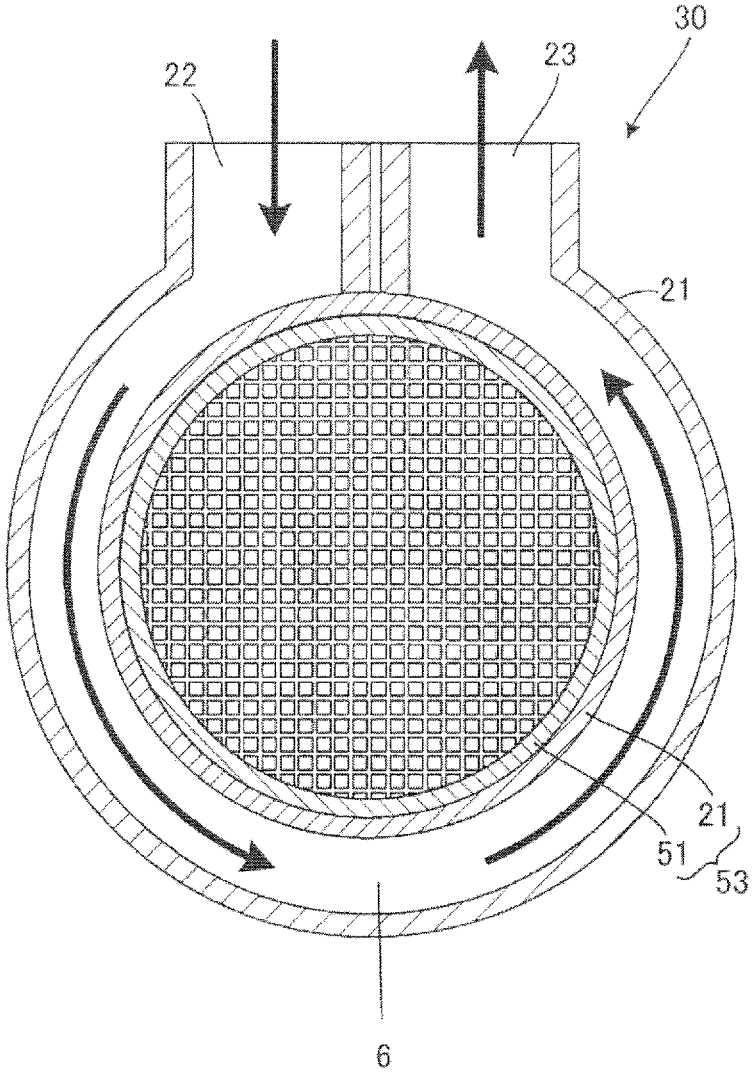
FIG. 15C is a cross-sectional view showing another embodiment of a heat exchanger where a honeycomb structure having an extended outer peripheral wall is contained in a casing, cut along a cross section perpendicular to the axial direction.

FIG. 15A is a perspective view showing another embodiment of a heat exchanger 30 where a honeycomb structure 1 having an extended outer peripheral wall 51 is contained in a casing 21, FIG. 15B is a cross-sectional view along a cross section parallel to the axial direction, and FIG. 15C is a cross-sectional view along a cross section perpendicular to the axial direction.

In the embodiment of FIGS. 15A to 15C, the second fluid inlet 22 and the second fluid outlet 23 are formed on the same side with respect to the honeycomb structure 1. Such a structure as the present embodiment is possible according to the installation site of the heat exchanger 30, piping, and the like. The present embodiment has a circling structure where the second fluid flow portion 6 goes around the honeycomb structure 1. That is, the second fluid flows around the outer periphery of the honeycomb structure 1.

In order to inhibit the honeycomb structure 1 from breaking by protecting the honeycomb structure 1, it is possible to have a structure where a metal plate or a ceramic plate is fitted for at least a part of the outer peripheral face 7 of the honeycomb structure 1. It may have a structure where the metal plate or the ceramic plate covers a part of the outer peripheral face 7 or a structure where the metal plate or the ceramic plate covers the entire outer peripheral face 7. The configuration of covering the entire outer peripheral face 7 has a structure where the second fluid is not brought into direct contact with the outer peripheral face 7 of the honeycomb structure 1.

Figure 16:
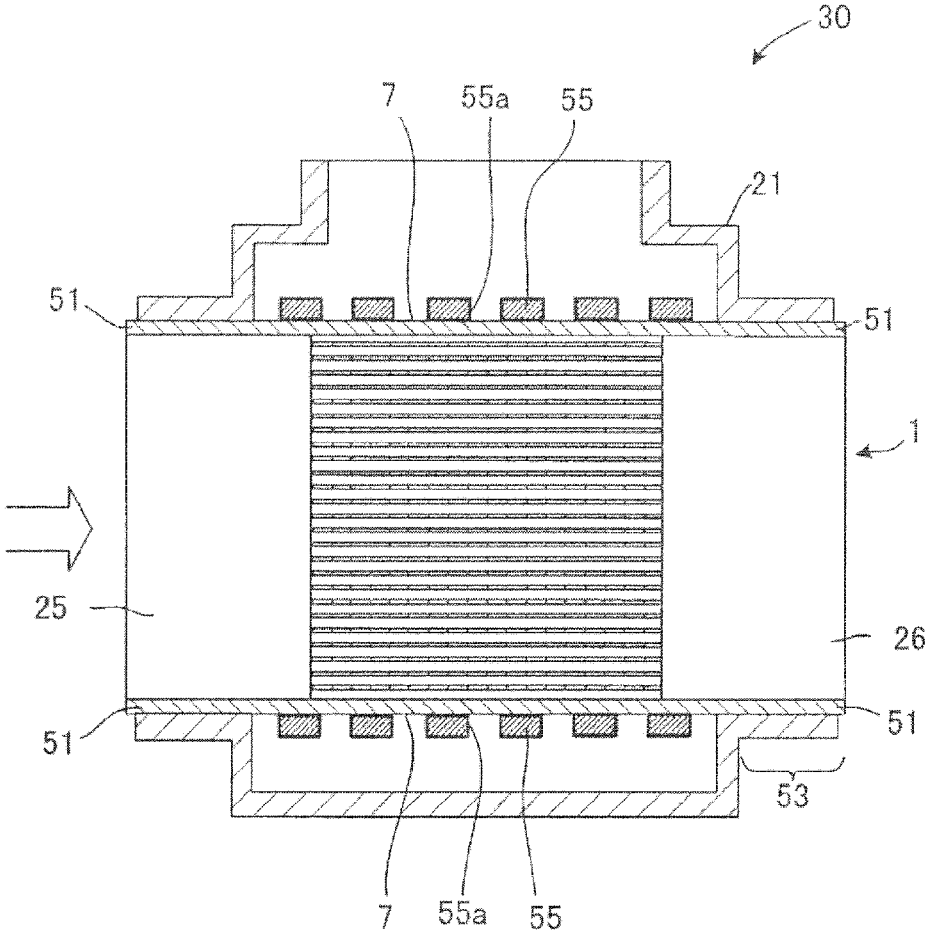
FIG. 16 is a cross-sectional view showing an embodiment of a heat exchanger where a honeycomb structure provided with a punching metal is contained in a casing, cut along a cross section parallel to the axial direction.

FIG. 16 is a cross-sectional view showing an embodiment of a heat exchanger 30 where a punching metal 55, which is a hole-provided metal plate having a plurality of holes, is provided on the outer peripheral face 7 of the a honeycomb structure 1 in the second fluid flow portion 6, cut along across section parallel to the axial direction. The punching metal 55 is a metal plate fitted for the outer peripheral face of the honeycomb structure 1. A honeycomb structure 1 having the extended outer peripheral wall 51 is contained in the casing 21. The punching metal 55 is provided so as to fit for the outer peripheral face 7 of the honeycomb structure 1 in the second fluid flow portion 6. The punching metal 55 is obtained by making holes in a metal plate and formed cylindrically along the shape of the outer peripheral face 7 of the honeycomb structure 1. That is, since the punching metal 55 has holes 55*a*, there are sites where the second fluid is brought into direct contact with the honeycomb structure 1, and thereby the heat transfer is not deteriorated. Since the honeycomb structure 1 is protected by covering the outer peripheral face 7 of the honeycomb structure 1 with the punching metal 55, the honeycomb structure 1 is inhibited from breaking. Incidentally, the hole-provided metal plate means a metal plate having a plurality of holes and is not limited to the punching metal 55.

In addition, the outer peripheral face of the metal plate or ceramic plate covering the outer peripheral face 7 of the honeycomb structure 1 may have fins for transferring heat with the second fluid flowing in the second fluid flow portion (regarding the fin shape, see FIGS. 5A and 5B showing an embodiment of fins directly arranged on the outer peripheral face 7 of the honeycomb structure 1). Since the contact area for the second fluid is increased by providing fins, the heat-transfer efficiency can be improved.

Figure 17A:
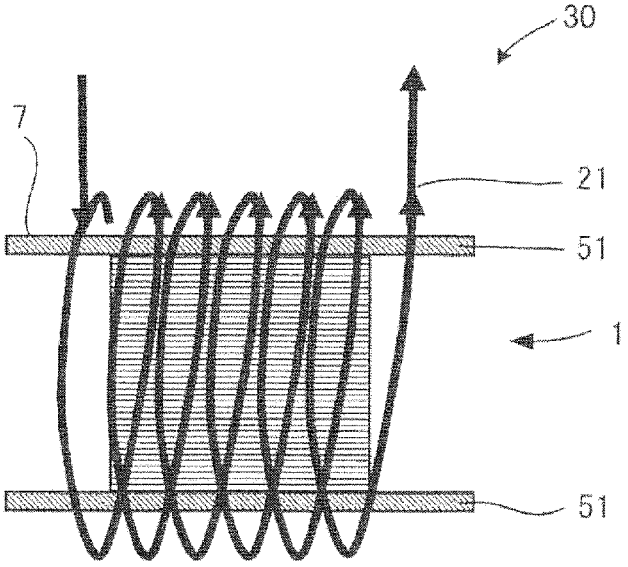
FIG. 17A is a schematic view for explaining a state that a casing is wound around the outer peripheral face of the honeycomb structure in a spiral fashion.
Figure 17B:
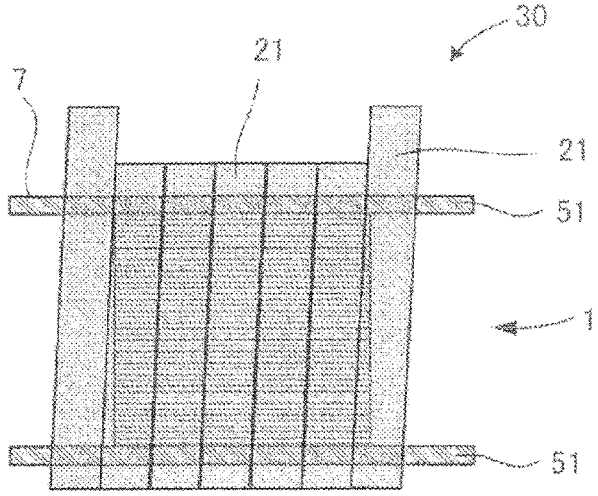
FIG. 17B is a schematic view in a direction parallel to the axial direction, for explaining a state that a casing is wound around the outer peripheral face of the honeycomb structure 1.

The FIGS. 17A and 17B shows a heat exchanger 30 in an embodiment where a casing 21 is formed in a tube-like fashion and wound around the outer peripheral face 7 of the honeycomb structure 1 in a spiral fashion. FIG. 17A is a schematic view for explaining a state that a casing 21 is wound around the outer peripheral face 7 of the honeycomb structure 1 in a spiral fashion. FIG. 17B is a schematic view in a direction parallel to the axial direction, for explaining a state that a casing is wound around the outer peripheral face 7 of the honeycomb structure 1. In the present embodiment, since the inside of the tube serves as the second fluid flow portion 6, and the casing 21 has a wound shape on the outer peripheral face 7 of the honeycomb structure 1 in a spiral fashion, the second fluid flowing in the second fluid flow portion 6 flows in a spiral fashion without direct contact to the outer peripheral face 7 of the honeycomb structure 1 on the outer peripheral face 7 of the honeycomb structure 1 to exchange heat. Such a configuration inhibits leakage and mixing of the first fluid and the second fluid even in the case of having breakage in the honeycomb structure 1. Incidentally, in the present embodiment, the honeycomb structure 1 may have a form of no extended outer peripheral wall 51. In FIGS. 17A and 17B, though the casing 21 is wound in a spiral fashion, a spiral fashion is not necessary. It is preferable that the casing 21 is provided to have a shape of being closely-attached to the outer peripheral face 7 of the honeycomb structure 1 from the viewpoint of improvement in heat-transfer efficiency.

Figure 18:
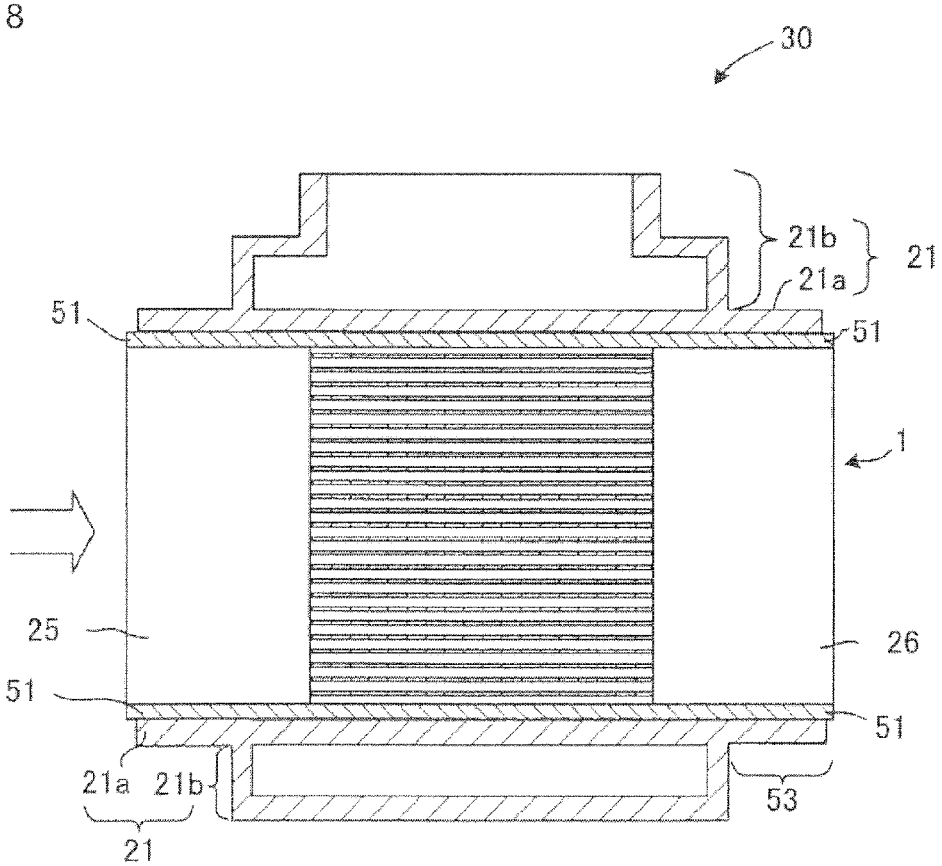
FIG. 18 is a cross-sectional view showing an embodiment of a heat exchanger where the casing is provided with the cylindrical portion and the outside casing portion as a unit, cut along a cross section parallel to the axial direction.

FIG. 18 shows an embodiment provided with the metal plate or ceramic plate fitted for the outer peripheral face 7 of the honeycomb structure 1 and the outside casing portion 21*b* forming the second fluid flow portion 6 outside thereof as a unit. In the heat exchanger 30 of the embodiment shown in FIG. 18, the casing 21 is provided with the cylindrical portion 21*a* fitted for the outer peripheral face 7 of the honeycomb structure 1 and the outside casing portion 21*b* forming the second fluid flow portion 6 outside the cylindrical portion 21*a* as a unit. The cylindrical portion 21*a* has a shape corresponding to the shape of the outer peripheral face 7 of the honeycomb structure 1, and the outside casing portion 21*b* has a cylindrical shape having a space where the second fluid flows outside the cylindrical portion 21*a*. The second fluid inlet 22 and the second fluid outlet 23 are formed in a part of the outside casing portion 21*b*. In the present embodiment, the second fluid flow portion 6 is formed by being surrounded by the cylindrical portion 21*a* and the outside casing portion 21*b*, and the second fluid flowing in the second fluid flow portion 6 flows in a circumferential direction on the outer peripheral face 7 of the honeycomb structure 1 without direct contact with the outer peripheral face 7 of the honeycomb structure 1 to exchange heat. Such a configuration inhibits leakage and mixing of the first fluid and the second fluid even in the case of having breakage in the honeycomb structure 1. Incidentally, in the present embodiment, the honeycomb structure 1 may have a form of no extended outer peripheral wall 51. The outside casing portion 21*b* may be formed and bonded on the outside of the unit obtained by winding a thin plate-like object obtained by unifying the extended outer peripheral wall 51 and the cylindrical portion 21*a* around the honeycomb structure 1 or the unit obtained by pressing the honeycomb structure 1 into a cylindrical object.

Figure 19:
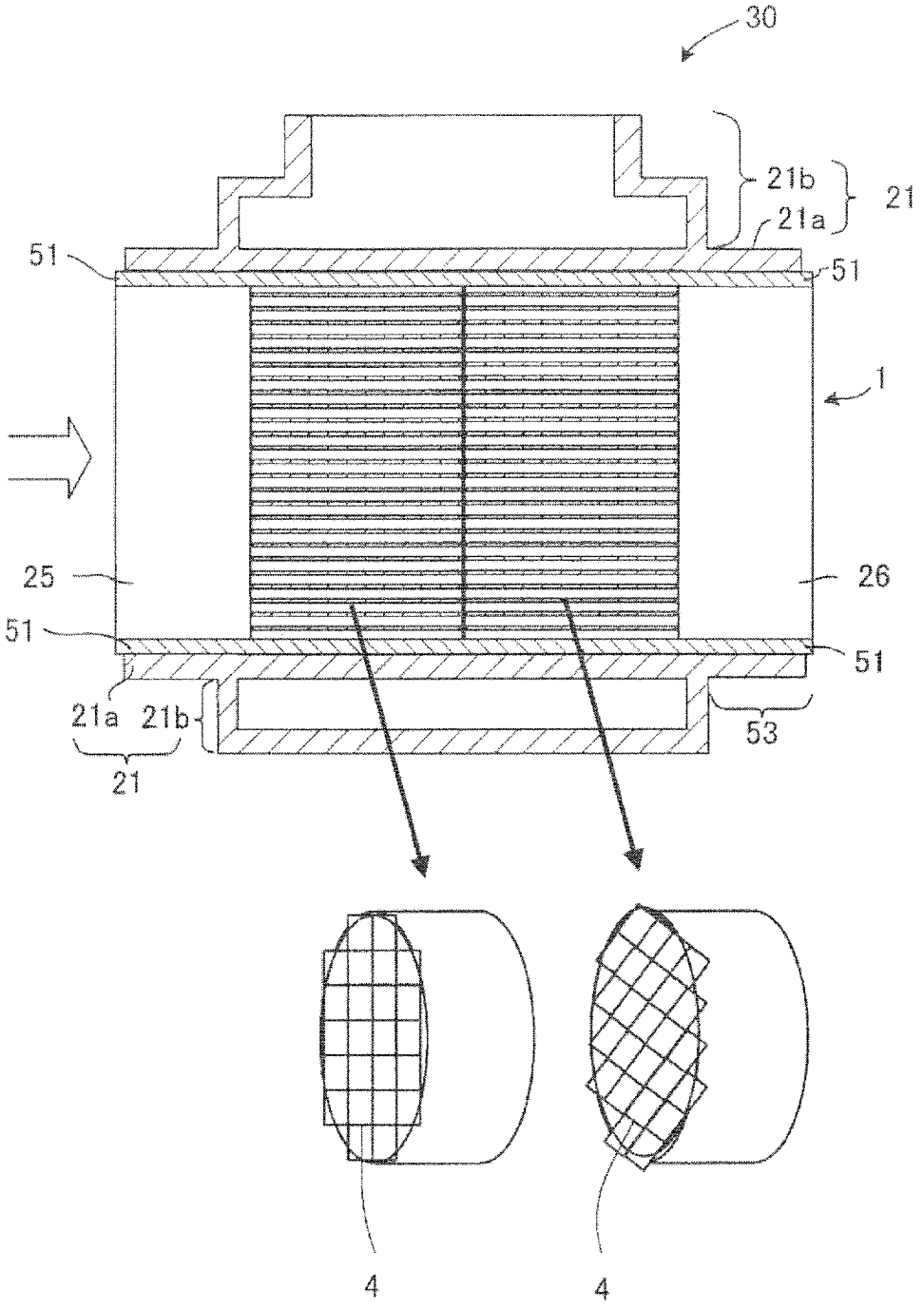
FIG. 19 is a cross-sectional view showing an embodiment where a plurality of honeycomb structures are disposed so that the directions of the partition walls of the honeycomb structures are different, cut along a cross section parallel to the axial direction.

FIG. 19 shows an embodiment of a heat exchanger 30 where the casing 21 is provided with the cylindrical portion 21*a* fitted for the outer peripheral face 7 of the honeycomb structure 1 and the outside casing portion 21*b* forming the second fluid flow portion 6 outside the cylindrical portion 21*a* as a unit. The first fluid flow portion 5 is constituted by a plurality of honeycomb portions 52, and the honeycomb portions 52 are disposed in such a manner that the directions of the partition walls 4 of the honeycomb structures 1 are different between the honeycomb portions in a cross section perpendicular to the axial direction. That is, in the present embodiment, a plurality of the honeycomb portions 52 are disposed in the casing 21 with the direction of the mesh (directions of the partition walls 4) is changed. That is, the cells 3 have a phase difference between the plural honeycomb portions 52. Such a configuration enables to improve heat-transfer efficiency because the flow of the first fluid becomes discontinuous. Incidentally, in the present embodiment, the honeycomb structure 1 may have a form of no extended outer peripheral wall 51.

Figure 20:
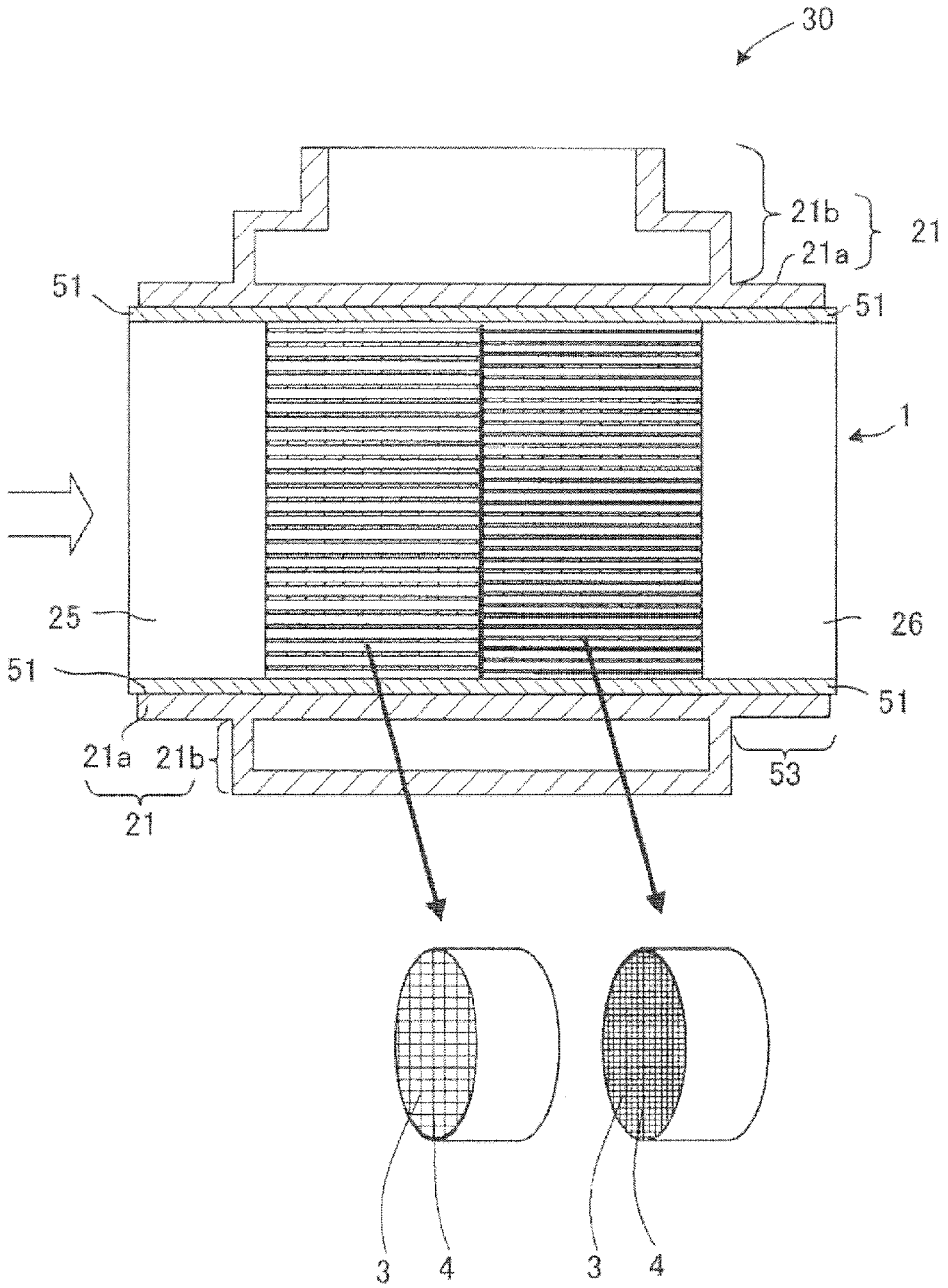
FIG. 20 is a cross-sectional view showing an embodiment where a plurality of honeycomb structures having different cell densities are disposed, cut along a cross section parallel to the axial direction.

FIG. 20 shows an embodiment of a heat exchanger 30 where the casing 21 is provided with the cylindrical portion 21*a* fitted for the outer peripheral face 7 of the honeycomb structure 1 and the outside casing portion 21*b* forming the second fluid flow portion 6 outside the cylindrical portion 21*a* as a unit. The first fluid flow portion 5 is constituted by a plurality of honeycomb portions 52, and the honeycomb portions 52 have different cell densities. The honeycomb portions 52 are disposed in such a manner that the cell density of the honeycomb portion 52 on the first fluid outlet side is larger than that of the honeycomb portion 52 on the first fluid inlet side. By disposing a plurality of honeycomb portions 52 in such a manner that the mesh density (cell density of the honeycomb portions 52) increases toward the downstream of the first fluid, the heat transfer area increases even with the temperature of the first fluid falling, thereby improving the heat-transfer efficiency. Incidentally, in the present embodiment, the honeycomb structure 1 may have a form of no extended outer peripheral wall 51.

Figure 21A:
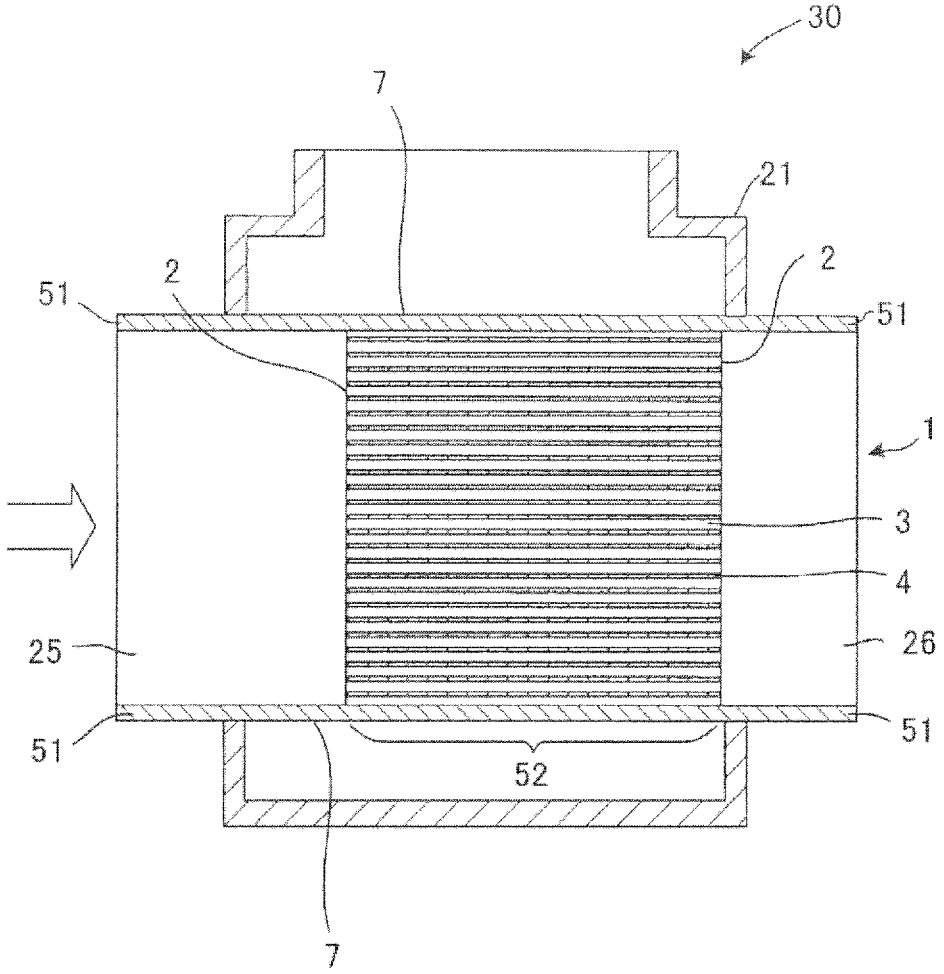
FIG. 21A is a cross-sectional view showing an embodiment where the honeycomb portion of the honeycomb structure is disposed to be closer to the downstream side in the axial direction with respect to the second fluid flow portion, cut along a cross section parallel to the axial direction.

FIG. 21A shows a cross-sectional view of an embodiment where the honeycomb portion 52 of the honeycomb structure 1 is disposed to be closer to the downstream side in the axial direction with respect to the second fluid flow portion 6, cut along a cross section parallel to the axial direction. The honeycomb structure 1 of the present embodiment has the extended outer peripheral wall 51 formed in a cylindrical shape to be extended outside in the axial direction from the end faces 2 in the axial direction. In addition, the casing 21 is formed cylindrically so as to cover apart of the outer peripheral face 7 outside the outer peripheral face 7 of the honeycomb structure 1, and the second fluid is brought into direct contact with the outer peripheral face 7 by flowing in the casing to receive heat from the first fluid. The honeycomb portion 52 where the cells 3 are formed by the partition walls 4 is disposed to be closer to the downstream side in the axial direction (downstream side of the first fluid flowing direction) with respect to the second fluid flow portion 6. Since the honeycomb portion 52 is disposed to be closer to the downstream side, the distance from the first fluid inlet to the end face 2 is long, and therefore the distance for allowing the first fluid to be brought into contact with the second fluid flow portion 6 is long. Therefore, since the highest temperature of the contact face between the honeycomb structure 1 and the casing 21 can be lowered, and the temperature of the contact portion with the casing 21 can be lowered, breakage by heat can be inhibited. In addition, heat radiation-released from the honeycomb structure 1 can be collected by the casing 21.

Figure 21B:
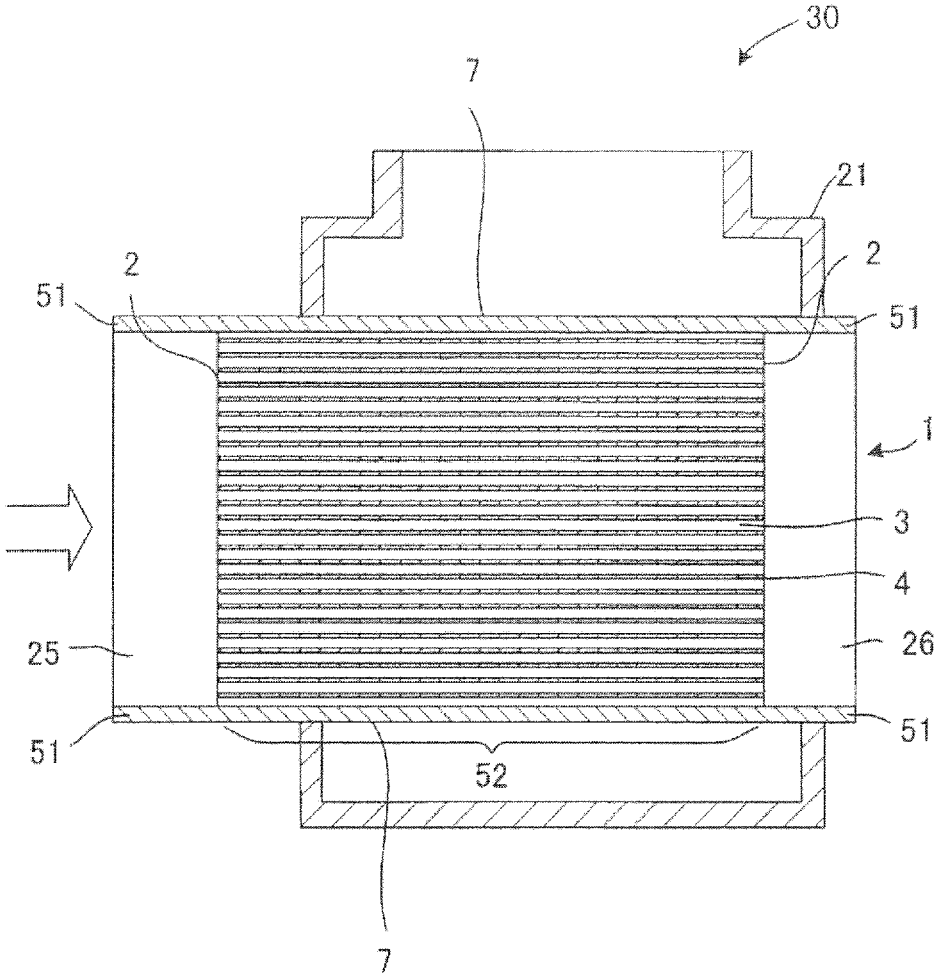
FIG. 21B is a cross-sectional view showing an embodiment where the second fluid flow portion is disposed to be closer to the downstream side in the axial direction with respect to the honeycomb portion, cut along a cross section parallel to the axial direction.

FIG. 21B is a cross-sectional view showing an embodiment where the second fluid flow portion 6 is disposed to be closer to the downstream side in the axial direction with respect to the honeycomb portion 52, cut along a cross section parallel to the axial direction. The honeycomb structure 1 of the present embodiment has an extended outer peripheral wall 51 formed in a cylindrical shape extended outside in the axial direction from the end faces 2 in the axial direction. The casing 21 is formed cylindrically so as to cover a part of the outer peripheral face 7 outside the outer peripheral face 7 of the honeycomb structure 1, and the second fluid is brought into direct contact with the outer peripheral face 7 by flowing in the casing 21 to receive heat from the first fluid. The first fluid inlet 25 has high temperature, and, when the temperature difference from the second fluid flowing in the casing 21 is large, high thermal stress is caused, and the honeycomb structure 1 may break. In the present embodiment, since the second fluid flow portion 6 is disposed to be closer to the downstream side in the axial direction with respect to the honeycomb portion 52, the temperature difference between the outer periphery and the center of the honeycomb portion 52 becomes small, and the thermal stress generated in the honeycomb can be reduced.

Figure 21C:
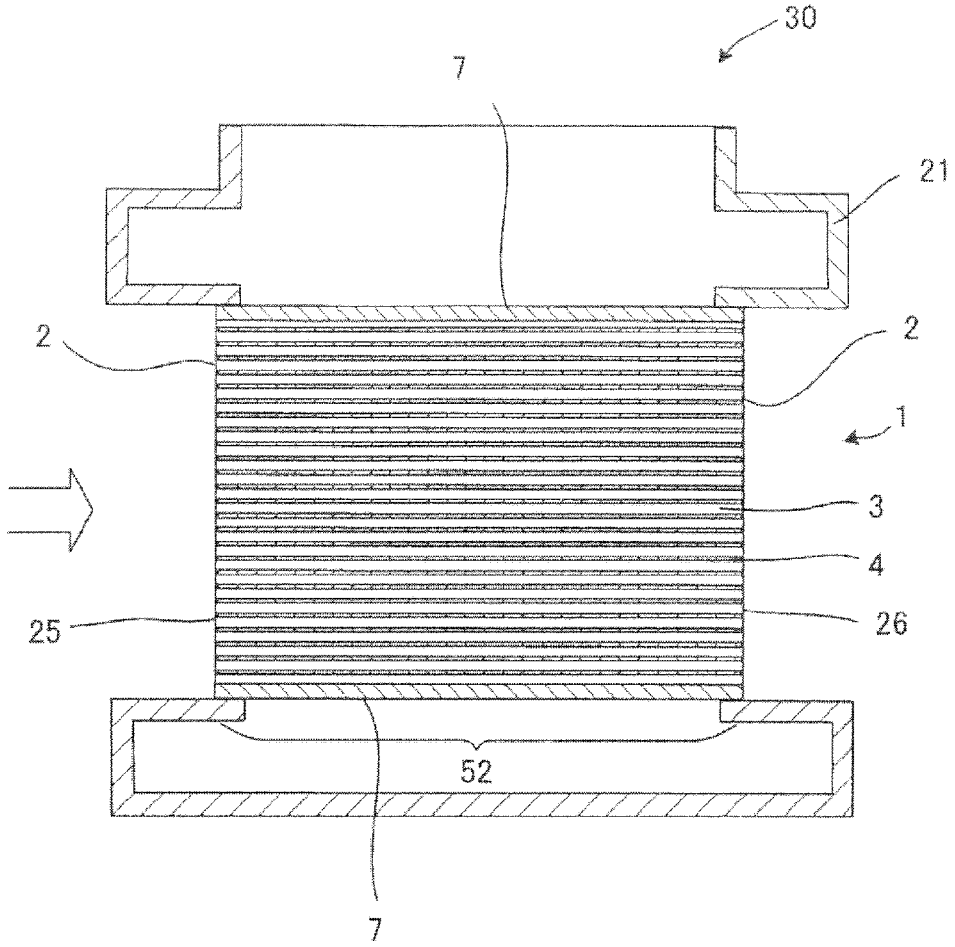
FIG. 21C is a cross-sectional view showing an embodiment where a casing is fitted for a honeycomb structure having no extended outer peripheral wall, cut along a cross section parallel to the axial direction.

FIG. 21C is a cross-sectional view showing an embodiment where a casing is fitted for a honeycomb structure 1 without the extended outer peripheral wall 51 (or attached outer peripheral wall 51*a*), cut along a cross section parallel to the axial direction. The casing 21 is formed in a ring shape, and the outer peripheral face 7 of the honeycomb structure 1 is fitted for the inner peripheral face of the casing 21. The casing 21 is preferably formed of metal or ceramic. That is, a metal plate or a ceramic plate constituting the casing 21 is fitted for a part of the outer peripheral face 7 of the honeycomb structure 1. The second fluid flowing in the casing 21 is brought into direct contact with the outer peripheral face 7 of the honeycomb structure 1 to exchange heat.

Figure 22:
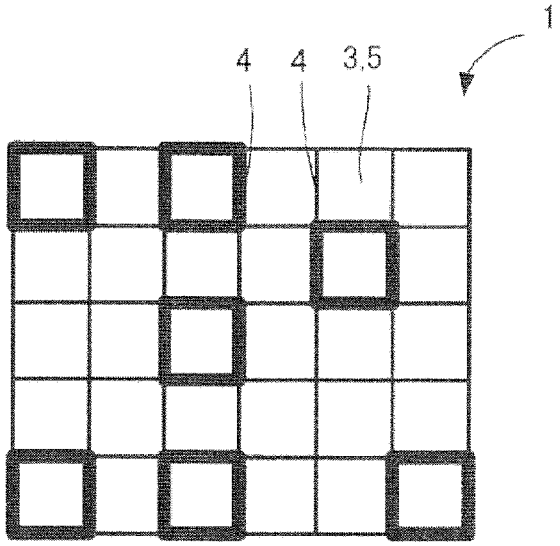
FIG. 22 is a view showing an embodiment of a heat exchange element where the thickness of the partition walls is partially different.

FIG. 22 is a view of honeycomb structure 1 from the end face 2 on the first fluid inlet side, showing another embodiment of a honeycomb structure 1. As shown in FIG. 22, the honeycomb structure 1 has a plurality of cells 3 partitioned by ceramic partition walls 4 and extending through in the axial direction from one end face 2 to the other end face 2 (see FIG. 1B) to allow a heating medium as the first fluid to flow therein, where the thickness of the partition walls 4 (partition wall thickness) forming the cells 3 is partially different. That is, it is an embodiment where the partition walls 4 are formed to have thick portions and thin portions in the honeycomb structure 1 of FIG. 1B. The configuration other than the thickness of the partition walls 4 is the same as the honeycomb structure 1 of FIG. 1B and is formed so that the second fluid flows perpendicularly to the first fluid. By imparting such variance in partition wall thickness, the pressure loss can be reduced. Incidentally, the portions having thick partition walls and the portions having thin partition walls may be disposed in a regular manner or at random as shown in FIG. 22, and the same effect can be obtained.

Figure 23A:
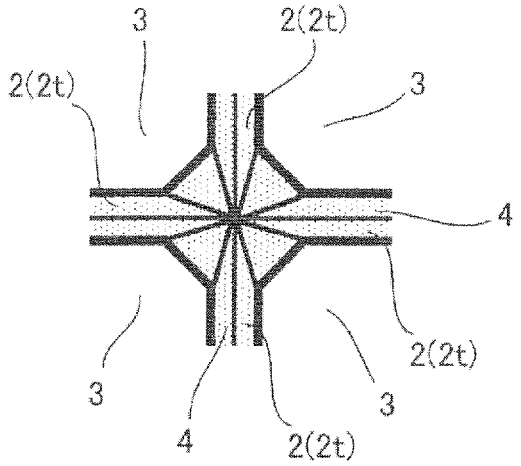
FIG. 23A is a view showing an embodiment where an end face in the axial direction of the partition walls of the honeycomb structure is tapered, viewed from the first fluid inlet side.
Figure 23B:
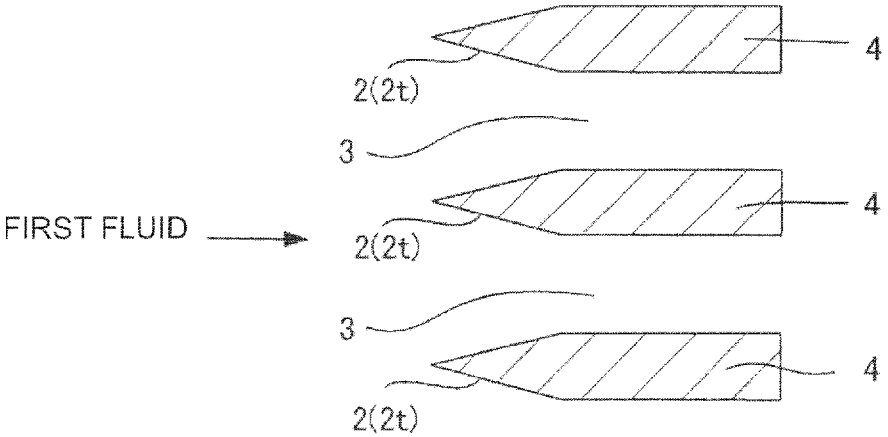
FIG. 23B is a cross-sectional view showing an embodiment where an end face in the axial direction of the partition walls of the honeycomb structure is tapered, cut along a cross section parallel to the axial direction.

FIG. 23A is a view showing an embodiment where an end face 2 in the axial direction of the partition walls 4 of the honeycomb structure 1 is formed as a tapered face 2*t*, the end face 2 of the honeycomb structure 1 being viewed from the first fluid inlet side. FIG. 23B is a cross-sectional view showing an embodiment where an end face 2 in the axial direction of the partition walls 4 of the honeycomb structure 1 is a tapered face 2*t*, cut along a cross section parallel to the axial direction. As shown in FIGS. 23A and 23B, the honeycomb structure 1 has a plurality of cells 3 partitioned by ceramic partition walls 4 and extending in the axial direction from one end face 2 to the other end face 2 (see FIG. 1B) and allowing the heating medium as the first fluid to flow therethrough with the end face 2 being a tapered face 2*t*. By allowing the end portions of the partition walls 4 at the first fluid inlet to have tapered faces 2*t*, the fluid inflow resistance is reduced, and therefore the pressure loss can be reduced.

Figure 24A:
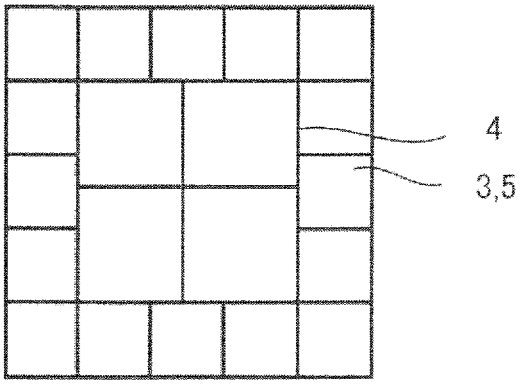
FIG. 24A is a view showing an embodiment of a honeycomb structure where cells having different sizes are formed.

FIG. 24A is a view of an end face 2 of a honeycomb structure 1 from the first fluid inlet side of the honeycomb structure 1, showing an embodiment where cells 3 having different sizes are formed. Since the first fluid flowing through the central portion has a high flow rate, the temperature is high, the volume is large, and the pressure loss is large. Therefore, the cells 3 in the central portion were made large to be able to reduce the pressure loss.

Figure 24B:
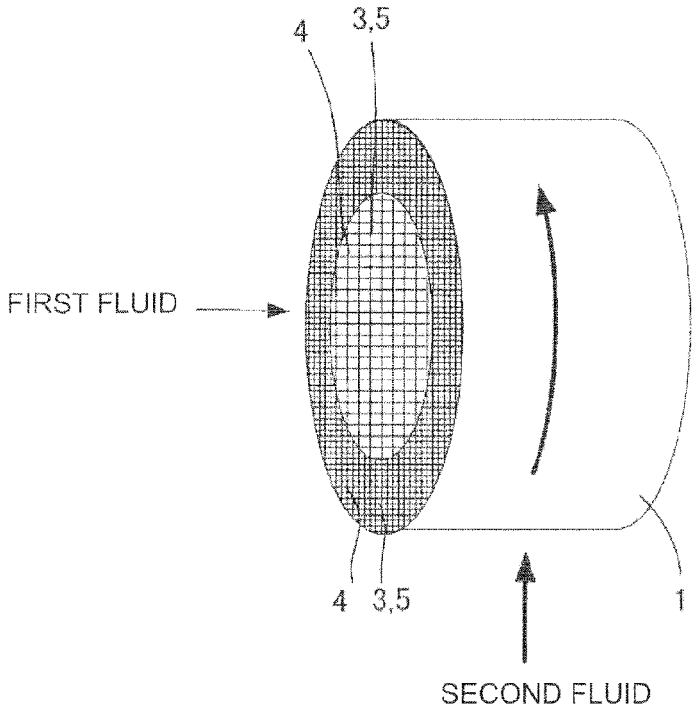
FIG. 24B is a decomposed perspective view showing an embodiment of a circular columnar honeycomb structure where cells having different sizes are formed.

FIG. 24B shows an embodiment of a circular columnar honeycomb structure 1 where cells 3 having different sizes are formed. The inside circular columnar honeycomb structure and the outside circular columnar honeycomb structure form a unit, and the cells 3 of the circular columnar honeycomb structure form the first fluid flow portion 5.

Figure 24C:
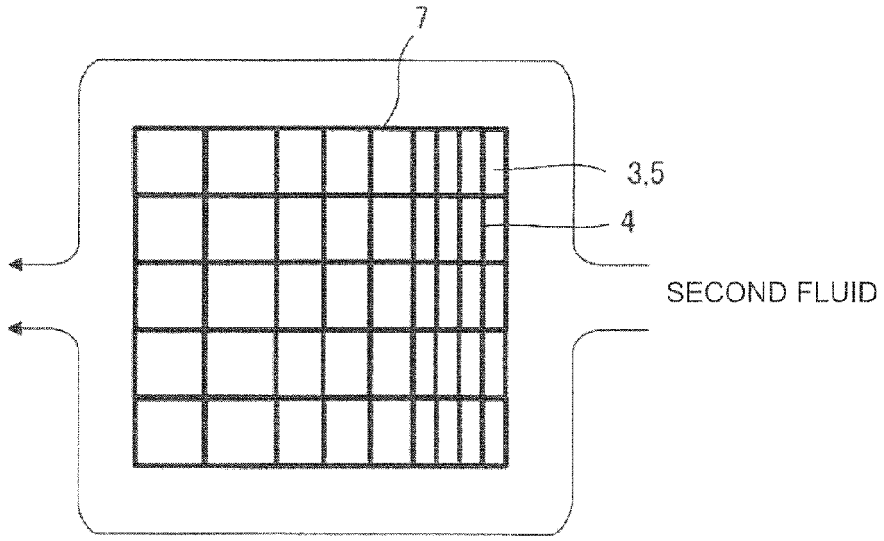
FIG. 24C is a view showing an embodiment of a honeycomb structure where the size of the cells is varied.
Figure 24D:
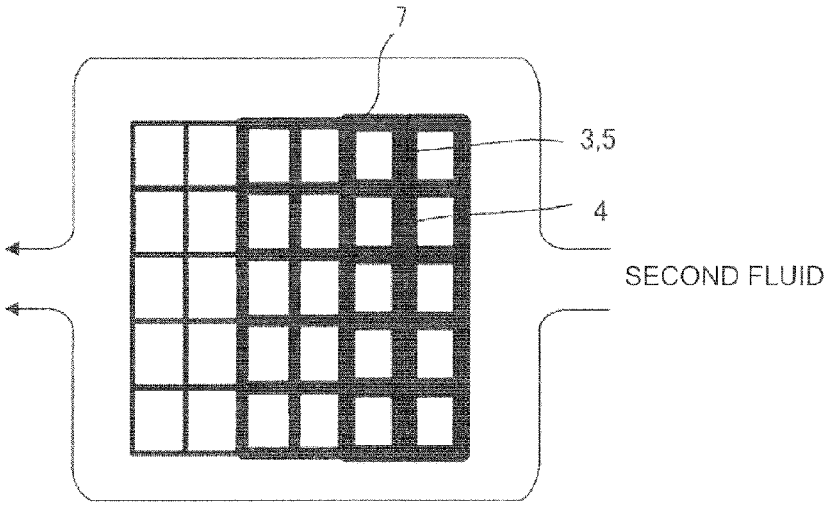
FIG. 24D is a view showing an embodiment of a honeycomb structure where the thickness of the partition walls is varied.

FIG. 24C shows an embodiment where the size of the cells 3 is varied, one end face 2 being viewed from the first fluid inlet side. The cells 3 are formed to gradually become larger from the right side to the left side of the figure. The right side of the figure is the second fluid inlet side to allow the second fluid to flow from the right side to the left side along the outer peripheral face 7 of the honeycomb structure 1. That is, the cells 3 on the second fluid inlet side are formed to be small, and the cells 3 on the outlet side are formed to be large. In the heat exchanger 30 shown in FIG. 6, when the first fluid flow portion is formed as shown in FIG. 24C to allow the second fluid to flow from the right side to the left side of the FIG. 24C, since the second fluid has high temperature on the downstream side of the second fluid (left side of FIG. 24C), the temperature of the first fluid flowing the downstream side of the second fluid rises to have a large pressure loss. However, by making large the cells 3 of the first fluid flow portion 5 on the downstream side of the second fluid, the pressure loss can be reduced. FIG. 24D is a view showing an embodiment where the thickness of the partition walls 4 of the cells 3 is varied, the end face 2 on the first fluid inlet side being viewed. The partition walls 4 of the cells 3 are formed to gradually become thinner from the right side to the left side of the figure. The right side of the figure is the second fluid inlet side, and by thinning the partition walls 4 of the cells 3 on the second fluid downstream side, the pressure loss can be reduced similarly to the FIG. 24C.

Figure 25A:
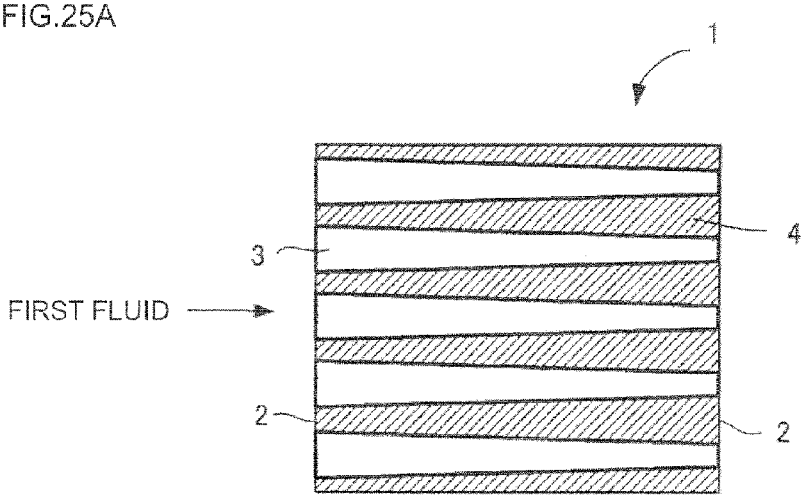
FIG. 25A is a view showing an embodiment of a honeycomb structure where the thickness of the partition walls becomes larger from the inlet side toward the outlet side of the first fluid.
Figure 25B:
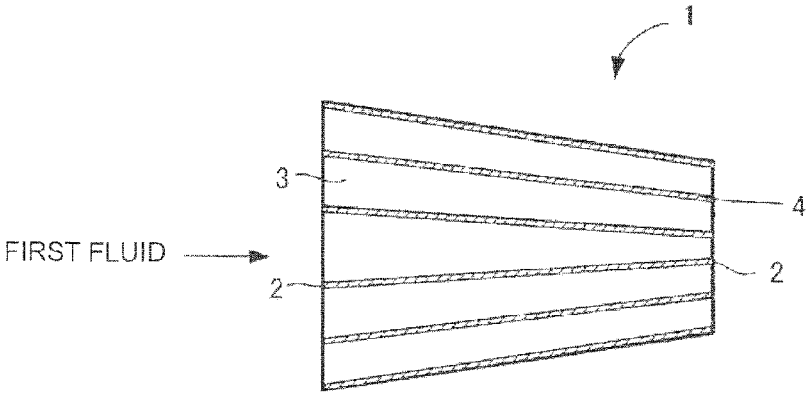
FIG. 25B is a view showing an embodiment of a honeycomb structure where the first fluid flow portion gradually becomes narrow from the inlet side toward the outlet side of the first fluid.

FIG. 25A is a cross-sectional view along a cross section parallel to the axial direction, showing an embodiment of a honeycomb structure 1 where the thickness of the partition walls 4 becomes larger from the inlet side toward the outlet side (from the upstream side toward the downstream side) of the first fluid. FIG. 25B shows an embodiment of a honeycomb structure 1 where the fluid flow portion 5 gradually becomes narrow from the inlet side toward the outlet side (from the upstream side toward the downstream side) of the first fluid. In the first fluid flow portion 5, the temperature of the first fluid falls toward the downstream side, and the heat transfer is reduced by the volume shrinkage of the first fluid.

By narrowing the first fluid flow portion 5, the contact is improved, and the heat transfer between the first fluid and the partition wall faces can be increased.

Figure 26A:
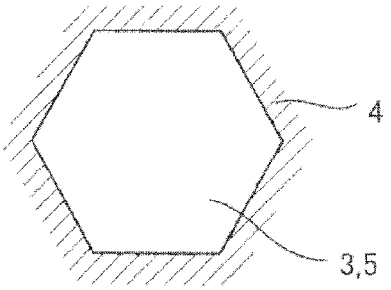
FIG. 26A is a view showing an embodiment where the cells of the honeycomb structure have a hexagonal shape.
Figure 26B:
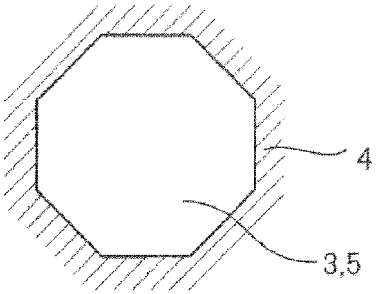
FIG. 26B is a view showing an embodiment where the cells of the honeycomb structure have an octagonal shape.

In the honeycomb structure 1 shown in FIG. 1, the shape of the cells 3 functioning as the first fluid flow portion 5 can be made hexagonal as shown in FIG. 26A. Alternatively, as shown in FIG. 26B, the shape of the cells 3 functioning as the first fluid flow portion 5 can be made octagonal. Since such a shape has a corner having a wide angle, stagnation or the like of the fluid is reduced, and the fluid film thickness (thickness of a temperature boundary layer of the first fluid) can be reduced, thereby raising the heat transfer coefficient between the first fluid and the wall faces of the partition walls.

Figure 27:
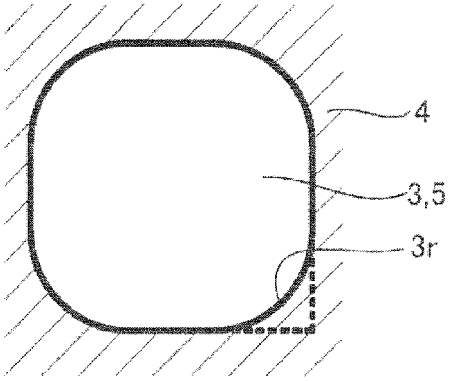
FIG. 27 is a view showing an embodiment of a honeycomb structure where an R portion is formed in each corner portion of a cell.

In the honeycomb structure 1 shown in FIG. 1, as shown in FIG. 27, an R portion 3*r* can be formed by imparting an R shape to the corner portion of the cell 3 functioning as the first fluid flow portion 5. Since the angle of the corner portion is widened by such a shape, stagnation or the like of the fluid is reduced, and the fluid film thickness can be reduced, thereby raising the heat transfer coefficient between the first fluid and the wall faces of the partition walls.

Figure 28A:
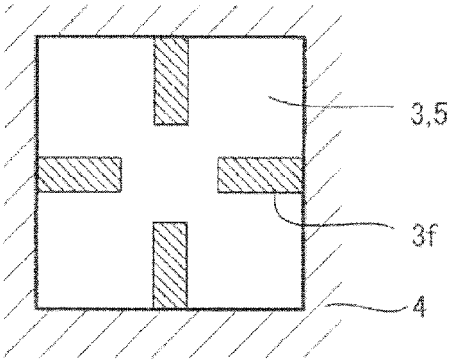
FIG. 28A is a view showing an embodiment of a honeycomb structure having fins protruding in a cell.
Figure 28B:
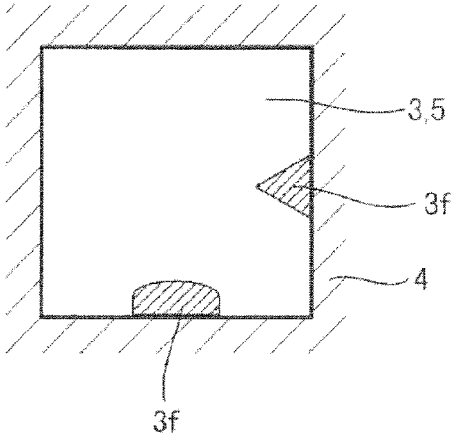
FIG. 28B is a view showing another embodiment of a honeycomb structure having fins protruding in a cell.

Further, in the honeycomb structure 1 shown in FIG. 1, there can be given a fin structure having fins 3*f* protruding in the cell 3 functioning as the first fluid flow portion 5 as shown in FIGS. 28A and 28B. The fin 3*f* is formed to extend in the axial direction (the first fluid flow direction) on a wall face of the partition wall 4 forming the cell 3, and the shape of the fin 3*f* may be a plate, a hemisphere, a triangle, a polygon, or the like in a cross section perpendicular to the axial direction. Such a configuration enables to increase the heat transfer area and reduce the fluid film thickness by disturbing the flow of the fluid, thereby raising the heat transfer coefficient between the first fluid and the wall faces of the partition walls. The fins 3*f* may be formed only in the unplugged cells 3 or also in the plugged cells 3.

Figure 47:
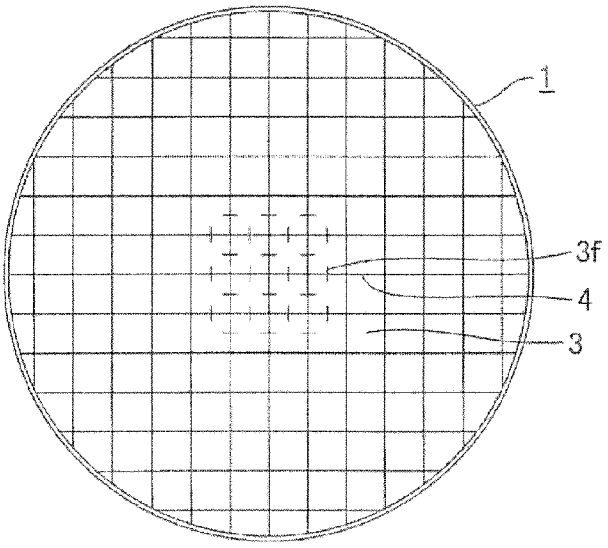
FIG. 47 is a view showing an embodiment where fins are provided in the cells in the central portion of the honeycomb structure.
Figure 48A:
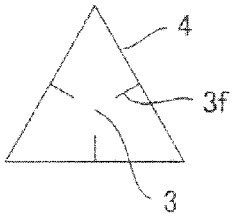
FIG. 48A is a view showing an embodiment 1 of fins provided in a cell.
Figure 48B:
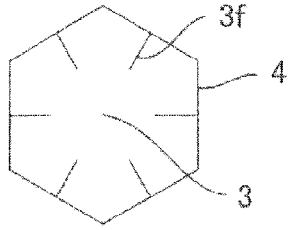
FIG. 48B is a view showing an embodiment 2 of fins provided in a cell.
Figure 48C:
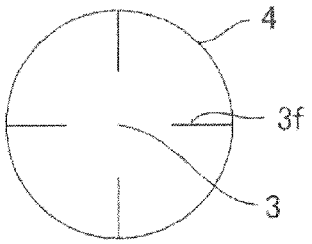
FIG. 48C is a view showing an embodiment 3 of fins provided in a cell.
Figure 48D:
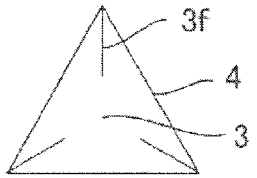
FIG. 48D is a view showing an embodiment 4 of fins provided in a cell.
Figure 48E:
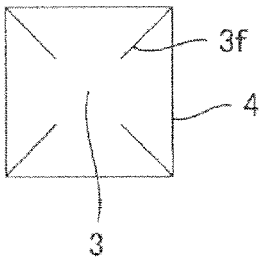
FIG. 48E is a view showing an embodiment 5 of fins provided in a cell.
Figure 48F:
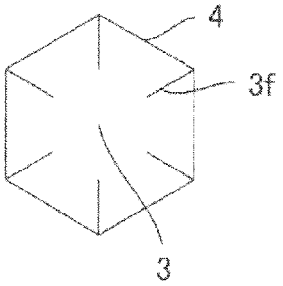
FIG. 48F is a view showing an embodiment 6 of fins provided in a cell.
Figure 48G:
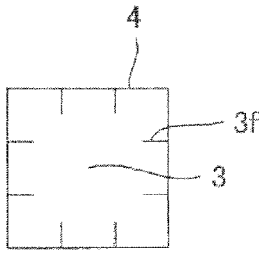
FIG. 48G is a view showing an embodiment 7 of fins provided in a cell.

As shown in FIG. 47, there can be employed the structure where the fins 3*f* are provided on the partition walls 4 of the cells 3 in the central portion of the honeycomb structure 1. Such a structure enables to increase the gas contact area, which enables to raise the heat-transfer efficiency and to remedy the defect of accelerating the deterioration in the central portion due to the concentration of the first fluid in the central portion.

FIGS. 48A to 48G show cell shapes and dispositions of fins in the honeycomb structure 1 where fins 3*f* are provided in the cells 3 in the central portion. As shown in FIGS. 48A to 48G, the shape of the cell 3 is not limited to quadrangular, and it may be any of polygons such as a triangle and a hexagon, and a circle. The fins 3*f* may be disposed on the partition walls 4 or at the intersections of the partition walls 4, and the disposition may be determined according to the number of fins 3*f*. The thickness of the fin 3*f* is preferably equivalent to or smaller than the thickness of the partition walls from the thermal shock resistance and conditions for production.

Figure 29A:
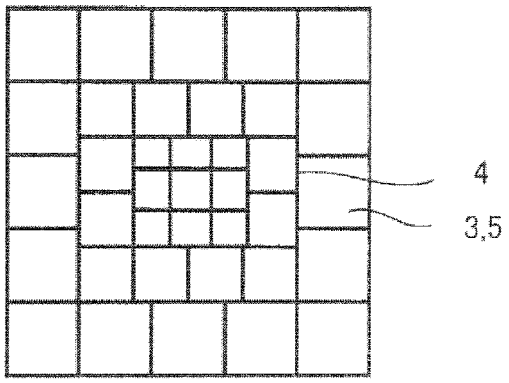
FIG. 29A is a view showing an embodiment of a honeycomb structure where a part of the cell structure is dense.

FIG. 29A shows an embodiment of a honeycomb structure 1 where apart of the cell structure is made dense. The first fluid flowing in the cells 3 in the central portion of the honeycomb structure 1 has high temperature because of high flow rate. It is preferable to have a structure where the cells in the central portion of the honeycomb structure 1 are narrowed while the cells 3 in the outside portion of the honeycomb structure 1 are widened.

Figure 29B:
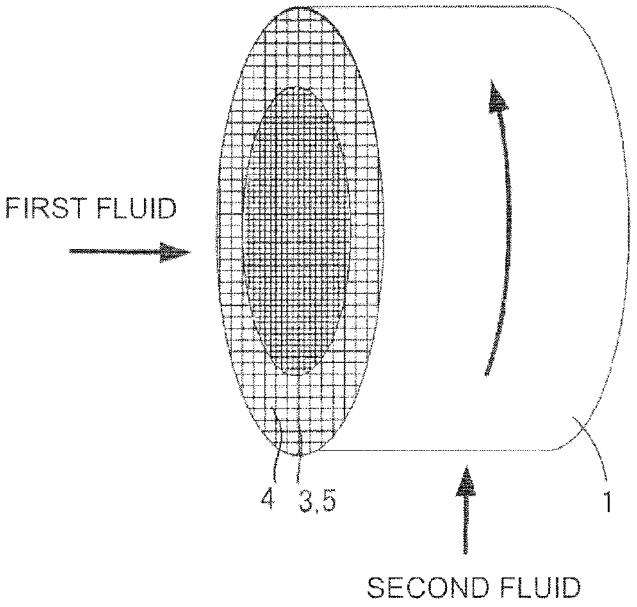
FIG. 29B is a decomposed perspective view showing an embodiment of a circular columnar honeycomb structure where cells having different sizes are formed.

FIG. 29B shows an embodiment of a circular columnar honeycomb structure 1 where cells 3 having different sizes are formed. The inside circular columnar honeycomb structure and the outside circular columnar honeycomb structure form a unit, and the cells 3 of the circular columnar honeycomb structure forms the first fluid flow portion 5.

Figure 29C:
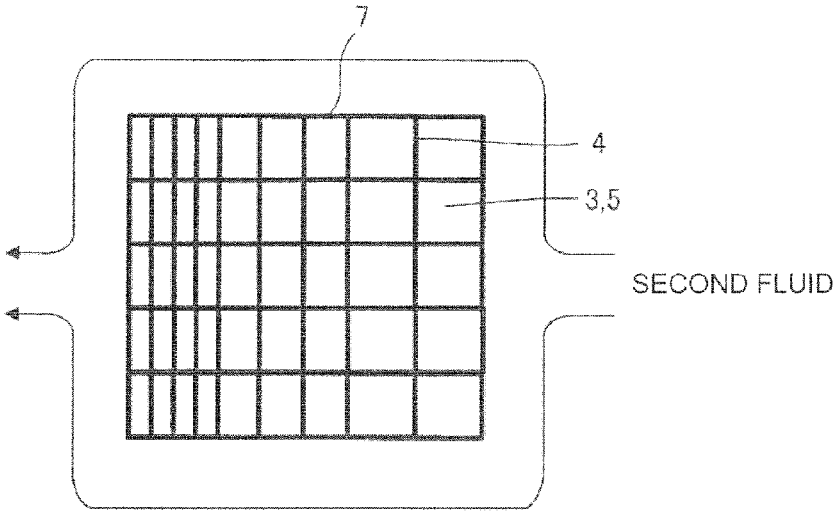
FIG. 29C is a view showing an embodiment of a honeycomb structure where the cell density gradually changes.
Figure 29D:
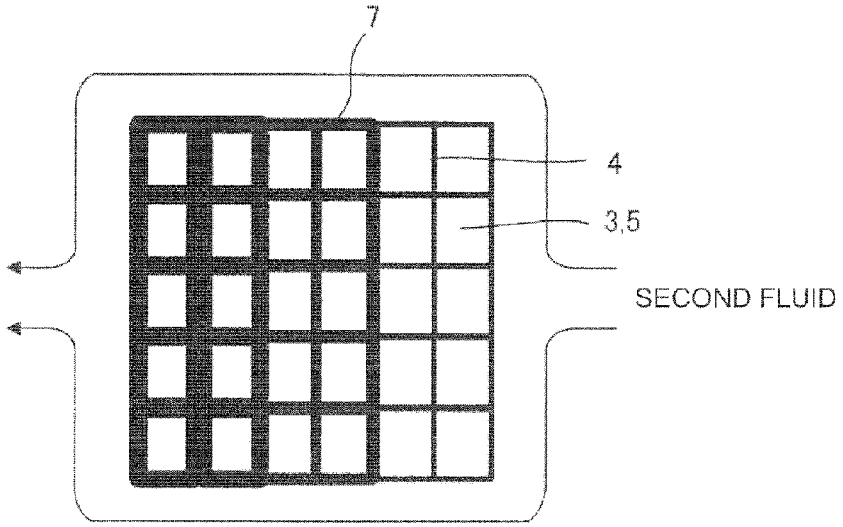
FIG. 29D is a view showing an embodiment of a honeycomb structure where the cell structure is changed by changing the partition wall thickness.

FIG. 29C shows an embodiment where a part of the cell structure is made dense, viewed from the end face 2 on the first fluid inlet side. It is formed in such a manner where the cell density gradually increases from the right side to the left side of the figure. It is structured in such a manner that the right side is the second fluid inlet side and that the second fluid flows from the right side to the left side along the outer peripheral face 7 of the honeycomb structure 1. That is, the cells 3 functioning as the first fluid flow portion 5 has a low cell density on the second fluid inlet side and a high cell density on the second fluid outlet side. FIG. 29D shows an embodiment of a honeycomb structure 1 where the cell structure is changed by changing the thickness of partition walls 4 (partition wall thickness). The cells 3 functioning as the first fluid flow portion 5 has a low cell density on the second fluid inlet side, which is the right side of the figure, and a high cell density on the second fluid outlet side, which is the left side of the figure. In the heat exchanger 30 shown in FIG. 6, when the first fluid flow portion 5 is formed as in FIG. 29C (or FIG. 29D) to allow the second fluid to flow from the right side to the left side of FIG. 29C (or FIG. 29D), the first fluid flowing the second fluid downstream side (left side of FIG. 29C (or FIG. 29D)) has high temperature because the temperature of the second fluid is high, and the pressure loss is large. However, by raising the cell density on the second fluid downstream side of the cells 3 of the first fluid flow portion 5, the heat transfer area can be increased. By increasing the thickness the partition walls 4, the total heat transfer amount can be increased.

Figure 30:
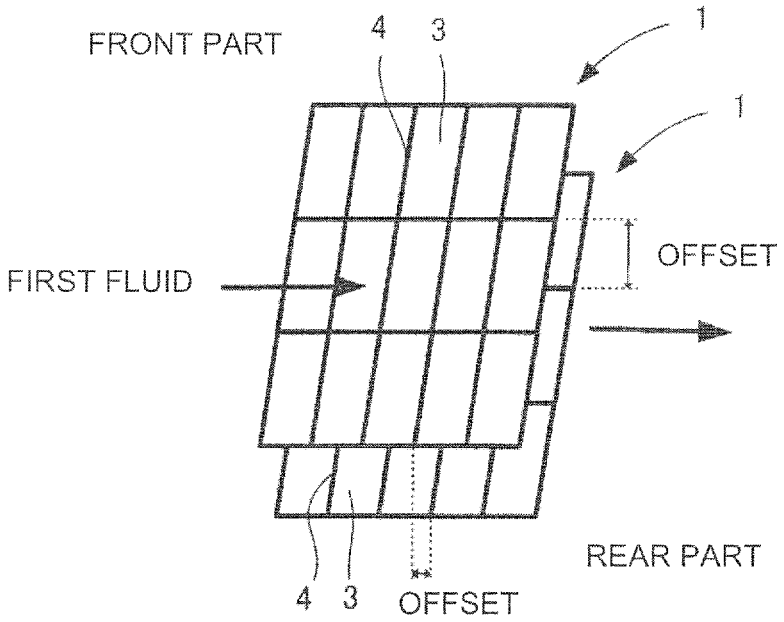
FIG. 30 is a view showing an embodiment of a heat exchanger where the position of the honeycomb structure in the front part and the position of the honeycomb structure in the rear part are offset.

FIG. 30 shows an embodiment of a heat exchanger 30 where the positions of the partition walls 4 are offset. By such a heat exchanger 30 having a configuration where the directions and positions of the partition walls 4 of a plurality of honeycomb structures 1 are offset, the flow of the fluid can be disturbed at the positions where the partition walls are offset. Therefore, the fluid film thickness can be reduced, thereby raising the heat transfer coefficient between the first fluid and the wall faces of the partition walls.

Figure 31:
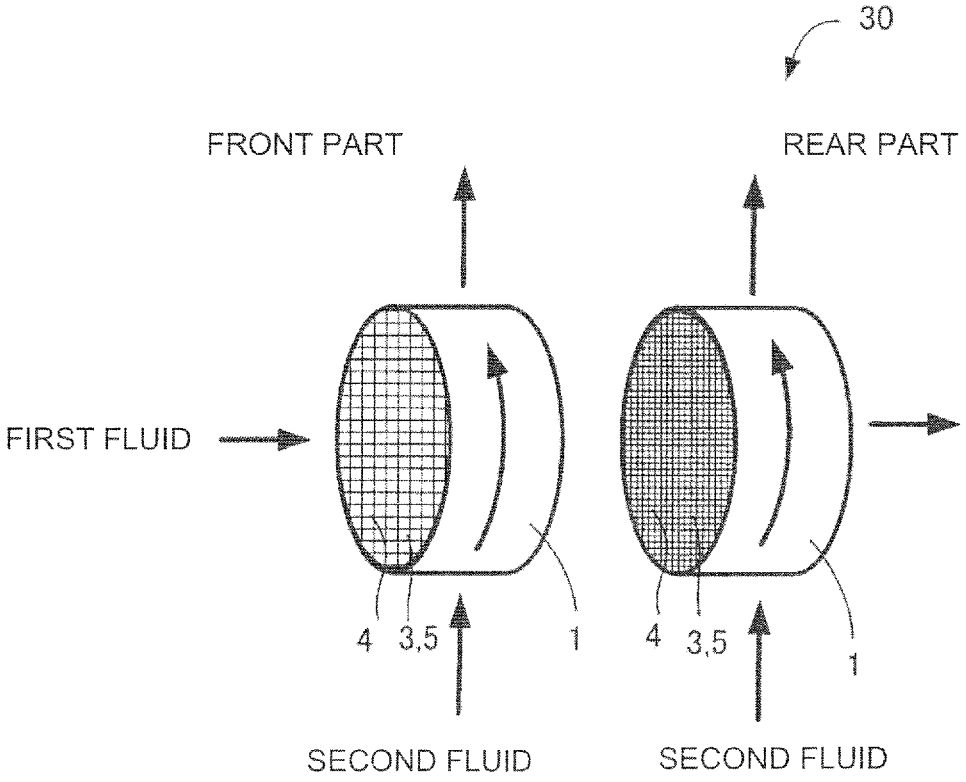
FIG. 31 is a view showing an embodiment of a heat exchanger where the honeycomb structure in the rear part has a higher cell density than the honeycomb structure in the front part.

FIG. 31 shows an embodiment of a heat exchanger 30 where a plurality of honeycomb structures 1 are disposed in series in the first fluid flow direction and where the honeycomb structure 1 in the rear part (on the downstream side) has a higher cell density than that of the honeycomb structure 1 in the front part (on the upstream side). In the first fluid flowing the first fluid flow portion 5, the temperature is lowered toward the downstream side, and heat transfer is reduced by the volume shrinkage of the first fluid. In the present embodiment, the heat transfer area is increased by the disposition where the honeycomb structure 1 in the rear part (on the downstream side) has a higher cell density to be able to increase heat transfer between the first fluid and the wall faces of the partition walls 4.

Figure 32:
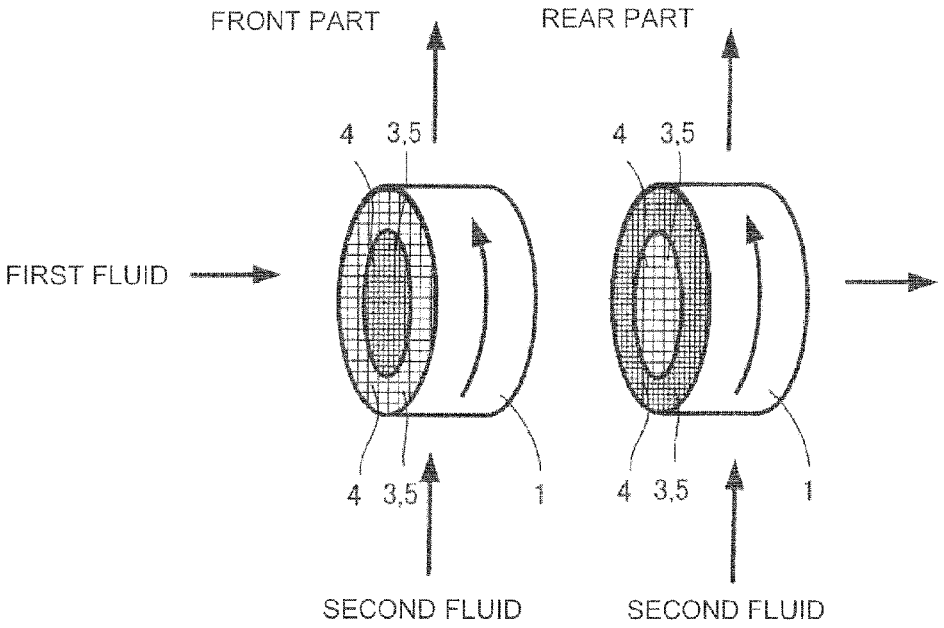
FIG. 32 is a view showing an embodiment of a heat exchanger where the cell density of the honeycomb structure in the front part is high on the inside and low on the outer peripheral side while the cell density of the honeycomb structure in the rear part is low on the inside and high on the outer peripheral side.

FIG. 32 shows an embodiment of a heat exchanger 30 where a plurality of honeycomb structures 1 having regions having different cell distributions are disposed in series in the first fluid flow direction. Specifically, two regions are formed on the inside (center side) and the outer peripheral side in the peripheral direction, and the cell density of the honeycomb structure 1 in the front part (on the upstream side) is high on the inside and low on the outer peripheral side while the cell density of the honeycomb structure 1 in the rear part (on the downstream side) is low on the inside and high on the outer peripheral side. By disturbing the flow of the fluid with a cell structure having different cell density distributions between the front and the rear, the fluid film thickness can be reduced, thereby raising the heat transfer coefficient between the first fluid and the wall faces of the partition walls 4. The number of the regions having different cell densities is not limited to 2 and may be 3 or more.

Figure 33A:
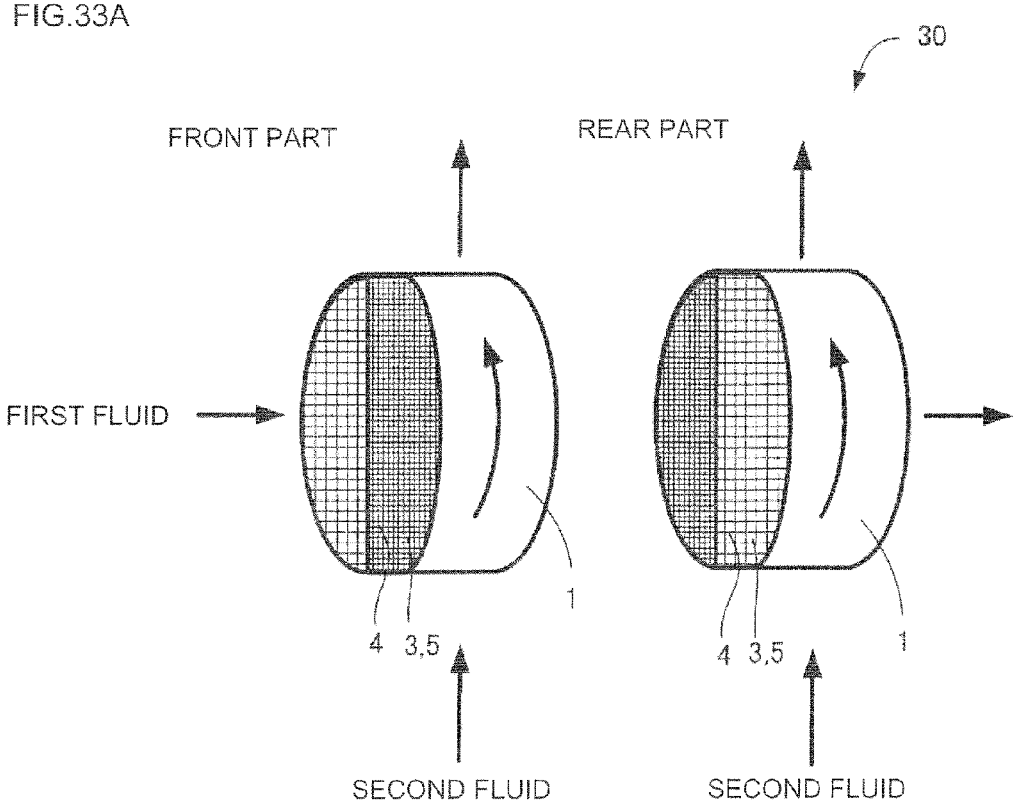
FIG. 33A is a view showing an embodiment of a heat exchanger where a plurality of honeycomb structures are disposed, two semilunar regions having different cell densities are formed in each honeycomb structure, and the cell density distribution is different between the honeycomb structure in the front part and the honeycomb structure in the rear part.
Figure 33B:
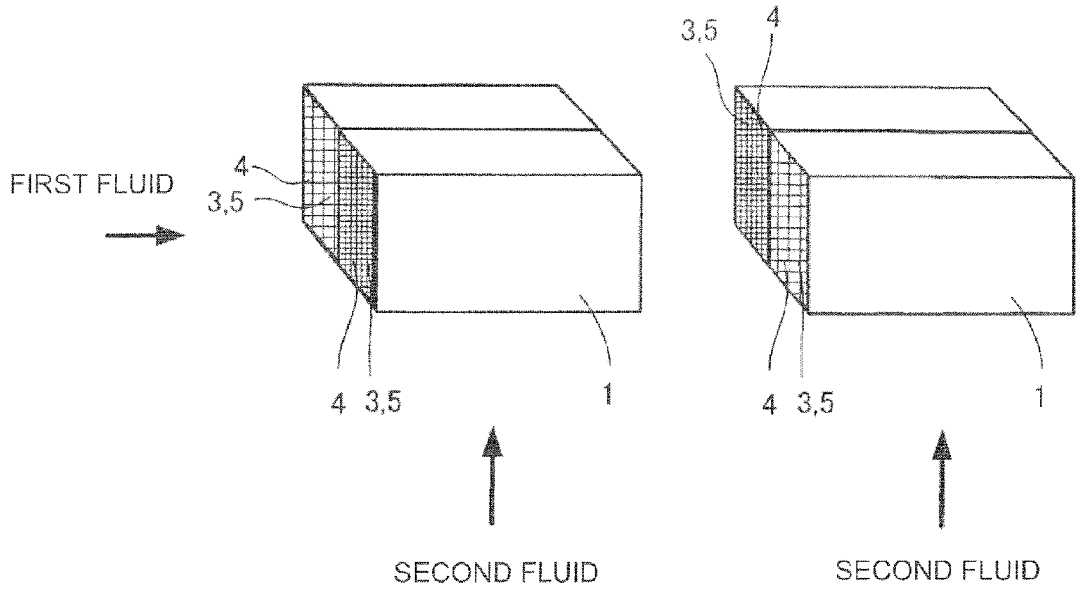
FIG. 33B is a view showing an embodiment of a heat exchanger where a plurality of honeycomb structures are disposed, two prismatic regions having different cell densities are formed in each honeycomb structure, and the cell density distribution is different between the honeycomb structure in the front part and the honeycomb structure in the rear part.

FIG. 33A shows an embodiment of a heat exchanger 30 where a plurality of honeycomb structures 1 having regions having different cell density distributions are disposed in series in the first fluid flow direction. Specifically, two semilunar regions are formed in each honeycomb structure 1, and the right and left (or upper and lower) cell density distribution of the honeycomb structures 1 is made different between the honeycomb structure 1 in the front part (on the upstream side) and the honeycomb structure in the rear part (on the downstream side) upon disposing the honeycomb structures in series. The cell density of the honeycomb structure 1 in the front part is high on one side (right side in the figure) and low on the other side (left side in the figure) while the cell density of the honeycomb structure 1 in the rear part is low on one side (right side in the figure) and high on the other side (left side in the figure). That is, since the cell density in the corresponding portions is different between the honeycomb structure 1 in the front part and the honeycomb structure 1 in the rear part, in other words, the cell structure is that the cell density distribution is different between the front part and the rear part, the flow of the fluid is disturbed. Therefore, the fluid film thickness can be reduced, thereby raising the heat transfer coefficient between the first fluid and the wall faces of the partition walls 4. As shown in FIG. 33B, by disposing quadrangular honeycomb structures 1 each having two regions in series with changing the right and left (or upper and lower) cell density distribution between the honeycomb structure 1 in the front part (on the upstream side) and the rear part (on the downstream side), the flow of the fluid is disturbed, and the heat transfer coefficient can be raised.

Figure 34A:
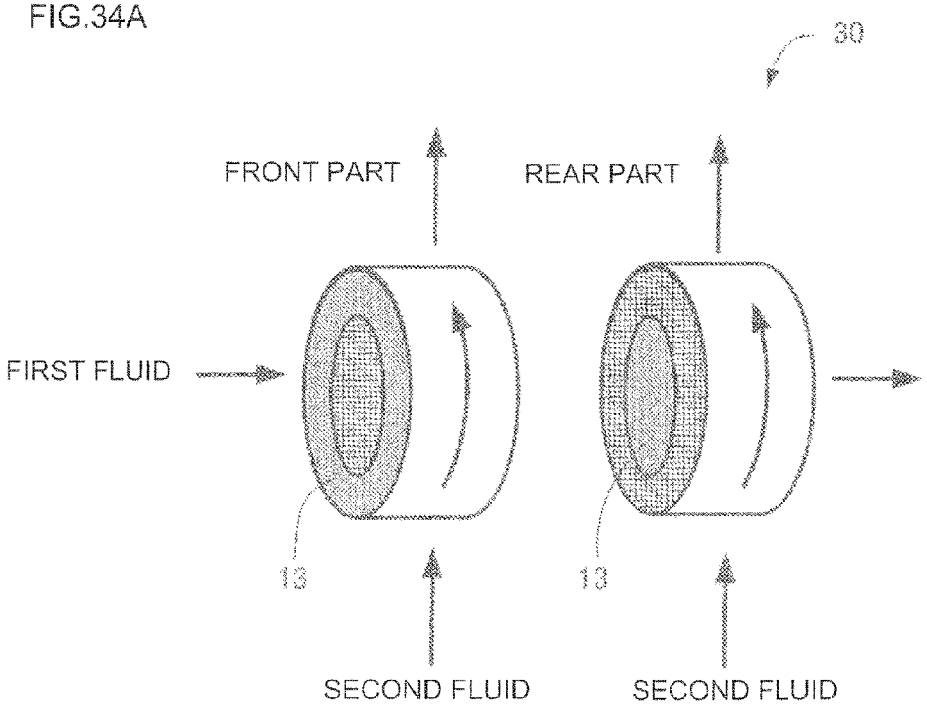
FIG. 34A is a view showing an embodiment of a heat exchanger where the honeycomb structure in the front part is plugged on the outer peripheral side while the honeycomb structure in the rear part is plugged on the inside.
Figure 34B:
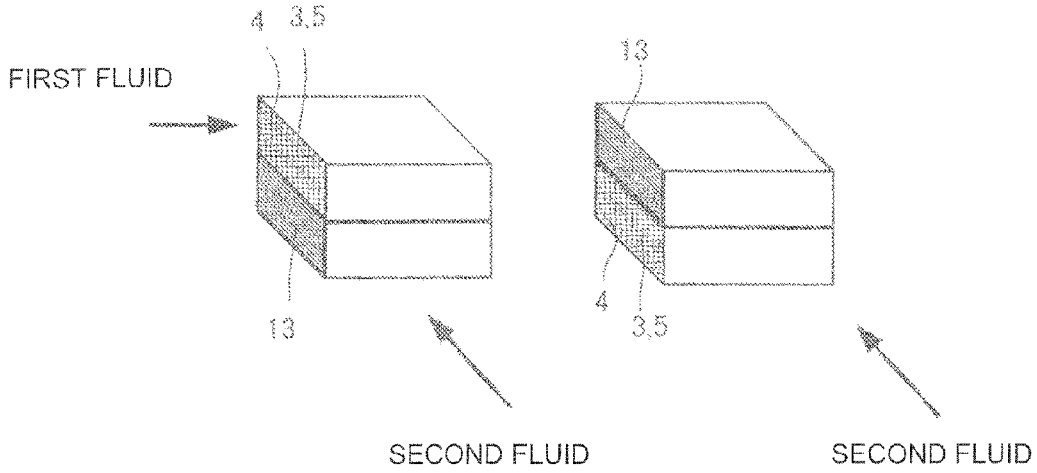
FIG. 34B is a view showing an embodiment of a heat exchanger where honeycomb structures each obtained by combining a plugged prism and an unplugged prism are disposed in the front part and the rear part.

FIG. 34A shows an embodiment of a heat exchanger 30 where a plurality of honeycomb structures 1 are disposed in series in the first fluid flow direction to have a structure where flow passage of the first fluid in the front part and the rear part is changed. Specifically, two regions are formed on the inside (center side) and the outer peripheral side in the peripheral direction, and the honeycomb structure 1 in the front part is plugged with a plugging portion 13 on the outer peripheral side while the honeycomb structure 1 in the rear part is plugged with the plugging portion 13 on the inside. Such a configuration enables to disturb the flow of the fluid. Therefore, the fluid film thickness can be reduced, thereby raising the heat transfer coefficient between the first fluid and the wall faces of the partition walls. FIG. 34B is a view showing an embodiment of a heat exchanger where honeycomb structures 1 each obtained by combining prisms one of which is entirely plugged are disposed in the front part and the rear part. In the front part, the lower region is entirely plugged with the plugging portion 13, and, in the rear part, the upper region is entirely plugged with the plugging portion 13. This enables to change the flow of the first fluid.

Figure 35A:
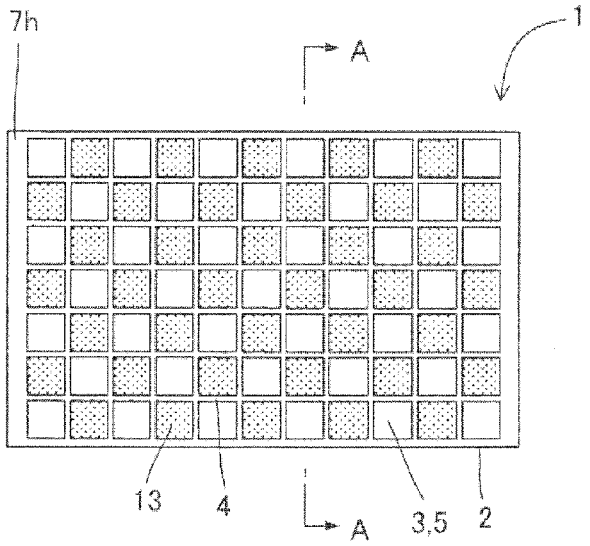
FIG. 35A is a view showing an embodiment of a honeycomb structure where the inlets and the outlets in the first fluid flow portion are alternately plugged.
Figure 35B:
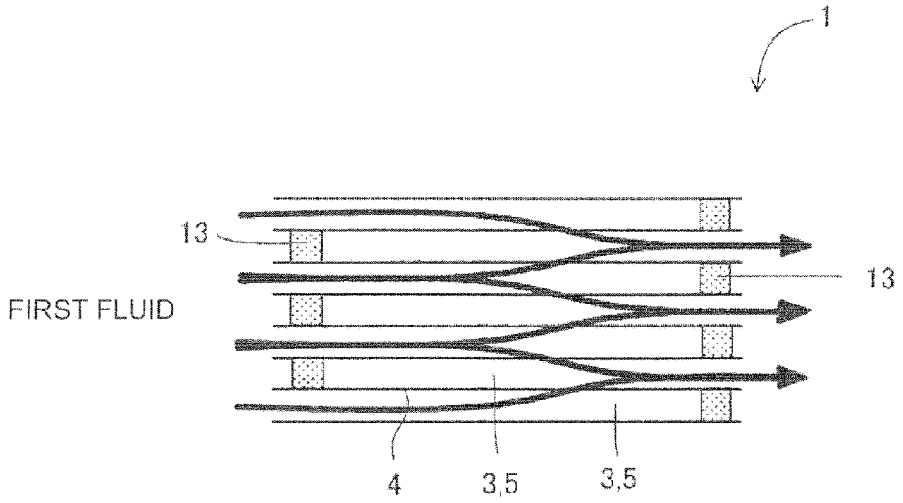
FIG. 35B is an A-A cross-sectional view in FIG. 35A.

FIG. 35A shows an embodiment of a honeycomb structure 1 where the inlets and the outlets in the first fluid flow portion 5 are alternately plugged with the plugging portion 13. FIG. 35B is an A-A cross-sectional view in FIG. 35A. The material for the partition walls 4 is changed depending on the position of the partition walls 4 to have a structure where the first fluid flowing in from the inlet passes through partition walls 4 and flows out from the outlet. By this configuration, the heat collection of the first fluid is performed not on the wall surfaces but inside the porous partition walls 4. Since heat can be collected not on the two dimensional surfaces but three dimensionally, the heat transfer area can be increased.

Figure 35C:
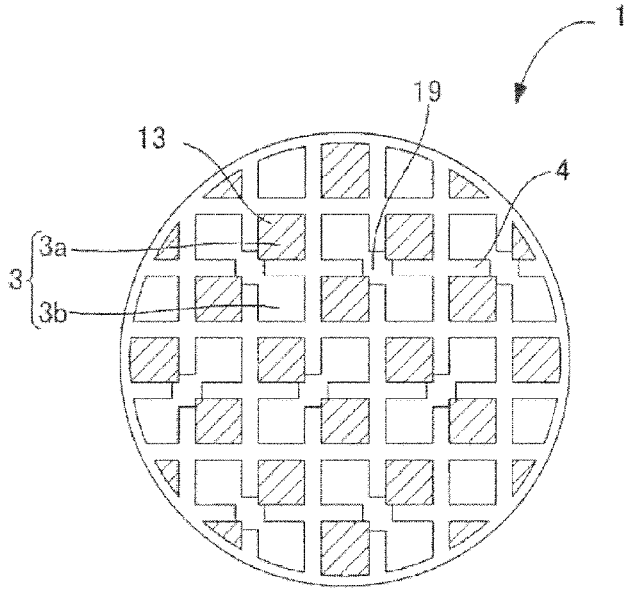
FIG. 35C is a plane schematic view showing an example of an embodiment of a honeycomb structure where a portion having no intersection without partition walls in a portion corresponding to a partition wall intersection portion is formed, viewed from an end face side.

FIG. 35C is a plane schematic view showing an example of an embodiment of a honeycomb structure 1 where a portion 19 having no intersection without partition walls 4 in a portion corresponding to a partition wall intersection portion is formed, viewed from an end face side. The basic structure of the honeycomb structure 1 has a plurality of cells 3 partitioned by the porous partition walls 4 and extending in the axial direction, where one end portion of each of predetermined cells 3*a* is sealed and the other end portion (on the side opposite to the sealed end portions of the predetermined cells 3*a*) of each of the remaining cells 3*b* is plugged with the plugging portion 13.

In the honeycomb structure 1, as a characteristic structure, there is formed a no-intersection portion 19 having no partition wall 4 in the portion corresponding to the partition wall intersection in at least a part of the partition wall intersection portion where a partition wall 4 intersects with another partition wall 4. In the case of a honeycomb structure 1 having such a structure, since a part of exhaust gas passes through the no-intersection portion 19, the pressure loss of the gas can be reduced with maintaining the heat-transfer efficiency.

Figure 36:
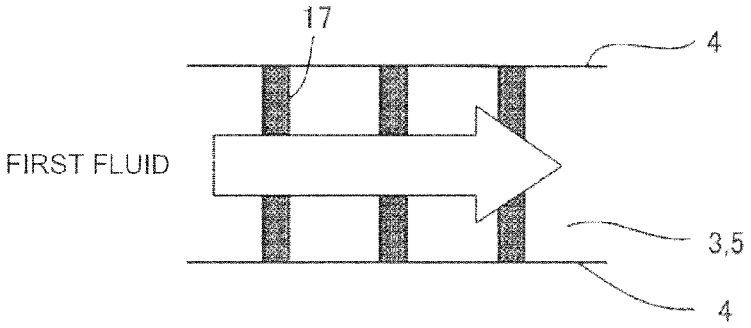
FIG. 36 is a cross-sectional view of the first fluid flow portion, showing an embodiment where porous walls are formed in the first fluid flow portion.

FIG. 36 shows an embodiment where porous walls 17 are formed in the first fluid flow portion 5 functioning as first fluid passage. FIG. 36 is a cross-sectional view of the first fluid flow portion 5. The porous walls 17 in the first fluid flow portion 5 are formed to have a higher porosity than that of the partition walls 4 forming the cells 3. Therefore, in the present embodiment, the first fluid passes through the porous walls 17 and is discharged from the outlet. Since heat can be collected not on the two-dimensional surfaces but three-dimensionally, the heat transfer area can be increased even with the same volume. In addition, the honeycomb structure 1 can be downsized.

Figure 37:
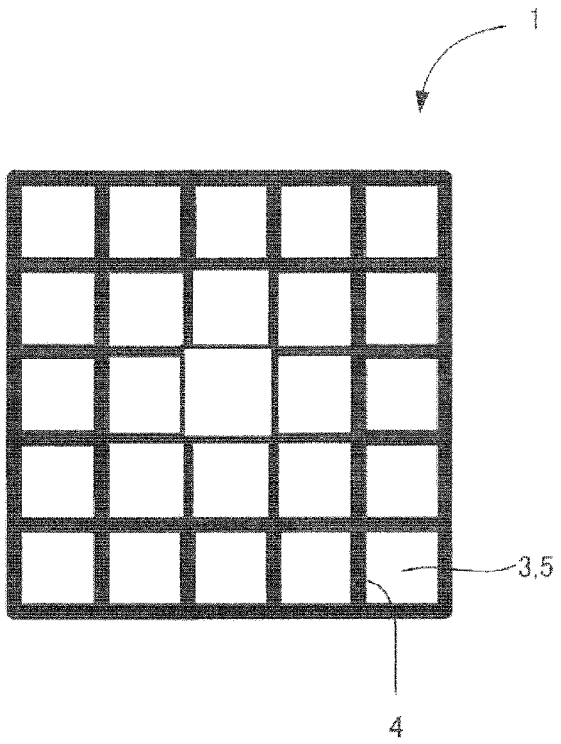
FIG. 37 is a view showing an embodiment of a honeycomb structure where the thickness of the partition walls forming the first fluid flow portion is gradually increased from the center toward the outer periphery in a cross section perpendicular to the axial direction.

FIG. 37 shows an embodiment of a honeycomb structure 1 where the thickness of the partition walls 4 (partition wall thickness) forming the first fluid flow portion 5 is gradually increased from the center toward the outer periphery in a cross section perpendicular to the axial direction. The fin efficiency becomes higher as the partition wall thickness becomes larger when the honeycomb structures 1 have the same size. By thickening the path for transferring heat collected from the cell central portion, the heat conduction in the walls can be increased.

Figure 38:
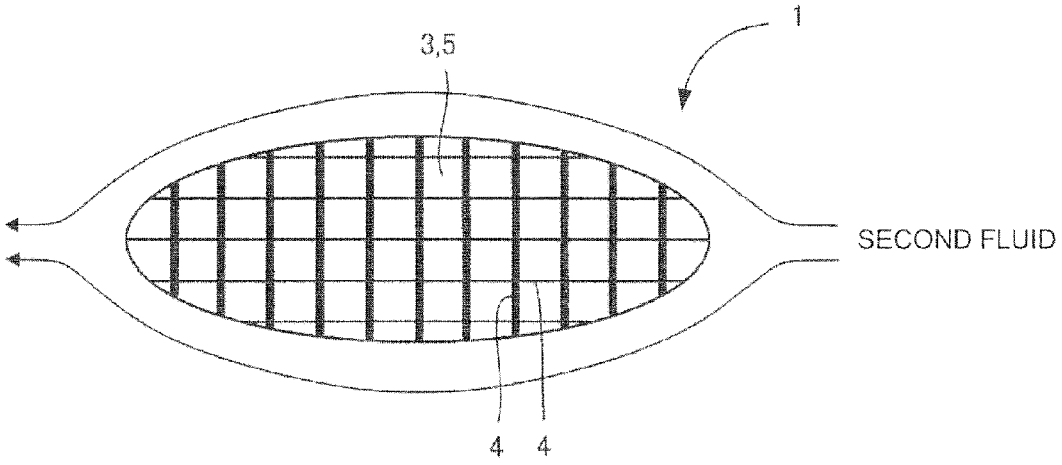
FIG. 38 is a view showing an embodiment of a honeycomb structure where the external shape is elliptic and the partition walls in one direction were made thick.

FIG. 38 shows an embodiment of a honeycomb structure 1 where the external shape is elliptic. In the present embodiment, the partition walls 4 extending in the shorter axial direction were made thick. Since the fin efficiency becomes higher as the thickness of the partition walls 4 becomes larger, the thick walls are disposed perpendicularly to the second fluid to transfer the heat of the first fluid to the second fluid, thereby increasing the total heat conduction. In addition, pressure loss can be reduced in comparison with the increase of the thickness in the entire body. It is also possible to make the shape of the honeycomb structure 1 rectangular.

Figure 39A:
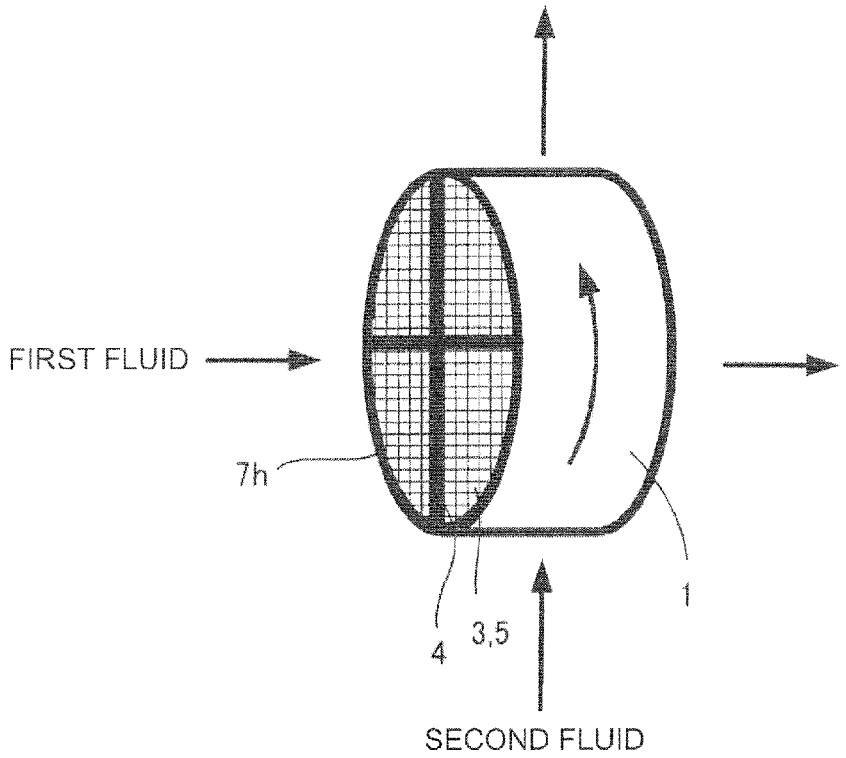
FIG. 39A is a view showing an embodiment of a honeycomb structure where the partition wall thickness is partially changed.
Figure 39B:
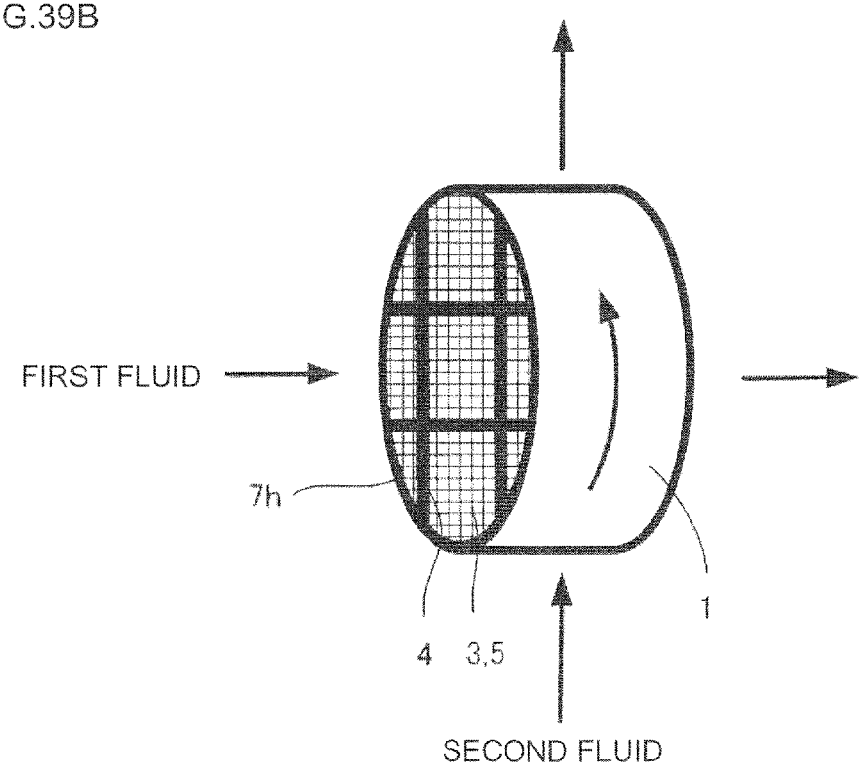
FIG. 39B is a view showing another embodiment of a honeycomb structure where the partition wall thickness is partially changed.

FIGS. 39A and 39B show embodiments of a honeycomb structure 1 where the thickness of the partition walls 4 is partially changed. By partially increasing the thickness of the partition walls 4, heat paths to the outer peripheral wall 7*h* can be formed, and the temperature of the outer peripheral wall 7*h* can be raised. The same effect can be obtained by disposing the thickness of the partition walls 4 in a regular manner or at random.

Figure 40A:
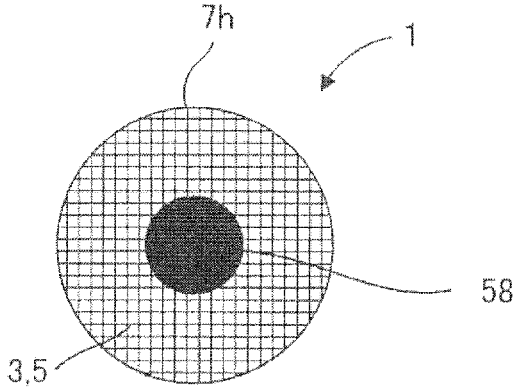
FIG. 40A is a view of an embodiment provided with a heat conductor along the axial direction of the central portion, viewed from the inlet side of the first fluid.
Figure 40B:
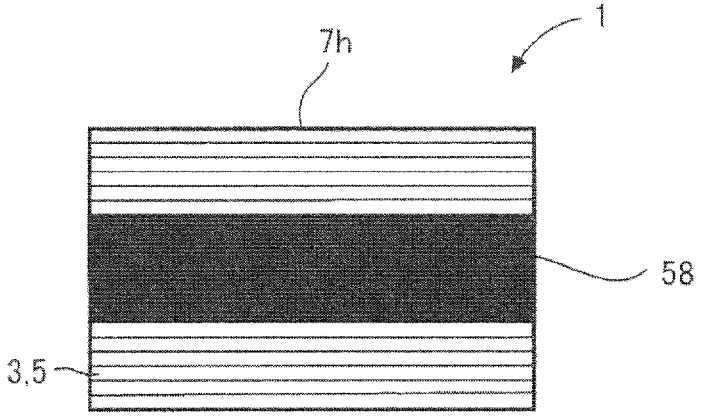
FIG. 40B is a cross-sectional view of a cross section along the axial direction of an embodiment provided with a heat conductor along the axial direction of the central portion.

FIGS. 40A and 40B show an embodiment provided with a heat conductive element 58 along the axial direction in the central portion. Since the first fluid flowing in the cell central portion is far from the outer peripheral wall 7*h* brought into contact with the second fluid, heat is not sufficiently collected. By disposing the heat conductive element 58 along the axial direction in the central portion to conduct high temperature on the inlet side to the downstream position, heat can be collected in the entire honeycomb structure 1. In addition, the transfer distance to the outer peripheral wall 7*h* can be reduced.

Figure 41:
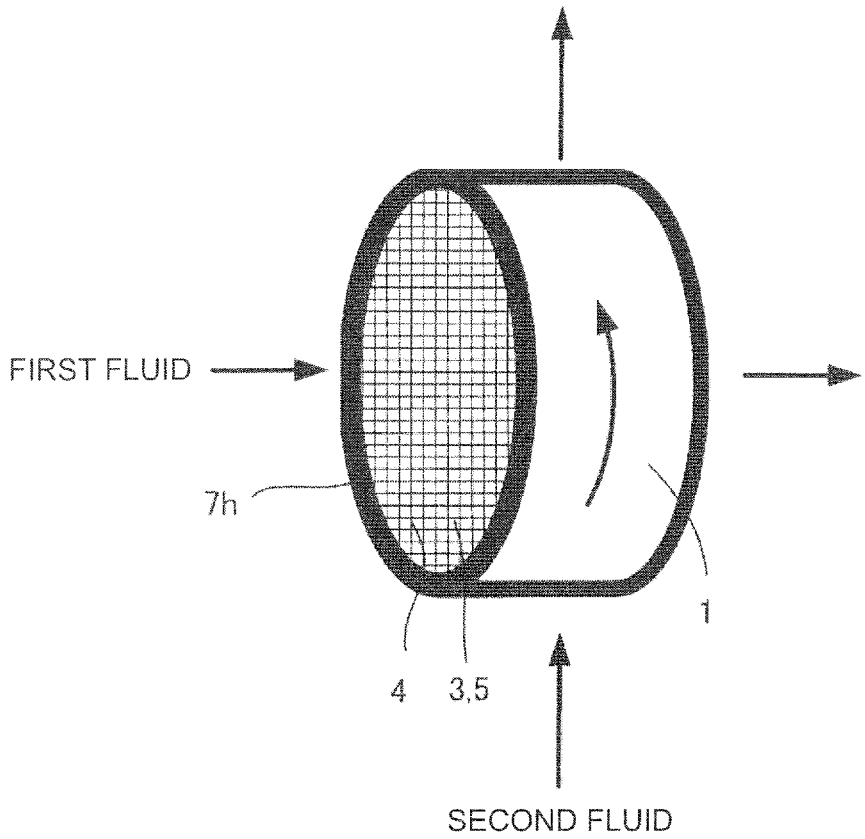
FIG. 41 is a view showing an embodiment where the outer peripheral wall of the honeycomb structure is thicker than the partition walls forming the cells.

FIG. 41 shows an embodiment where the outer peripheral wall 7*h* of the honeycomb structure 1 is made thicker than the partition walls 4 forming the cells 3. Since the outer peripheral wall 7*h* is made thick in comparison with the central portion cell 3, the strength as a structure can be enhanced.

Figure 42:
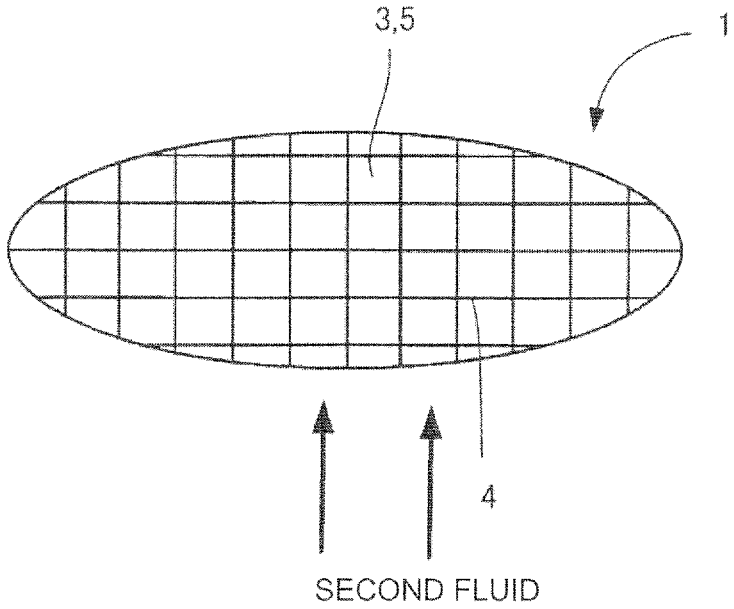
FIG. 42 is a view showing an embodiment where the external shape of the honeycomb structure is flattened.

FIG. 42 shows an embodiment where the external shape of the honeycomb structure forming the honeycomb structure 1 is flattened. In comparison with a circle, the heat transfer path can be shortened in the shorter axial portion, and a water passage pressure loss is smaller than in the case that the external shape of the honeycomb structure 1 is an angled structure.

Figure 43A:
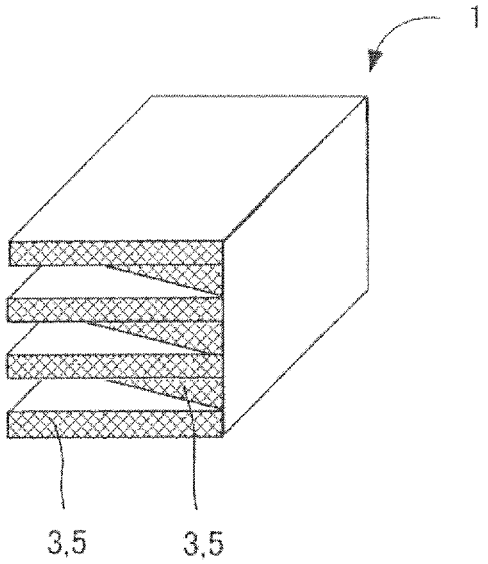
FIG. 43A is a perspective view showing an embodiment where the end face on the first fluid inlet side is inclined.
Figure 43B:
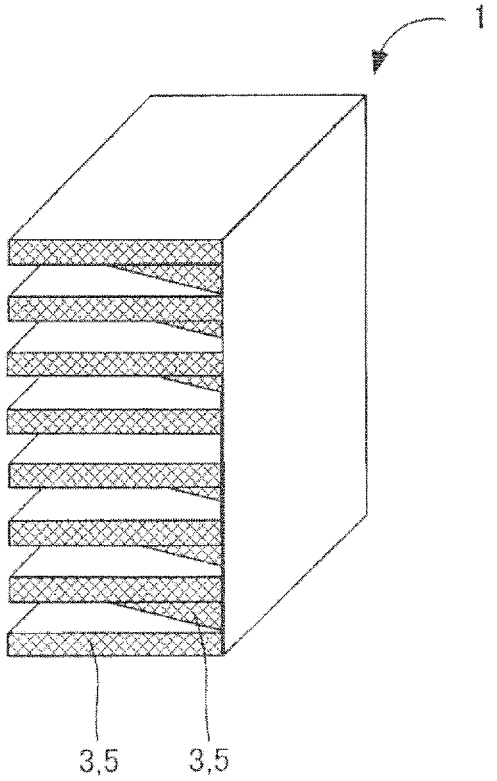
FIG. 43B is a perspective view showing another embodiment where the end face on the first fluid inlet side is inclined.
Figure 43C:
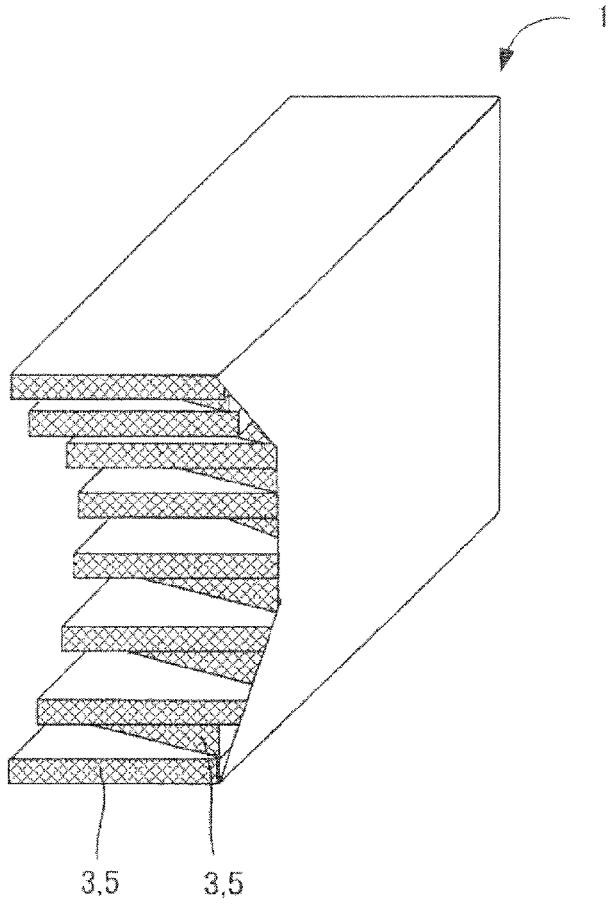
FIG. 43C is a perspective view showing still another embodiment where the end face on the first fluid inlet side is inclined.

FIGS. 43A to 43C show an embodiment where the end face 2 on the first fluid inlet side of the honeycomb structure 1 is inclined. By the inclined formation of the inlet, the area of the contact of a high temperature portion of the first fluid becomes wide, and the total heat transfer area is increased. It is also possible to form the end face on the outlet side to be inclined, and, in this case, the pressure loss can be reduced.

Figure 44:
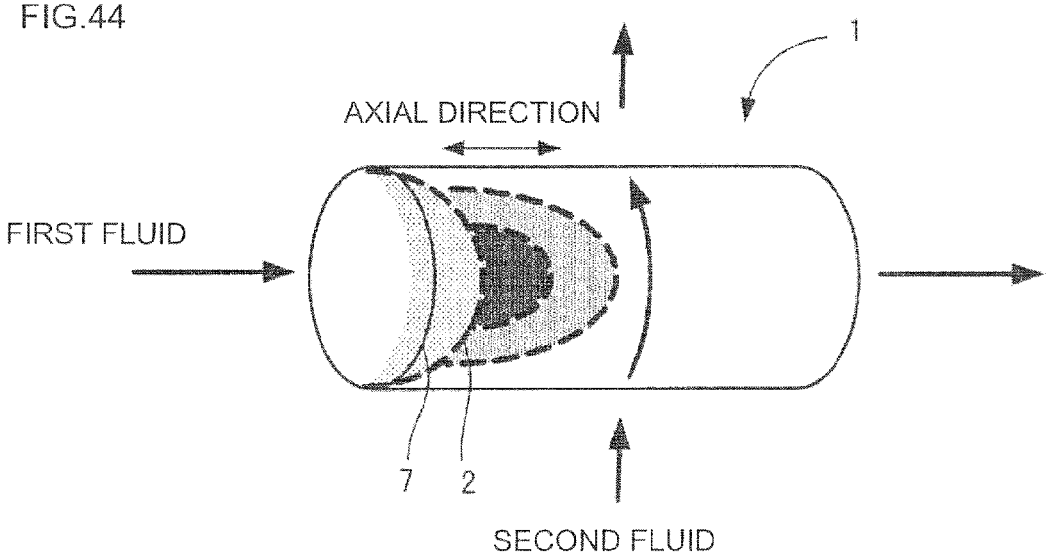
FIG. 44 is a view showing an embodiment where the end face on the first fluid inlet side of the honeycomb structure is formed into a depressed face shape.

FIG. 44 shows an embodiment where the end face 2 on the first fluid inlet side of the honeycomb structure 1 is formed into a depressed face shape. By the formation of a depressed face at the inlet of the first fluid, a high temperature portion of the first fluid is extended backward, and heat-transfer efficiency of the honeycomb backside portion with the second fluid is raised. In addition, by forming the depressed face, the thermal stress at the surface can be made compression stress to be able to maintain high fracture strength.

Figure 45A:
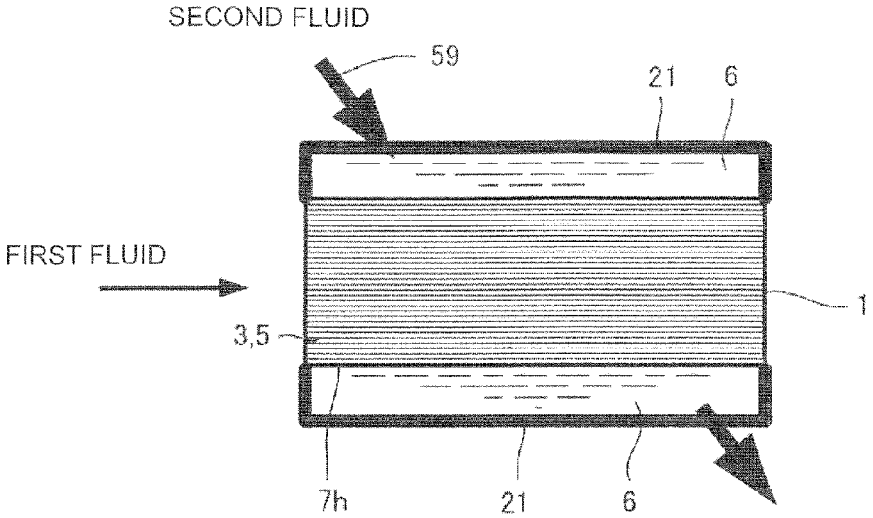
FIG. 45A is a view showing an embodiment where a nozzle is arranged so that the second fluid circles.

FIG. 45A shows an embodiment where a nozzle 59 is arranged on the second fluid inlet side of the second fluid flow portion 6 so that the second fluid circles. By disposing the second fluid inlet on the first fluid outlet side and disposing the nozzle 59 in such a manner that the second fluid outlet is arranged on the first fluid inlet side, the opposed flow with respect to the temperature of the first fluid can be obtained, and the heat exchange performance can be improved.

Figure 45B:
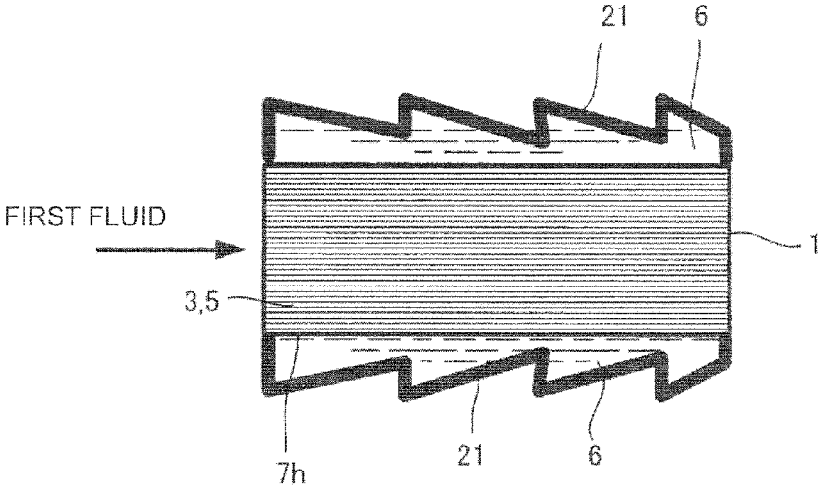
FIG. 45B is a view showing an embodiment where the shape of the second fluid flow portion is saw-like in a cross section along the axial direction.

FIG. 45B shows an embodiment where the passage shape of the second fluid flow portion 6 is changed. Since the shape of the passage is saw-like to have a plurality of level-different portions in a cross section along the axial direction, the heat transfer area increases. In addition, the flow of the fluid can be disturbed, and the fluid film thickness can be reduced, thereby raising the heat transfer coefficient between the second fluid and the outer peripheral wall 7*h*.

Figure 45C:
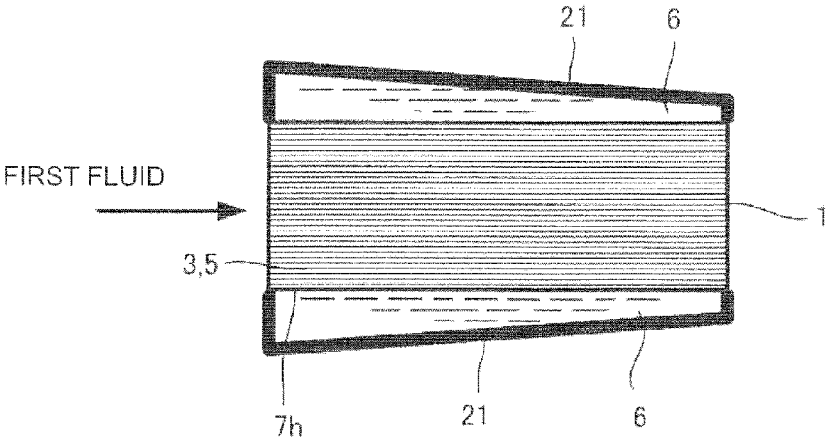
FIG. 45C is a view showing an embodiment where the shape of the passage of the second fluid flow portion becomes smaller toward the downstream side of the first fluid flow portion.

FIG. 45C shows an embodiment where the shape of the passage of the second fluid flow portion 6 becomes smaller toward the downstream side of the first fluid flow portion 5. The flow of the fluid can be disturbed, and the fluid film thickness can be reduced, thereby raising the heat transfer coefficient between the second fluid and the outer peripheral wall 7*h* can be raised. Further, the flow rate of the second fluid on the downstream side of the first fluid flow portion 5 can be raised, and the heat transfer coefficient between the second fluid and the outer peripheral wall 7*h* can be raised even in a low temperature portion, thereby collecting more heat.

Figure 45D:
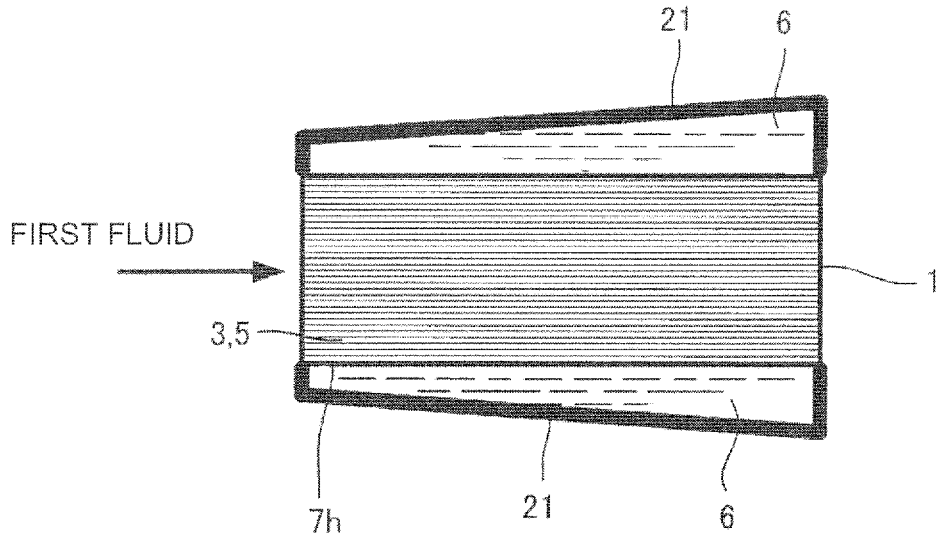
FIG. 45D is a view showing an embodiment where the shape of the passage of the second fluid flow portion becomes larger toward the downstream side of the first fluid flow portion.

FIG. 45D shows an embodiment where the shape of the passage of the second fluid flow portion 6 becomes larger toward the downstream side of the first fluid flow portion 5. In addition, the flow of the fluid can be disturbed, and the fluid film thickness can be reduced, thereby raising the heat transfer coefficient between the second fluid and the outer peripheral wall 7*h*. Further, the flow rate of the second fluid on the upstream side of the first fluid flow portion 5 can be raised, and the heat transfer coefficient between the second fluid and the outer peripheral wall 7*h* can be raised even in a high temperature portion to be able to collect more heat.

Figure 45E:
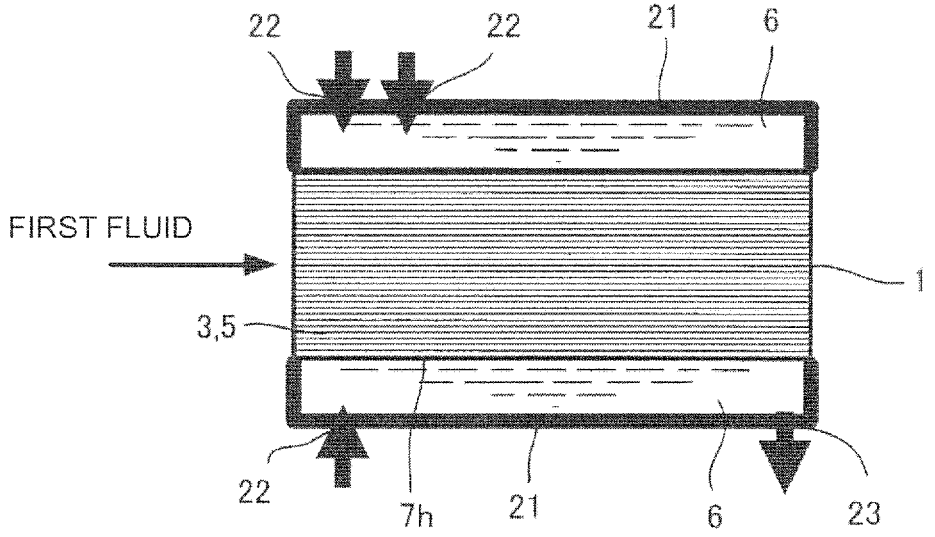
FIG. 45E is a view showing an embodiment where a plurality of inlets for the second fluid are arranged in the high temperature portion.

FIG. 45E shows an embodiment where a plurality of inlets 22 for the second fluid are arranged in the high temperature portion. By the plural inlets 22 for the second fluid, the flow of the fluid can be disturbed, and the fluid film thickness can be reduced, thereby raising the heat transfer coefficient between the second fluid and the outer peripheral wall 7*h*. In addition, by uniformly sending the second fluid having low temperature in a high temperature portion, the heat transfer coefficient between the second fluid and the outer peripheral wall 7*h* can be raised, and more heat can be collected.

Figure 46:
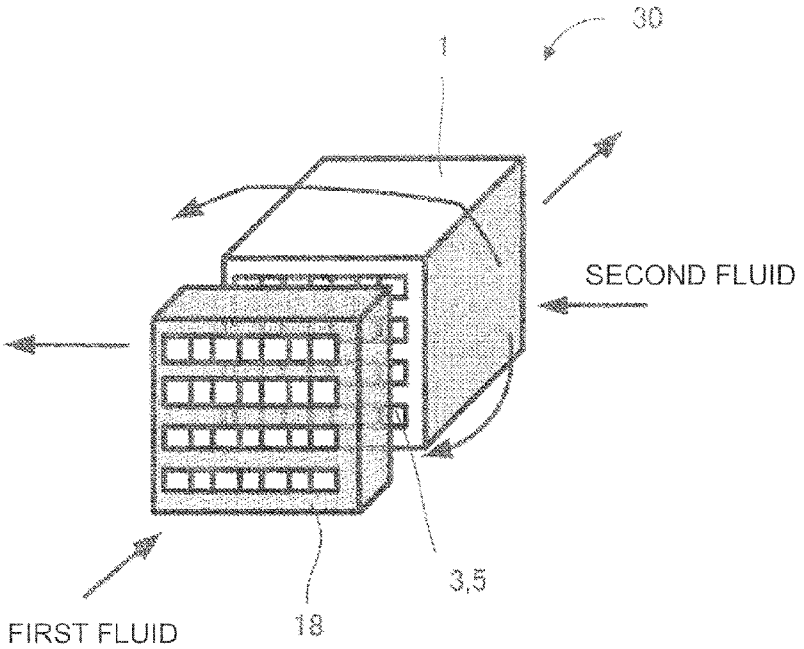
FIG. 46 is a view showing an embodiment of a heat exchanger where an adiabatic plate having the same shape as the cells forming the first fluid flow portion is disposed on the inlet side of the first fluid of the honeycomb structure.

FIG. 46 shows an embodiment of a heat exchanger 30 where an adiabatic plate 18 having the same shape as the cells 3 forming the first fluid flow portion 5 is disposed on the inlet side of the first fluid of the honeycomb structure 1. Since the aperture ratio of the first fluid side inlet is small, in the case of disposing no adiabatic plate, when the first fluid is brought into contact with the outlet side end face, a heat loss is caused on the inlet wall faces. By disposing an adiabatic plate having the same shape as the inlet, the first fluid enters the inside of the honeycomb with the first fluid maintaining the heat, thereby having no heat loss of the first fluid.

Figure 49:
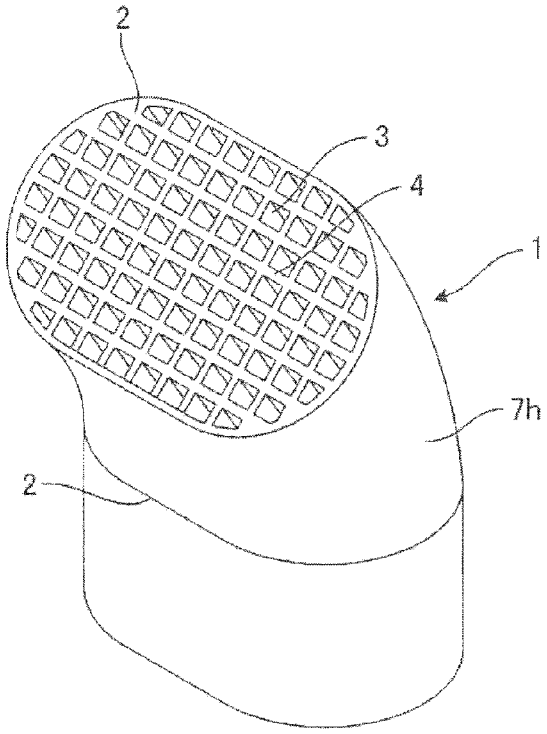
FIG. 49 is a perspective view showing an embodiment where a honeycomb structure is bent in one direction.

FIG. 49 shows an embodiment where the honeycomb structure 1 for allowing the first fluid to flow therein is bent in one direction. The honeycomb structure 1 of the present embodiment is not linear in the longitudinal direction (axial direction) and bent in one direction. The cells 3 extending from one end face 2 to the other end face 2 are bend in a similar manner. This necessarily brings the first fluid (gas) into contact with the inner wall faces of the honeycomb structure 1, thereby increasing the heat exchange amount. When the casing 21 is manufactured in accordance with the shape of the honeycomb structure 1, the heat exchanger 30 can be installed in a space where a heat exchange having an ordinary shape cannot be installed.

Figure 50:
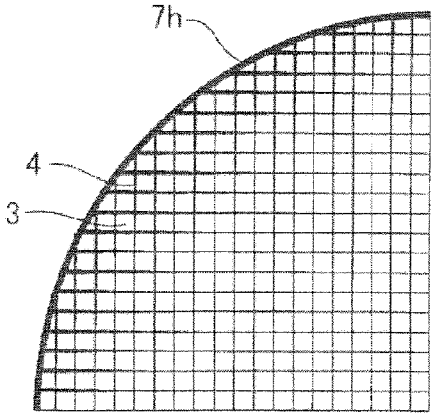
FIG. 50 is a partially enlarged view showing an embodiment of a honeycomb structure where the partition walls of the cells near the outer peripheral wall are made thick.

FIG. 50 shows an embodiment of the honeycomb structure 1 where the partition walls 4 of the cells 3 near the outer peripheral wall 7*h* are made thick. By making thick the partition walls 4 of the cells 3 on the outer peripheral side, heat collected near the center of the honeycomb structure 1 can efficiently be transferred to the outer peripheral wall 7*h*, thereby increasing the heat exchange amount. In addition, the isostatic strength is tried to improve, and the gripping force upon canning can be made strong.

Figure 51A:
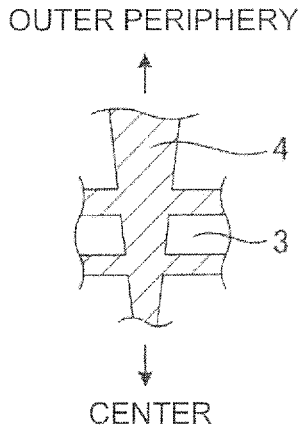
FIG. 51A is a view showing an embodiment 1 of a partition wall which gradually becomes thinner toward the central side of the honeycomb structure.
Figure 51B:
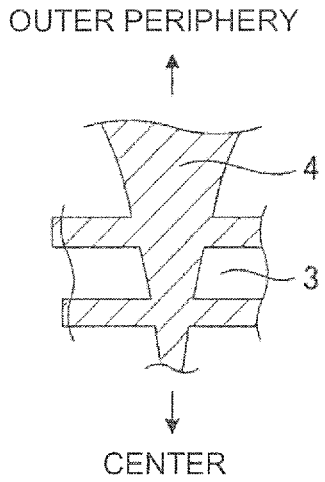
FIG. 51B is a view showing an embodiment 2 of a partition wall which gradually becomes thinner toward the central side of the honeycomb structure.
Figure 51C:
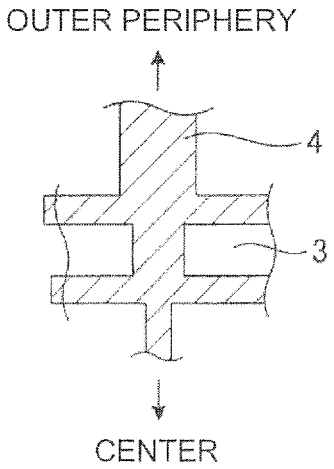
FIG. 51C is a view showing an embodiment 3 of a partition wall which gradually becomes thinner toward the central side of the honeycomb structure.

FIGS. 51A to 51C each shows an embodiment of a honeycomb structure 1 where the thickness of the partition walls 4 of the cells 3 is gradually reduced toward the central side in a cross section perpendicular to the axial direction. FIG. 51A shows an embodiment of a partition wall 4 which gradually becomes thinner linearly toward the central side. FIG. 51B shows an embodiment of a partition wall 4 which curves and becomes thinner toward the central side. FIG. 51C shows an embodiment of a partition wall 4 which becomes thinner in a staircase pattern toward the central side. Since such a configuration enables to efficiently transfer heat collected around the center of the honeycomb structure 1 to the outer peripheral wall 7*h*, the heat exchange amount increases. In addition, the isostatic strength is tried to improve with suppressing the increase in the heat capacity and the pressure loss.

Figure 52A:
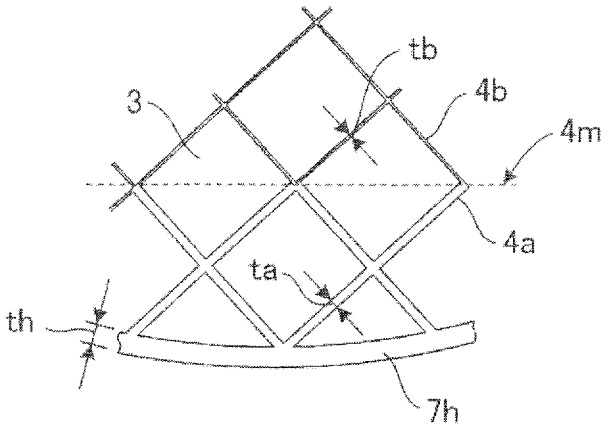
FIG. 52A is a view showing an embodiment of a honeycomb structure where the partition walls of cells just inside the outermost cells are made thick.
Figure 52B:
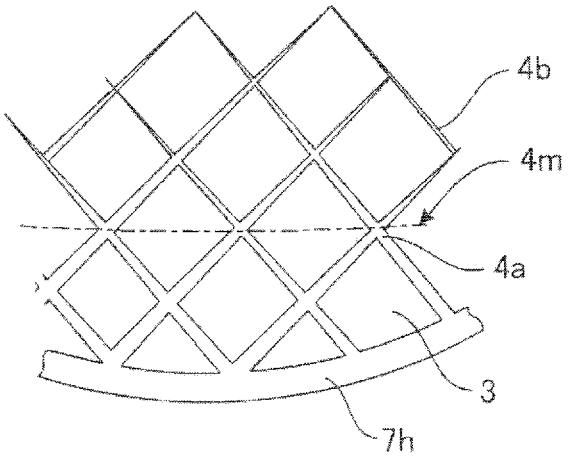
FIG. 52B is a view showing another embodiment of a honeycomb structure where the partition walls of cells just inside the outermost cell are made thick.

FIGS. 52A and 52B show embodiments of a honeycomb structure where the partition walls of cells just inside the outermost cells are made thick. In a range for a few cells from each of the outermost cells, the thickness of the partition walls is increased, and the partition wall thickness is gradually reduced toward the central side until the partition walls have the basic partition wall thickness. It will be described in more detail. In the embodiment of FIG. 52A, the thickness tb of the partition walls 4*b* of the basic cells inside the boundary 4*m* is within the range from 0.7 to 0.9 times the thickness to of the partition walls 4*a* of the outermost cells on the outer peripheral side with respect to the boundary 4*m*. Since the heat collected around the center of the honeycomb structure 1 can efficiently be transferred to the outer peripheral wall 7*h*, thereby increasing the heat exchange amount. In addition, the isostatic strength can be fulfilled.

In the honeycomb structure 1, the thickness to of the outermost peripheral cell partition walls 4*a* is within the range from 0.3 to 0.7 times the thickness th of the outer peripheral wall 7*h* of the honeycomb structure. Since the heat collected around the center of the honeycomb structure 1 can efficiently be transferred to the outer peripheral wall 7*h*, thereby increasing the heat exchange amount. In addition, the isostatic strength can be fulfilled.

As shown in FIG. 52B, by gradually increasing the partition wall thickness in the range of $0.7 \leq tb/ta \leq 0.9$ from the inside cells toward the outermost peripheral cells in the range for 3 cells from the outermost periphery toward inside of the honeycomb structure 1, heat collected around the center of the honeycomb structure 1 can efficiently be transferred to the outer peripheral wall 7*h*, thereby increasing the heat exchange amount. In addition, the isostatic strength, thermal shock resistance, and corner portion strength of the outer peripheral wall can be fulfilled.

Figure 52C:
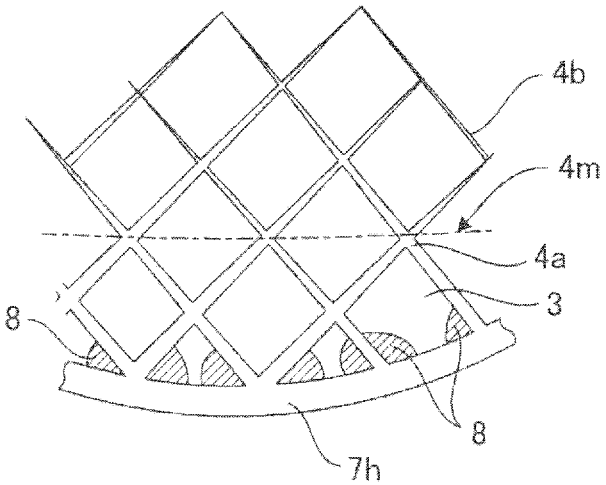
FIG. 52C is a partial cross section explanatory view showing an example where padding is conducted at contact points in the honeycomb structure.
Figure 52D:
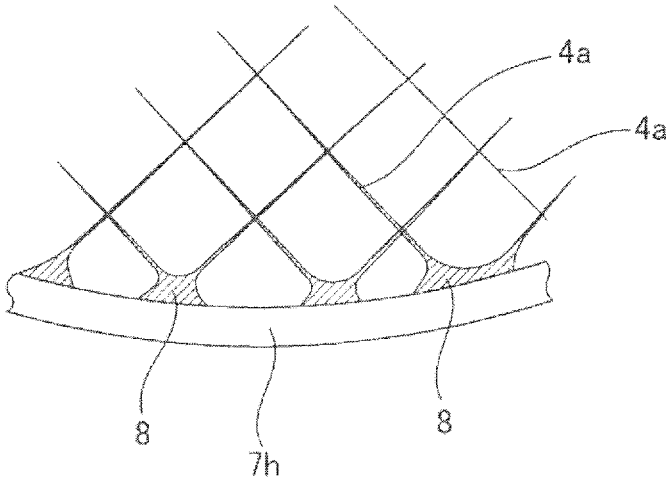
FIG. 52D is a partial cross section explanatory view showing another example where padding is conducted at contact points in the honeycomb structure.

FIG. 52C is a partial cross section explanatory view showing an example where padding 8 is performed at contact points in the honeycomb structure 1. FIG. 52D is a partial cross section explanatory view showing another example where padding 8 is performed at contact points in the honeycomb structure 1. These embodiments show examples where padding is performed at contact points where the outermost cell partition walls 4*a* and the outer peripheral wall 7*h* are brought into contact with each other in the honeycomb structure 1. Such a configuration enables to inhibit the partition walls 4 of the cells 3 from deforming with avoiding excessive increase of the thickness of the outer peripheral wall.

Figure 53A:
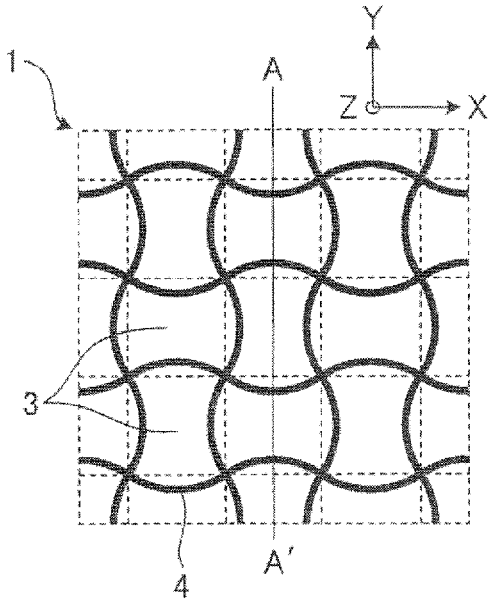
FIG. 53A is a cross-sectional view showing an embodiment of a honeycomb structure having wave-shaped partition walls.
Figure 53B:
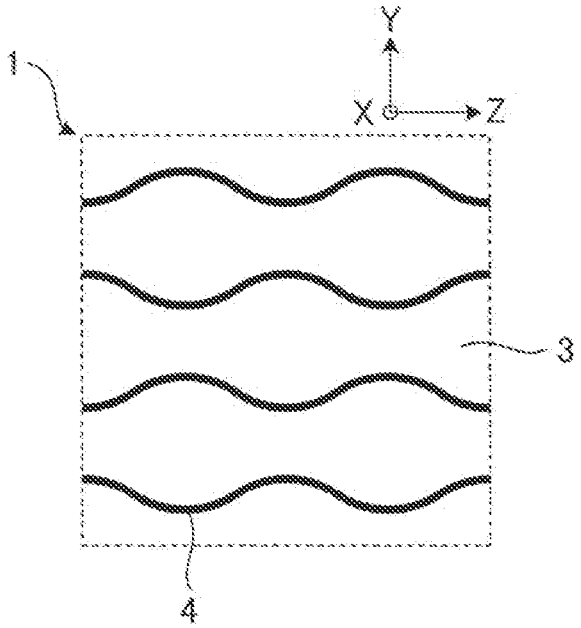
FIG. 53B is a cross-sectional view showing an A-A' cross section of the honeycomb structure having wave-shaped partition walls shown in FIG. 53A.

FIG. 53A shows a cross section of the cell passage of a honeycomb structure 1 having wave-shaped partition walls. In the honeycomb structure 1 having wave-shaped partition walls, the partition walls 4 of an ordinary honeycomb structure 1 having cells 3 shaving a quadrangular (square) shape in a cross section perpendicular to the axial direction are formed into a wave shape. The honeycomb structure 1 having wave-shaped partition walls means a honeycomb structure where a wave-shaped wall is present, including a structure where all the partition walls 4 have a wave shape. In FIG. 53A, the cell passages (axial direction) are in the z-axial direction, and a face perpendicular to the z-axial direction has orthogonal coordinate axes of the X axis and the Y axis. Incidentally, FIG. 53A shows the positions of the partition walls in an ordinary honeycomb structure with dashed lines. FIG. 53B is an A-A' cross-sectional view in FIG. 53A and shows a cross section (Y-Z plane) perpendicular to the cell passage (axial direction).

As in the honeycomb structure 1 having wave-shaped walls, when the wall face portions of the partition walls 4 are formed in a wave shape in both the cell passage direction (axial direction) and the cell passage cross-sectional direction, the surface area of the partition walls 4 can be increased to enhance the interaction between the first fluid and the partition walls can be enhanced. Though the cross-sectional area of the cell passage is almost constant, by the change of the cross-sectional shape, the flow of the first fluid in the cell passage is made unfixed to be able to further enhance the interaction between the first fluid and the partition walls. Thus, the heat-transfer efficiency can be improved.

Figure 54:
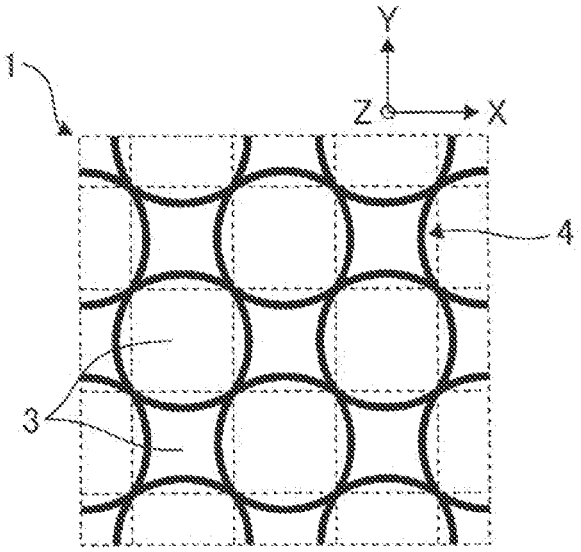
FIG. 54 is a cross-sectional view showing another embodiment of a honeycomb structure having wave-shaped partition walls.

FIG. 54 shows another embodiment of a honeycomb structure 1 having wave-shaped walls. In the cell passage of FIGS. 53A and 53B, the protruding faces of a pair of partition wall faces among two pair of the facing partition walls forming the cell passages face each other. On the other hand, in a honeycomb structure 1 having wave-shaped walls shown in FIG. 54, in two pair of the partition wall faces facing each other and forming the cell passages, both the two pairs have a structure where protruding faces face each other and depressed faces face each other.

Figure 55A:
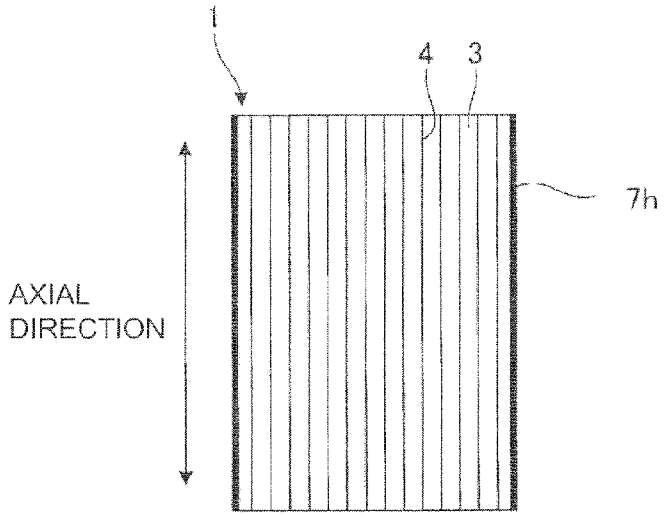
FIG. 55A is a view schematically showing an embodiment of a honeycomb structure having curved partition walls and schematic parallel cross-sectional view showing a cross section parallel to the axial direction.
Figure 55B:
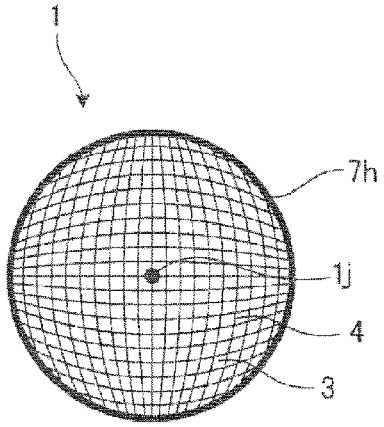
FIG. 55B is a view schematically showing an embodiment of a honeycomb structure having curved partition walls and schematic cross-sectional view showing a cross section perpendicular to the axial direction.

FIGS. 55A and 55B are views schematically showing an embodiment of a honeycomb structure 1 where the partition walls 4 have curved shapes. FIG. 55A is a schematic parallel cross-sectional view showing a cross-section perpendicular to the axial direction, and FIG. 55B is a perpendicular schematic cross-sectional view. The honeycomb structure 1 is provided with plural partition walls 4 partitioning each of the plural cells 3 extending in the axial direction, and as shown in FIG. 55B, the partition walls 4 show a shape curved in a protruding form from the central axis 1*j* toward outside (in the outer peripheral wall 7*h* direction) (hereinbelow referred to as a "positive curve"). By having the partition walls 4 showing a positive curve, the following effect can be obtained.

By the partition walls 4 showing a positive curve, the cell density in the central portion becomes smaller than the cell density in the outer periphery. Therefore, the aperture ratio becomes larger in the central portion than in the outer peripheral portion. In a honeycomb structure 1 having a relatively high cell density, pressure loss becomes large though the heat-transfer efficiency is high. In such a honeycomb structure 1, by providing the partition walls 4 having a positive curve, the first fluid easily flows in the central portion, which reduces the pressure loss.

Figure 56:
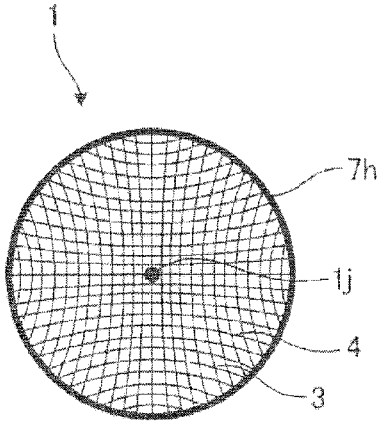
FIG. 56 is a cross-sectional view schematically showing another embodiment of a honeycomb structure having curved partition walls.

FIG. 56 is a cross-sectional view schematically showing another embodiment of a honeycomb structure 1 having curved partition walls 4. The honeycomb structure 1 of the embodiment shown in FIG. 56 has partition walls 4 curved in a protruding shape from outside (outer peripheral wall 7*h* side) toward the central axis 1*j* (hereinbelow referred to as a "negative curve"). By having the partition walls 4 showing a negative curve, the following effect can be obtained.

In a cross section perpendicular to the axial direction, since the partition walls 4 show a negative curve, the cell density of the central portion becomes higher than the cell density of the outer peripheral portion. Therefore, the central portion has a lower aperture ratio than that in the outer peripheral portion. In a honeycomb structure 1 having a relatively low cell density, the heat-transfer efficiency is lowered though the pressure loss is small. In such a honeycomb structure 1, by the partition walls 4 showing a negative curve, the cell density in the central portion becomes larger than that in the outer peripheral portion, thereby raising the heat transfer efficiency. In addition, in a quadrangular cell structure, since the resistance against the external pressure in the diagonal direction of the cell 3 is increased, the strength of the honeycomb structure 1 is also improved.

Figure 57:
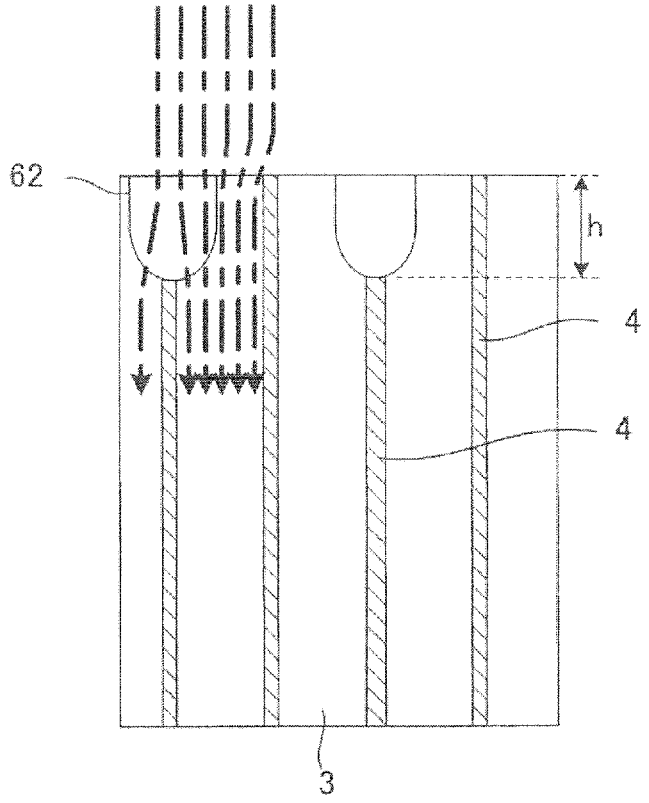
FIG. 57 is a partially enlarged view of a schematic axis-Y cross section showing a form of a honeycomb structure containing partition walls having different height in the axial direction.

FIG. 57 shows an embodiment of a honeycomb structure 1 containing partition walls 4 having different height in the axial direction in one end portion 62. The honeycomb structure 1 is provided with partition walls 4 disposed so as to form a plurality of cells 3 extending in the axial direction from one end portion 62 to the other end portion 62 as shown in FIG. 57, and partition walls 4 having different height in the axial direction in one end portion 62 are included. In FIG. 57, the partition walls 4 having different height h are formed. In one end portion 62, the presence of the partition walls 4 having different height enables the flow of the fluid to be treated becomes smooth in one end portion 62, and the pressure loss of the first fluid (gas) can be reduced.

There is no particular limitation on the heating medium as the first fluid to be allowed to flow through a ceramic heat exchanger of the present invention containing such a honeycomb structure 1 having a configuration as described above as long as it is a medium having heat, such as gas and liquid. An example of gas is automobile exhaust gas. There is no particular limitation on the medium to be heated as the second fluid which receives heat from the heating medium (exchanges heat) as long as it has lower temperature than that of the heating medium, such as gas and liquid. Though water is preferable in consideration of handling, it is not particularly limited to water.

As described above, since the honeycomb structure 1 has a high heat conductivity, and there are plural portions serving as passages depending on the partition walls 4, a high heat-transfer efficiency can be obtained. Therefore, the entire honeycomb structure 1 can be downsized, and it becomes possible to mount the honeycomb structure 1 on an automobile. In addition, the pressure loss is small for the first fluid (high temperature side) and the second fluid (low temperature side).

Next, a method for producing a heat exchanger 30 of the present invention will be described. In the first place, the ceramic forming raw material is extruded to form a honeycomb formed body where a plurality of cells 3 partitioned by ceramic partition walls 4, extending from one end face 2 to the other end face 2, and functioning as fluid passages.

Specifically, the production is as follows. After the honeycomb formed body is formed by extruding a kneaded material containing a ceramic powder into a desired shape, it is dried and fired to be able to obtain a honeycomb structure 1 where a plurality of cells 3 functioning as gas passages are separated and formed by the partition walls 4.

As the material for the honeycomb structure 1, the aforementioned ceramics can be used. For example, in the case of producing a honeycomb structure containing Si-impregnation SiC composite material as the main component, in the first place, predetermined amounts of a C powder, a SiC powder, a binder, and water or an organic solvent are kneaded and formed to obtain a desired shape of a honeycomb formed body. Next, the honeycomb formed body is put in reduced pressure inert gas or vacuum in a metal Si atmosphere, and the formed body is impregnated with metal Si.

Incidentally, in the case of $Si_3N_4$, SiC, or the like, it is possible to form a honeycomb formed body having a plurality of cells 3 separated by the partition walls 4 and functioning as fluid passages by preparing a kneaded material of a forming raw material and extruding the kneaded material in the forming step. This is dried and fired to be able to obtain a honeycomb structure 1. By putting the honeycomb structure 1 in a casing 21, the heat exchanger 30 can be produced.

Since a heat exchanger 30 of the present invention shows high heat-transfer efficiency in comparison with a conventional heat exchanger, the heat exchanger 30 itself can be downsized. Further, since it can be produced from a unitary body by extrusion, the cost can be reduced. The heat exchanger 30 can suitably be used when the first fluid is gas while the second fluid is liquid. For example, it can suitably be used for exhaust heat recovery or the like to improve gasoline mileage of an automobile.

EXAMPLE

Hereinbelow, the present invention will be described in more detail on the basis of Examples. However, the present invention is by no means limited to these Examples.

Examples 1 to 4

There were produced heat exchangers 30 where the first fluid flow portion and the second fluid flow portion were formed by the honeycomb structure 1 and the casing 21 as follows.

(Production of Honeycomb Structure)

After the kneaded material containing a ceramic powder is extruded into a desired shape, it was dried and fired to produce a silicon carbide honeycomb structure 1 having a main body size of 33×33×60 mm.

(Casing)

Figure 10:
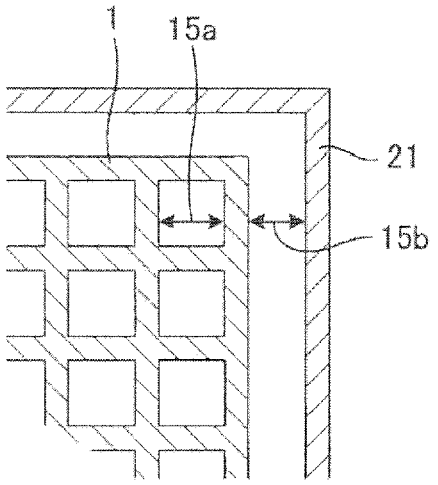
FIG. 10 is a schematic view showing a gap in a heat exchanger of an Example, used for measuring a heat-transfer efficiency.

As the outside container of the honeycomb structure 1, there was used a casing 21 made of stainless steel. In each of the Examples 1 to 4, one honeycomb structure 1 was disposed in a casing 21 (see FIGS. 1A and 1B). As shown in FIG. 10, the distance 15*b* between the honeycomb structure 1 and the casing was made the same as the cell length 15*a* of the honeycomb structure 1. The first fluid flow portion 5 is formed in the honeycomb structure, and the second fluid flow portion 6 is formed in the casing 21 so that the second fluid flows around the outer periphery (outside structure) of the honeycomb structure 1. To the casing 21 were arranged pipes for introduction and discharge of the first fluid to and from the honeycomb structure 1 and the second fluid to and from the casing 21. These two paths are completely isolated from each other lest the first fluid and the second fluid should be mixed together (outer periphery flow structure). The external structure of all the honeycomb structures 1 of Examples 1 to 4 was the same.

Comparative Example 1

There were produced Comparative Example 1 where the first fluid flow portion was formed by a pipe made of SUS304 and where the second fluid flow portion was formed so that the second fluid flows outside the pipe.

Comparative Examples 2 to 4

Figure 11:
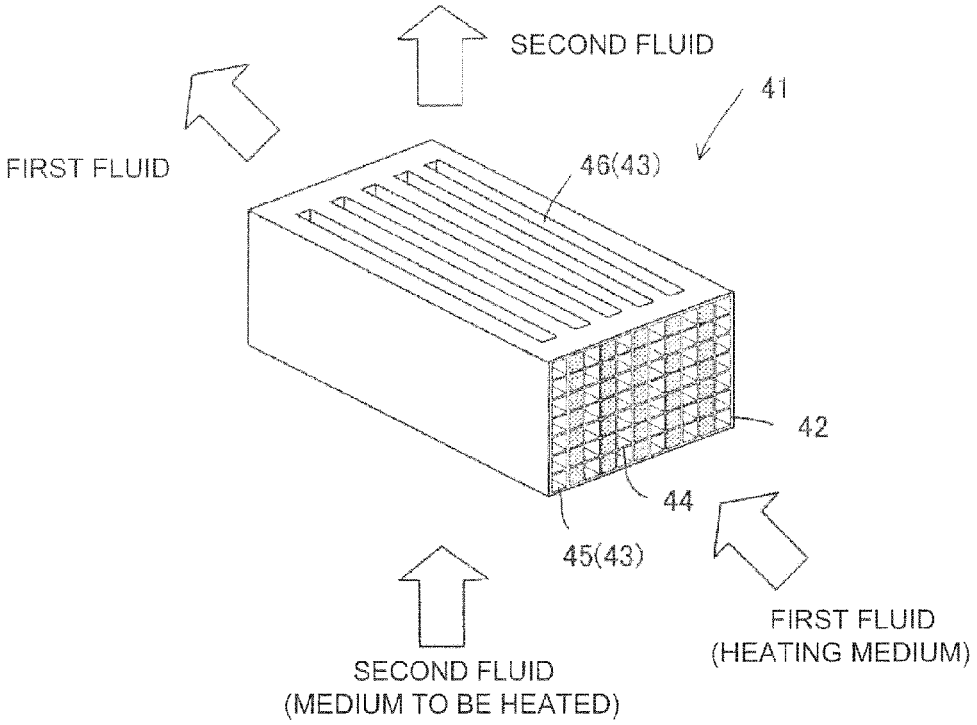
FIG. 11 is a schematic view showing a heat exchange element in heat exchangers of Comparative Examples 2 to 4.

There were produced heat exchangers of Comparative Examples 2 to 4, each being provided with a heat exchange element 41 shown in FIG. 11 in a container. In the heat exchange element 41, the first fluid flow portion 45 having a honeycomb structure having a plurality of cells partitioned by ceramic partition walls 44, extending from one end face 42 to the other end face 42, and allowing a heating medium as the first fluid to flow therein and the second fluid flow portions 46 partitioned by ceramic partition walls 44, extending in the direction perpendicular to the axial direction, and allowing the second fluid to flow therein, and transferring heat to the medium to be heated as the second fluid flowing therein are alternately formed as a unit of plural portions (cross flow structure). Inside of the plugged cells 43, the partition wall 44 isolating plugged cells 43 from each other is removed to be formed into a slit shape (slit structure).

Figure 12:
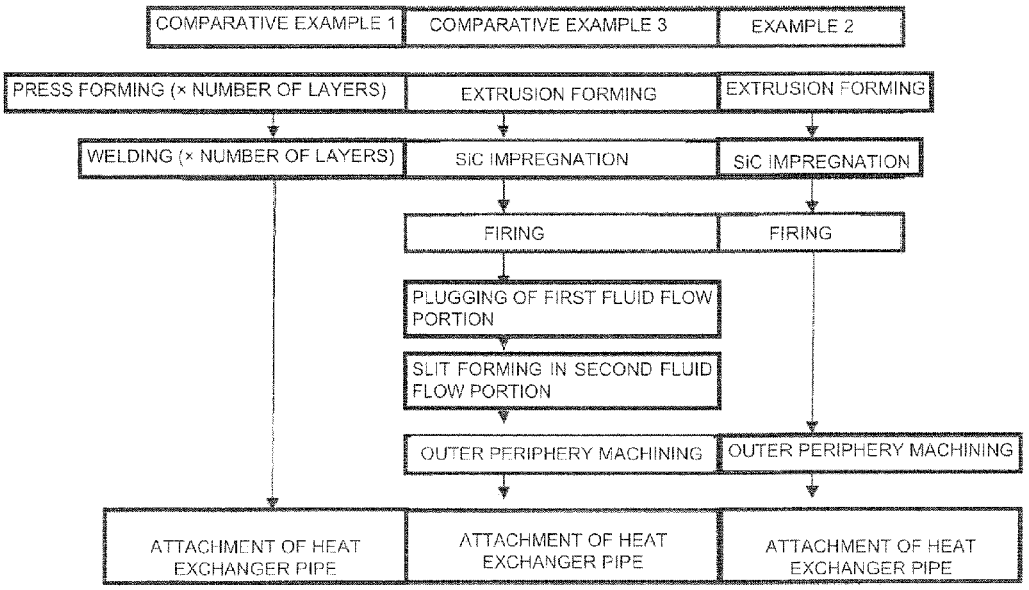
FIG. 12 is a view schematically showing production processes of an Example and Comparative Examples.

FIG. 12 shows the production processes of Example 2, and Comparative Examples 1 and 3 for comparing the production processes. The number of the production steps in Example 2 is smaller than that of Comparative Examples 3. Incidentally, since Comparative Example 1 employs pipes, the production process is far different from that of Examples.

had a dual structure, where a pipe having the second fluid passage was arranged around the outer peripheral portion of the pipe functioning as the first fluid passage. That is, the second fluid flowed outside the pipe for the first fluid. The (cooled) water flowed outside the pipe (gap of 5 mm). The pipe capacity of Comparative Example 1 means a pipe serving as the passage for the first fluid.

(Test Result)

Table 1 shows heat-transfer efficiency. The heat-transfer efficiency (%) was obtained by calculating an energy amount from the ΔT° C. (outlet temperature−inlet temperature of the honeycomb structure 1) of the first fluid (nitrogen gas) and the second fluid (water) using the formula 1.

The heat-transfer efficiency (%)=(inlet temperature of the first fluid (gas)−outlet temperature of the first fluid (gas)/(inlet temperature of the first fluid (gas)−outlet temperature of the second fluid (cooled water))×100 (Formula 1)

TABLE 1

| | Material | Shape: First fluid flow portion | Shape: Second fluid flow portion | Shape: Pathway | Partition wall or honeycomb density [g/cm$^3$] | Partition wall heat-transfer efficiency [W/mK] | Number of cells | Heat-transfer efficiency [%] | Number of steps |
|---|---|---|---|---|---|---|---|---|---|
| Example 1 | Silicon carbide densification by Si-impregnation | Honeycomb structure | Outside structure | Outer periphery flow structure | 3 | 150 | 100 | 92 | 5 |
| Example 2 | Silicon carbide densification by Si-impregnation | Honeycomb structure | Outside structure | Outer periphery flow structure | 3 | 150 | 289 | 92 | 5 |
| Example 3 | Silicon carbide densification by Si-impregnation | Honeycomb structure | Outside structure | Outer periphery flow structure | 5 | 300 | 100 | 96 | 5 |
| Example 4 | Silicon carbide densification by Si-impregnation | Honeycomb structure | Outside structure | Outer periphery flow structure | 5 | 300 | 289 | 96 | 5 |
| Comp. Ex. 1 | SUS304 | Pipe | Outside structure | Outer periphery flow structure | 7.5 | 15 | — | 79 | — |
| Comp. Ex. 2 | Silicon carbide | Honeycomb structure | Slit structure | Cross flow structure | 1.5 | 23 | 91 | 88 | 7 |
| Comp. Ex. 3 | Silicon carbide densification by Si-impregnation | Honeycomb structure | Slit structure | Cross flow structure | 3 | 150 | 91 | 92 | 7 |
| Comp. Ex. 4 | Silicon carbide densification by Si-impregnation | Honeycomb structure | Slit structure | Cross flow structure | 5 | 300 | 91 | 96 | 7 |

(First Fluid and Second Fluid)

All of the first fluid, the temperature of the second fluid at the inlet of the honeycomb structure 1, and the flow rate had the same conditions. Nitrogen gas ($N_2$) at 350° C. was used as the first fluid. Water was used as the second fluid.

(Test Method)

Nitrogen gas is allowed to flow into the first fluid flow portion 5 of the honeycomb structure 1, and (cooled) water was allowed to flow into the second fluid flow portion 6 in the casing 21. The SV (space velocity) of nitrogen gas with respect to the honeycomb structure 1 was 50,000 $h^{-1}$. The flow rate of (cooled) water was 5 L/min. Though the heat exchanger 30 of Comparative Example 1 has a structure which is different from that of the heat exchangers of Example 1 to 4, all the test conditions such as flow rates of the first fluid and the second fluid are made the same. Incidentally, the pipe capacity (honeycomb structure 1 portion) of Comparative Example 1 was the same as the main body capacity (33 cc) of the honeycomb structures 1 of Examples 1 to 4. In the Comparative Example 1, the pipe Comparison Between Examples 1 to 4 and Comparative Example 1

As shown in Table 1, Example 1 showed high heat-transfer efficiency in comparison with Comparative Example 1. This seems because, in Comparative Example 1, the heat-transfer efficiency was low as a whole because it is difficult to sufficiently perform heat exchange in the central portion of the pipe though heat can easily be exchanged with the first fluid (nitrogen gas) on the side closer to the (cooled) water. On the other hand, it is considered that the present invention had high heat-transfer efficiency because it has a honeycomb structure where the wall area where the first gas (nitrogen gas) and (cooled) water are bought into contact with each other is relatively large in comparison with Comparative Example 1.

Comparison Between Examples 1 to 4 and Comparative Examples 2 to 4

Examples 1 to 4 could obtain equivalent or higher heat-transfer efficiency in comparison with Comparative Examples 2 to 4. In addition, since Examples 1 to 4 do not require steps of plugging, slit formation, and the like, the number of steps is small in comparison with Comparative Examples 2 to 4, and production time and production costs could be reduced.

Example 5 to 8

Heat exchangers 30 each having the first fluid flow portion 5 and the second fluid flow portion 6 formed by a honeycomb structure 1 and a casing 21 were produced as follows.

(Production of Honeycomb Structure)

After the kneaded material containing a ceramic powder was extruded into a desired shape, it was dried, fired, and impregnated with Si to produce a: honeycomb structure 1 having silicon carbide as the material and the main body size of 52 mm in diameter×120 mm in length (height).

(Casing)

A coating material was disposed outside the honeycomb structure 1, and a stainless steel casing 21 was used as the outside container. Stainless steel was used as the coating material which was extended from the punching metal, the plate material having no hole, and the honeycomb structure. The gap between the coating material and the casing 21 was 5 mm, and one honeycomb structure 1 was disposed in the casing in Examples 5 to 8 (see FIG. 1A and FIG. 1B). As shown in FIG. 10, the gap 15*b* between the honeycomb structure 1 having a coating material disposed thereon and the casing was 1 mm (the coating material is not shown in FIG. 10). The first fluid flow portion 5 was formed to have a honeycomb structure, and the second fluid flow portion 6 was formed so as to have a flow in the outer periphery (outside structure) of the honeycomb structure 1 in the casing 21. To the casing 21 were attached pipes for introducing the first fluid into the honeycomb structure 1, discharging the first fluid from the honeycomb structure 1, introducing the second fluid into the casing 21, and discharging the second fluid from the casing 21. Incidentally, these two paths were completely isolated from each other lest the first fluid and the second fluid should be mixed together (outer peripheral flow structure). In addition, the external shape structure of all the honeycomb structures 1 of Examples 5 to 8 was the same.

(First Fluid and Second Fluid)

All of the first fluid, the temperature of the second fluid at the inlet of the honeycomb structure 1, and the flow rate had the same conditions. Nitrogen gas ($N_2$) at 350° C. was used as the first fluid. Water was used as the second fluid. Nitrogen gas was allowed to flow into the first fluid flow portion 5 of the honeycomb structure 1, and (cooled) water was allowed to flow into the second fluid flow portion 6 in the casing 21. The flow rate of the nitrogen gas with respect to the honeycomb structure 1 was 3.8 L/s. The flow rate of the (cooled) water was 5 L/min.

TABLE 2

| | Structure | Heat-transfer efficiency |
|---|---|---|
| Example 5 | No coating | 92% |
| Example 6 | Partial coating | 92% |
| Example 7 | Complete coating | 92% |
| Example 8 | Completely coated extended outer peripheral wall | 95% |

Examples 5 to 8 and Comparative Example 1

As shown in Table 2, the heat-transfer efficiency is not changed between Examples 6 to 8 having the coating and Example 5 having no coating, which shows no difference in heat exchange performance by coating. As a result, even when breakage is caused in the honeycomb structure 1, mixing of the first fluid and the second fluid can be inhibited by disposing the coating material, and it is considered that the heat exchange performance can be maintained. In particular, a completely coated body has a large effect of inhibiting the first fluid and the second fluid from being mixed together. Further, Example 8 where the honeycomb structure 1 is provided with the extended outer peripheral wall 51 had high heat-transfer efficiency. This seems to be because the heat is exchanged also in the second passage portion outside the honeycomb structure 1.

INDUSTRIAL APPLICABILITY

There is no particular limitation on the field where a heat exchanger of the present invention is used, such as an automobile field and an industrial field, as long as the heat exchanger is used for exchanging heat between the heating medium (high temperature side) and the medium to be heated (low temperature side). In the case that it is used for collecting exhaust heat from exhaust gas in an automobile field, it can be used for improving gasoline mileage of an automobile.

DESCRIPTION OF REFERENCE NUMERALS

1: honeycomb structure, 1*h*: complementary honeycomb structure, 1*j*: central axis, 2: end face (in axial direction), 2*t*: tapered face, 3: cell, 3*f*: fin, 4: partition wall, 4*a*: outermost peripheral cell partition wall, 4*b*: basic cell partition wall, 4*m*: boundary, 5: first fluid flow portion, 6: second fluid flow portion, 7: outer peripheral face, 7*h*: outer peripheral wall, 8: padding at contact point, 9: fin, 13: plugging portion, 15*a*: cell length of honeycomb structure, 15*b*: distance between honeycomb structure and casing, 19: no intersection portion, 21: casing, 21*a*: cylindrical portion, 21*b*: outside casing portion, 22: inlet (of second fluid), 23: outlet (of second fluid), 24: inner peripheral face, 25: inlet (of first fluid), 26: outlet (of first fluid), 28: spring, 29: accordion portion, 30: heat exchanger, 41: heat exchange element, 42: end face, 43: cell, 44: partition wall, 45: first fluid flow portion, 46: second fluid flow portion, 51: extended outer peripheral wall, 51*a*: attached extended outer peripheral wall, 52: honeycomb portion, 53: sealing portion, 55: punching metal, 55*a*: hole of (punching metal), 58: heat conductive element, 59: nozzle, 62: end portion.

The invention claimed is:

1. A heat exchanger comprising:

a first fluid flow portion formed of a honeycomb structure having a plurality of cells partitioned by ceramic partition walls and surrounded by a ceramic continuous outer peripheral face, with the plurality of cells extending from one end face to another end face of the honeycomb structure in an axial direction to allow a heating medium as a first fluid to flow therein, and a second fluid flow portion formed of a casing containing the honeycomb structure therein, the casing having an inlet and an outlet for a second fluid, and the second fluid flowing on the ceramic continuous outer peripheral face of the honeycomb structure in direct contact with a metal plate configured to cover and thus be in direct contact with the entire outer peripheral face, the second fluid being in direct contact with the metal plate at least at the entire portion of the metal plate where the entire outer peripheral face of the honeycomb structure is held, so as to receive heat from the first fluid.

2. The heat exchanger according to claim 1, wherein the first fluid is gas, the second fluid is liquid, and the first fluid has higher temperature than that of the second fluid.

3. The heat exchanger according to claim 1, having a fin for transferring heat from and to the second fluid flowing in the second fluid flow portion on the metal plate.

4. The heat exchanger according to claim 1, wherein the metal plate is a cylindrical portion configured so as to fit the entire outer peripheral face of the honeycomb structure and have a structure where the second fluid is not brought into direct contact with the outer peripheral face of the honeycomb structure.

5. The heat exchanger according to claim 1, wherein a tube formed of one of metal and ceramics having an internal portion that serves as the second fluid flow portion is wound in the form of a winding around the metal plate.

6. The heat exchanger according to claim 1, wherein the honeycomb structure has an extended outer peripheral wall formed so as to cylindrically extend outside in an axial direction from at least one of the one end face and the another end face of the honeycomb structure in the axial direction.

7. The heat exchanger according to claim 6, wherein the casing is formed cylindrically in the form of covering a part of the metal plate outside the metal plate, the second fluid flows in the casing and is brought into direct contact with the metal plate to receive heat from the first fluid, and a honeycomb portion having the cells formed by the partition walls is disposed downstream with respect to the second fluid flow portion in the axial direction.

8. The heat exchanger according to claim 6, wherein the casing is formed cylindrically in the form of covering a part of the metal plate outside the metal plate, the second fluid flows in the casing and is brought into direct contact with the metal plate to receive heat from the first fluid, and the second fluid flow portion is disposed downstream in the axial direction with respect to the honeycomb portion having the cells formed by the partition walls.

9. The heat exchanger according to claim 1, wherein the first fluid flow portion is constituted in such a manner that a plurality of honeycomb portions having the cells formed by the partition walls are disposed in line in the axial direction, with each of the honeycomb portions having a face direction of the partition walls and the honeycomb portions are disposed to be coaxially aligned and rotated such that directional orientations of the partition walls are different between the respective honeycomb portions in a cross section perpendicular to the axial direction.

10. The heat exchanger according to claim 1, wherein the first fluid flow portion is constituted so that a plurality of honeycomb portions having the cells formed by the partition walls are disposed in line in the axial direction, the honeycomb portions have different cell densities, and the honeycomb portions are disposed so that a honeycomb portion on the outlet side of the first fluid has a higher cell density than that of a honeycomb portion on the inlet side of the first fluid.

11. The heat exchanger according to claim 1, wherein a plurality of honeycomb structures are disposed in the casing so that outer peripheral faces of the plurality of honeycomb structures face each other in a state of having a gap therebetween for allowing the second fluid to flow therein.

* * * * *